US011668231B2

(12) United States Patent
Wahl et al.

(10) Patent No.: US 11,668,231 B2
(45) Date of Patent: Jun. 6, 2023

(54) TRANSFER MECHANISM FOR A SPLIT-CYCLE ENGINE

(71) Applicant: Tour Engine, Inc., San Diego, CA (US)

(72) Inventors: Michael H. Wahl, Bonita, CA (US); Amit Helfand, San Diego, CA (US); Gilad Tour, San Diego, CA (US); Yehoram Hofman, San Diego, CA (US); Hugo Benjamin Tour, San Diego, CA (US); Oded Tour, San Diego, CA (US)

(73) Assignee: Tour Engine, Inc., San Diego, CA (US)

( * ) Notice: Subject to any disclaimer, the term of this patent is extended or adjusted under 35 U.S.C. 154(b) by 0 days.

(21) Appl. No.: 17/292,394

(22) PCT Filed: Nov. 8, 2019

(86) PCT No.: PCT/US2019/060627
§ 371 (c)(1),
(2) Date: May 7, 2021

(87) PCT Pub. No.: WO2020/097569
PCT Pub. Date: May 14, 2020

(65) Prior Publication Data

US 2022/0010724 A1 Jan. 13, 2022

Related U.S. Application Data

(60) Provisional application No. 62/758,380, filed on Nov. 9, 2018.

(51) Int. Cl.
*F02B 41/06* (2006.01)

(52) U.S. Cl.
CPC ..... *F02B 41/06* (2013.01)

(58) Field of Classification Search
CPC ..... F02B 41/06; F02B 33/22; F02F 1/242
(Continued)

(56) References Cited

U.S. PATENT DOCUMENTS 393,597 A 11/1888 Westinghouse
1,372,216 A 3/1921 Casaday
(Continued)

FOREIGN PATENT DOCUMENTS

CN 102777253 11/2012
DE 10 2010 032055 1/2012
(Continued)

OTHER PUBLICATIONS

International Preliminary Report on Patentability for PCT/US14/47076, dated Jan. 19, 2016, 4 pages.
(Continued)

*Primary Examiner* — Lindsay M Low
*Assistant Examiner* — Omar Morales
(74) *Attorney, Agent, or Firm* — Morrison & Foerster LLP

(57) ABSTRACT

A split-cycle engine includes: a compression chamber, housing a first piston, that induces and compresses working fluid; an expansion chamber, housing a second piston, that expands and exhausts the working fluid; and a transfer chamber, housing a third piston and a fourth piston, wherein the third piston and the fourth piston move relatively to vary a volume within the transfer chamber and to selectively fluidly couple the volume within the transfer chamber to the compression chamber and the expansion chamber. A method of operating an engine includes: inducing working fluid in a first chamber; compressing the working fluid in the first chamber; moving a first moveable boundary of a second chamber; moving a second moveable boundary of the second chamber; expanding the working fluid in the third
(Continued)

Hot Side Crank Angle: 45° chamber; and exhausting the working fluid from the third chamber.

27 Claims, 28 Drawing Sheets

(58) Field of Classification Search
USPC ..... 123/52.1
See application file for complete search history.

(56) References Cited

U.S. PATENT DOCUMENTS

| | | | |
|---|---|---|---|
| 1,374,140 | A | 4/1921 | Dock |
| 2,302,442 | A | 11/1942 | Hickey |
| 2,522,649 | A | 10/1945 | Tenney |
| 2,404,395 | A | 7/1946 | Humphreys |
| 2,657,553 | A | 11/1953 | Cornelius |
| 3,145,527 | A | 8/1964 | Morgenroth |
| 3,522,797 | A | 8/1970 | Stinebaugh |
| 3,880,126 | A | 4/1975 | Thurston et al. |
| 4,199,945 | A | 4/1980 | Finkelstein et al. |
| 4,202,300 | A | 5/1980 | Skay |
| 4,630,447 | A | 12/1986 | Webber |
| 4,663,938 | A | 5/1987 | Colgate |
| 4,794,752 | A | 1/1989 | Redderson |
| 5,040,498 | A | 8/1991 | Scherer |
| 5,345,765 | A | 9/1994 | Kinnersly |
| 5,546,897 | A | 8/1996 | Brackett |
| 5,551,382 | A | 9/1996 | Bauer |
| 6,205,788 | B1 | 3/2001 | Warren |
| 6,487,858 | B2 | 12/2002 | Cammack |
| 6,880,501 | B2 | 4/2005 | Suh et al. |
| 7,050,900 | B2 | 5/2006 | Miller |
| 7,177,751 | B2 | 2/2007 | Froloff |
| 7,178,324 | B2 | 2/2007 | Sakita |
| 7,263,963 | B2 | 9/2007 | Price |
| 7,806,101 | B2 | 10/2010 | Hu |
| 8,006,656 | B2 | 8/2011 | Branyon |
| 8,082,892 | B2 | 12/2011 | Zhao |
| 8,210,138 | B2 | 7/2012 | Scuderi |
| 8,210,147 | B2 | 7/2012 | Cotton |
| 8,371,256 | B2 | 2/2013 | Durrett et al. |
| 8,459,227 | B2 | 6/2013 | Cotton |
| 8,590,497 | B2 | 11/2013 | Meldolesi |
| 8,714,121 | B2 | 5/2014 | Philips |
| 8,904,981 | B2 | 12/2014 | Fiveland |
| 9,435,233 | B2 | 9/2016 | Tour et al. |
| 10,107,178 | B2 | 10/2018 | Tour et al. |
| 10,253,724 | B2 | 4/2019 | Tour et al. |
| 10,378,431 | B2 | 8/2019 | Tour et al. |
| 10,598,080 | B2 | 3/2020 | Tour et al. |
| 11,230,965 | B2 | 1/2022 | Tour et al. |
| 2003/0015171 | A1 | 1/2003 | Scuderi |
| 2009/0056670 | A1 | 3/2009 | Zhao et al. |
| 2009/0150060 | A1 | 6/2009 | Branyon |
| 2009/0199829 | A1 | 8/2009 | Branyon et al. |
| 2009/0250046 | A1 | 10/2009 | Scuderi |
| 2009/0266347 | A1 | 10/2009 | Scuderi et al. |
| 2010/0012071 | A1 | 1/2010 | Cotton |
| 2010/0186689 | A1 | 7/2010 | Tour et al. |
| 2010/0269806 | A1 | 10/2010 | Kreuter |
| 2011/0149034 | A1 | 6/2011 | Tsukagoshi |
| 2011/0220075 | A1 | 9/2011 | Meldolesi |
| 2012/0080017 | A1 | 4/2012 | Philips |
| 2012/0192841 | A1 | 8/2012 | Medolesi |
| 2012/0255296 | A1 | 10/2012 | Philips |
| 2012/0298086 | A1 | 11/2012 | Scuderi |
| 2013/0118426 | A1* | 5/2013 | Kreuter ..... F01L 7/02 123/90.1 |
| 2016/0040623 | A1 | 2/2016 | Spiesberger |

FOREIGN PATENT DOCUMENTS

| | | |
|---|---|---|
| FR | 1 084 655 | 1/1955 |
| FR | 2 963 644 | 2/2012 |
| GB | 135 571 | 11/1918 |
| GB | 2 135 423 | 8/1984 |
| GB | 2 469 939 | 11/2010 |
| JP | H-06173763 | 6/1994 |
| JP | 2004-536252 | 12/2004 |
| JP | 2011-506833 | 3/2011 |
| JP | 2012-180835 | 9/2012 |
| WO | WO-2006/099106 | 9/2006 |
| WO | WO-2011/115868 | 9/2011 |
| WO | WO-2012/044723 | 4/2012 |
| WO | WO-2015/109256 | 7/2015 |
| WO | WO-2015/177035 | 11/2015 |

OTHER PUBLICATIONS

International Search Report and Written Opinion for PCT/US14/47076, dated Nov. 25, 2014, 5 pages.
Supplementary European Search Report for EP 14825949.2, dated Feb. 17, 2017, 5 pages.
Supplementary European Search Report for EP 18192515.7, dated Jan. 2, 2019, 6 pages.
First Office Action (translation) for CN 201480050777.7, dated Sep. 27, 2017, 4 pages.
Supplemental European Search Report for EP 15736989.3, dated Sep. 13, 2017, 6 pages.
Notice of Reasons for Rejection for JP 2016-527108, dated Apr. 18, 2018 7 pages (English translation only).
Notice of Reasons for Rejection for JP 2016-565121, dated May 16, 2018, 8 pages (English translation only).
Notice of Reasons for Rejection for JP 2016-565121, dated Mar. 27, 2019, 8 pages (English translation only).
International Search Report and Written Opinion for PCT/US2015/011856, dated May 11, 2015, 7 pages.

* cited by examiner

Hot Side Crank Angle: 45°

Hot Side Crank Angle: 0°

Hot Side Crank Angle: 30°

Hot Side Crank Angle: 60°

Hot Side Crank Angle: 90°

Hot Side Crank Angle: 120°

Hot Side Crank Angle: 150°

Hot Side Crank Angle: 180°

Hot Side Crank Angle: 210°

Hot Side Crank Angle: 240°

Hot Side Crank Angle: 270°

Hot Side Crank Angle: 300°

Hot Side Crank Angle: 330°

Hot Side Crank Angle: 45°

Hot Side Crank Angle: 0°

Hot Side Crank Angle: 10°

Hot Side Crank Angle: 19°

Hot Side Crank Angle: 45°

Hot Side Crank Angle: 0°

Hot Side Crank Angle: 12°

Hot Side Crank Angle: 23°

TRANSFER MECHANISM FOR A SPLIT-CYCLE ENGINE

CROSS REFERENCE TO RELATED APPLICATIONS

This application is a National Stage application under 35 U.S.C. § 371 of International Application No. PCT/US2019/060627, filed internationally on Nov. 8, 2019, which claims the benefit of priority to U.S. Provisional Application No. 62/758,380, filed Nov. 9, 2018, the contents of which are hereby incorporated by reference in their entirety.

FIELD OF THE DISCLOSURE

This disclosure relates generally to split-cycle engines and, in particular, to systems and methods of regulating fluid flow between a compression and an expansion chamber of split-cycle engines.

BACKGROUND OF THE DISCLOSURE

Conventional internal combustion engines include one or more cylinders. Each cylinder includes a single piston that performs four strokes, commonly referred to as the intake, compression, combustion/power/expansion, and exhaust strokes. Together, these four strokes form a complete cycle of the engine, carried out during two complete revolutions of the crankshaft. Each part of the cycle is affected differently by the heat rejected from the working fluid into the piston and cylinder walls: during induction and compression a high rate of heat rejection improves efficiency whereas during combustion/expansion, little or no heat rejection leads to best efficiency. This conflicting requirement cannot be satisfied by a single cylinder since the piston and cylinder wall temperature cannot readily change from cold to hot and back to cold within each cycle. A single cylinder of a conventional internal combustion engine cannot be optimized both as a compressor (requires cold environment for optimal efficiency performance) and a combustor/expander (requires hot environment and optimal expansion of the working fluid for optimal efficiency performance) at the same time and space.

Conventional internal combustion engines have low fuel efficiency—more than one half of the fuel energy is lost through as heat through the engine structure and exhaust outlet, without adding any useful mechanical work. A major cause of thermal waste in conventional internal combustion engines is the essential cooling system (e.g., radiator). which alone dissipates heat at the same or similar rate and quantity as the total heat actually transformed into useful work. Furthermore, conventional internal combustion engines are able to increase efficiencies only marginally by employing low heat rejection methods in the cylinders, pistons and combustion chambers and by waste-heat recovery methodologies that add substantial complexity and cost.

Further inefficiency results from high-temperature in the cylinder during the intake and compression strokes. This high temperature reduces engine volumetric efficiency and makes the piston work harder and, hence, reduces efficiency during these strokes.

A larger expansion ratio than compression ratio will greatly increase engine efficiency in an internal combustion engine. In conventional internal combustion engines, the maximum expansion ratio is typically the same as the maximum compression ratio. Moreover, conventional means may only allow for a decrease in compression ratio via valve timing (Miller and Atkinson cycles, for example) and may be less efficient than the increase in efficiency, which is possible in split-cycle engines where all four strokes are not executed in a single cylinder.

Another shortcoming of conventional internal combustion engines is an incomplete chemical combustion process, which reduces efficiency and causes harmful exhaust emissions.

To address these problems, others have previously disclosed split-cycle engine configurations. For example U.S. Pat. No. 1,372,216 to Casaday discloses a split-cycle combustion engine in which cylinders and pistons are arranged in respective pairs. The piston of the firing cylinder moves in advance of the piston of the compression cylinder. U.S. Pat. No. 3,880,126 to Thurston et al. discloses a two-stroke split-cycle internal combustion engine. The piston of the induction cylinder moves somewhat less than one-half stroke in advance of the piston of the power cylinder. The induction cylinder compresses a charge, and transfers the charge to the power cylinder where it is mixed with a residual charge of burned products from the previous cycle, and further compressed before igniting. U.S. Pat. Application No. 2003/0015171 A1 to Scuderi discloses a four-stroke cycle internal combustion engine. A power piston within a first cylinder (power cylinder) is connected to a crankshaft and performs power and exhaust strokes of the four-stroke cycle. A compression piston within a second cylinder (compression cylinder) is also connected to the crankshaft and performs the intake and compression strokes of a four-stroke cycle during the same rotation of the crankshaft. The power piston of the first cylinder moves in advance of the compression piston of the second cylinder. U.S. Pat. No. 6,880,501 to Suh et al. discloses an internal combustion engine that has a pair of cylinders, each cylinder containing a piston connected to a crankshaft. One cylinder is adapted for intake and compression strokes. The other cylinder is adapted for power and exhaust strokes. U.S. Pat. No. 5,546,897 to Brackett discloses a multi-cylinder reciprocating piston internal combustion engine that can perform a two, four, or diesel engine power cycle.

SUMMARY OF THE DISCLOSURE

The references described above, however, fail to disclose how to effectively govern the transfer of the working fluid in a timely manner and without significant pressure loss from the compression cylinder to the power cylinder, using a working fluid transfer mechanism.

In view of the foregoing disadvantages inherent in the known types of internal combustion engine now present in the prior art, embodiments described herein include a split-cycle internal combustion engine with differentiated cylinders. In some embodiments, the split-cycle internal combustion engine with differentiated cylinders described herein more efficiently converts fuel energy into mechanical work, better controls the amount of exhaust gas return (EGR), and can decrease EGR in the split-cycle engine. In some embodiments, a transfer cylinder facilitates a more efficient and more reliable transfer of working fluid from a compression chamber to the expansion chamber. In some embodiments, the transfer chamber includes two pistons which can move relatively (e.g., laterally within the transfer chamber) to selectively fluidly couple the transfer chamber with the compression chamber and the expansion chamber (e.g., the movement of the two pistons can cause the transfer chamber to fluidly couple with none, one, or both of the compression chamber and the expansion chamber). In some embodiments, working fluid transfers from the compression chamber into the transfer chamber. In some embodiments, working fluid transfers from the transfer chamber to the expansion chamber. In some embodiments, the transfer chamber reduces or minimizes EGR from the expansion chamber to the transfer chamber and from the transfer chamber to the compression chamber. Reducing or minimizing EGR reduces or minimizes dilution of the working fluid of the next engine cycle. Thus, reducing or minimizing EGR can improve combustion, increase the engine's volumetric efficiency, and increase the engine's overall efficiency. The transfer cylinder, including the two pistons, is referred to as a Two Piston Transfer Mechanism (hereinafter 2PTM). A 2PTM can allow a split-cycle engine to have improved control over when the transfer chamber is fluidly coupled to the compression chamber and when the transfer chamber is fluidly coupled to the expansion chamber. Thus, the split-cycle engine can more precisely control the compression and expansion ratios of the split-cycle engine, can implement asymmetry in the compression and expansion strokes to improve the efficiency, and can more precisely control the transfer of working fluid from the compression chamber to the expansion chamber.

DETAILED DESCRIPTION

In view of the foregoing disadvantages inherent in the known types of internal combustion engine now present in the prior art, embodiments described herein include a split-cycle internal combustion engine with differentiated cylinders. In some embodiments, the split-cycle internal combustion engine with differentiated cylinders described herein more efficiently converts fuel energy into mechanical work, better controls the amount of EGR, and can decrease EGR in the split-cycle engine. In some embodiments, a transfer cylinder facilitates a more efficient and more reliable transfer of working fluid from a compression chamber to the expansion chamber. In some embodiments, the transfer chamber includes two pistons which can move relatively (e.g., laterally within the transfer chamber) to selectively fluidly couple the transfer chamber with the compression chamber and the expansion chamber (e.g., the movement of the two pistons can cause the transfer chamber to fluidly couple with none, one, or both of the compression chamber and the expansion chamber). In some embodiments, working fluid transfers from the compression chamber into the transfer chamber. In some embodiments, working fluid transfers from the transfer chamber to the expansion chamber. In some embodiments, the transfer chamber reduces or minimizes EGR from the expansion chamber to the transfer chamber and from the transfer chamber to the compression chamber. Reducing or minimizing EGR reduces or minimizes dilution of the working fluid of the next engine cycle. Thus, reducing or minimizing EGR can improve combustion, increase the engine's volumetric efficiency, and increase the engine's overall efficiency. A 2PTM can allow a split-cycle engine to have improved control over when the transfer chamber is fluidly coupled to the compression chamber and when the transfer chamber is fluidly coupled to the expansion chamber. Thus, the split-cycle engine can more precisely control the compression and expansion ratios of the split-cycle engine, can implement asymmetry in the compression and expansion strokes to improve the efficiency, and can more precisely control the transfer of working fluid from the compression chamber to the expansion chamber. Although embodiments of this disclosure focus on the 2PTM, it is understood that the disclosure is not limited to the use of a 2PTM and other transfer mechanisms that achieve the same or similar benefits are contemplated.

Figure 1:
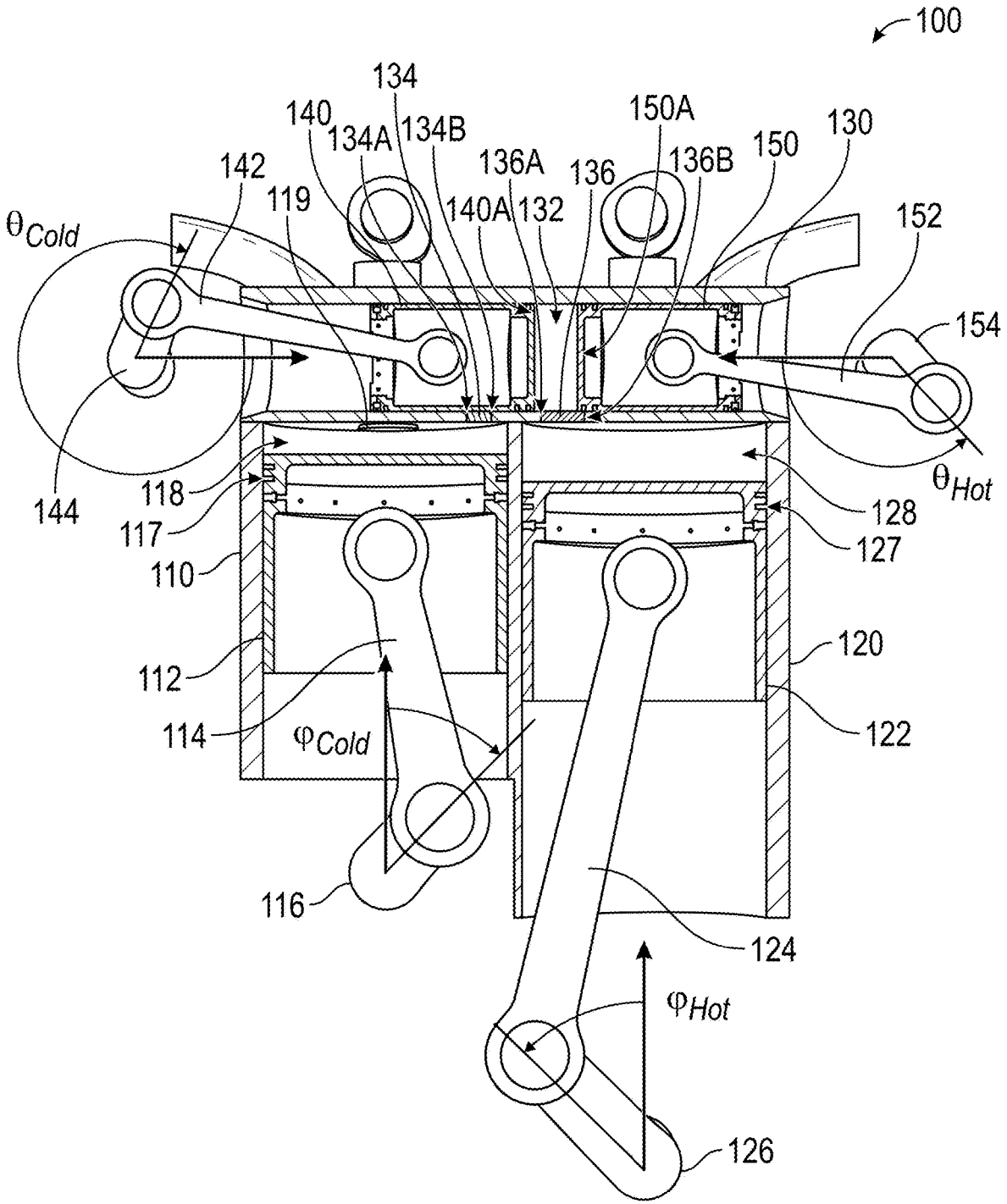
FIG. 1 illustrates a cross-sectional illustration of a split-cycle engine implementing an exemplary 2PTM at an expansion crankshaft angle of 45° in accordance with embodiments of the disclosure.

FIG. 1 illustrates a cross-sectional illustration of a split-cycle engine 100 implementing an exemplary 2PTM in accordance with embodiments of the disclosure. For ease of description and illustration. FIG. 1 illustrates split-cycle engine 100 at an angle of 45° (e.g., hot side/expansion crank angle of 45°) to provide an overview of the structure of an exemplary split-cycle engine with 2PTM in accordance with embodiments of the disclosure. Further details with respect to particular angles of interest (e.g., corresponding to particular events during an engine cycle) are provided below with respect to FIGS. 2-13. Omission and/or simplification of description with respect to FIG. 1 is not to be interpreted as limiting the scope of the disclosure.

In some embodiments, split-cycle engine 100 includes compression cylinder 110, expansion cylinder 120, and transfer cylinder 130. In some embodiments, compression cylinder 110, expansion cylinder 120, and transfer cylinder 130 have different sizes (e.g., longer or shorter, wider or narrower, or otherwise have different volumes). In some embodiments, compression cylinder 110 performs the intake stroke and the compression stroke, but not the exhaust stroke. In some embodiments, expansion cylinder 120 performs the expansion and exhaustion stroke, but not the intake stroke. In some embodiments, compression cylinder 110 is referred to as a cold cylinder or cold-side cylinder and expansion cylinder 120 is referred to as a hot cylinder or hot-side cylinder. In some embodiments, compression cylinder 110 and expansion cylinder 120 is formed adjacent to each other in an inline formation. In some embodiments, compression cylinder 110 and expansion cylinder 120 is formed in parallel and the upper-boundary (e.g., head) of compression cylinder 110 and expansion cylinder 120 is aligned (e.g., such that compression piston 112 and expansion piston 122 moves in parallel and when compression piston 112 and expansion piston 122 are both at TDC, compression piston 112 and expansion piston 122 is adjacent). In some embodiments, transfer cylinder 130 is formed overhead to compression cylinder 110 and expansion cylinders 110. For example, transfer cylinder 130 is formed perpendicular to and on top of compression cylinder 110 and expansion cylinder 120 (e.g., such that two pistons in transfer cylinder 130 move perpendicularly to compression piston 112 and expansion piston 122). In some embodiments, transfer cylinder 130 is mechanically coupled to the upper-boundary (e.g., head) of compression cylinder 110 and expansion cylinder 120. In some embodiments, the side-wall of transfer cylinder 130 is the upper-boundary (e.g., head) of compression cylinder 110 and expansion cylinder 120. In some embodiments, the length of transfer cylinder 130 is the same or similar to the width of the compression cylinder 110 and expansion cylinder 120 (e.g., the diameter of compression cylinder 110 plus the diameter of expansion cylinder 120 is the same or similar to the length of transfer cylinder 130).

In some embodiments, compression cylinder 110 and expansion cylinder 120 has a configuration different from an inline configuration. For example, compression cylinder 110 and expansion cylinder 120 has an opposed configuration (e.g., compression piston 112 and expansion piston 122 move in opposing directions) and transfer cylinder 130 is formed between compression cylinder 110 and expansion cylinder 120. In another exemplary embodiment, compression cylinder 110 and expansion cylinder 120 has an upside-down V-shaped configuration (e.g., compression cylinder 110 and expansion cylinder 120 are disposed diagonally such that the upper-boundary of compression cylinder 110 and expansion cylinder 120 are coupled and the lower-boundary of compression cylinder 110 and expansion cylinder 120 are separated by a distance) and transfer cylinder 130 is formed in the area between the head of compression cylinder 110 and expansion cylinder 120.

In some embodiments, compression cylinder 110 includes (e.g., houses) compression piston 112. In some embodiments, compression piston 112 moves reciprocally within the compression cylinder 110 to compress and transfer working fluid. In some embodiments, compression piston 112 defines the compression chamber 118 within compression cylinder 110 (e.g., the volume within compression cylinder 110 configured to house working fluid). In some embodiments, piston 112 has one or more rings 117 configured to seal compression chamber 118. In some embodiments, the one or more rings 117 can comprise a compression ring, an o-ring or any other suitable oil control ring. In some embodiments, piston 112 is coupled to the compression connecting rod 114. In some embodiments, connecting rod 114 is coupled to the compression crankshaft 116. In some embodiments, crankshaft 116 controls the reciprocating motion of piston 112. In some embodiments, crankshaft 116 converts rotational motion into reciprocating motion. It is understood that crankshaft 116 illustrated is a portion of a larger crankshaft mechanism (e.g., including gearwheels).

It will be appreciated by those skilled in the art that interconnected crankshafts are an exemplary mechanism for coordinating movement between the pistons of the engines herein. In other embodiments, different mechanisms are used for managing the position, speed, and timing of pistons.

In some embodiments, expansion cylinder 120 includes (e.g., houses) an expansion piston 122. In some embodiments, expansion piston 122 moves reciprocally within expansion cylinder 120 in response to the expansion of the working fluid (e.g., due to combustion and/or ignition) and to exhaust the burned working fluid. In some embodiments, expansion piston 122 defines the expansion chamber 128 within the expansion cylinder 120 (e.g., the volume within expansion cylinder 120 configured to house working fluid). In some embodiments, piston 122 has one or more rings 127 configured to seal expansion chamber 128. In some embodiments, the one or more rings 127 can comprise a compression ring, an o-ring or any other suitable oil control ring. In some embodiments, piston 122 is coupled to expansion connecting rod 124. In some embodiments, connecting rod 124 is coupled to expansion crankshaft 126. In some embodiments, crankshaft 126 controls the reciprocating motion of piston 122. In some embodiments, crankshaft 126 converts rotational motion into reciprocating motion. It is understood that expansion crankshaft 126 illustrated is a portion of a larger crankshaft mechanism (e.g., including gearwheels).

In some embodiments, crankshafts 116 and 126 are coupled to the same crankshaft mechanism. In some embodiments, crankshafts 116 and 126 are driven by independent crankshaft mechanisms. In some embodiments, crankshafts 116 and 126 are controlled by an external mechanical and/or an electrical mechanism such that the rotational speed and phase relationships of the crankshafts are maintained (e.g., synchronized). As will be described in more detail below, in some embodiments, the movement of compression piston 112 and expansion piston 122 is synchronized. In some embodiments, the movement of compression piston 112 and expansion piston 122 are be in phase. For example, both pistons reach TDC at the same time and/or both pistons reach BDC at the same time. In some embodiments, the movement of the compression piston and the expansion are out of phase (e.g., include phase lag). For example, one piston regularly reaches TDC when the other piston is slightly behind TDC.

As used herein and shown in FIG. 1, the angle of rotation of crankshaft 116 in a clockwise direction is referred to as $\phi_{COLD}$ and the angle of rotation of crankshaft 126 in a counter-clockwise direction is referred to as $\phi_{HOT}$. For simplicity and as used herein, the position of split-cycle engine 100 during an engine cycle is referred to by the angle of rotation of crankshaft 126, $\phi_{HOT}$. In some embodiments, a full cycle of split-cycle engine 100 has 360° (e.g., corresponding to a full rotation of crankshaft 126). As used herein, an angle of rotation of 0° refers to when the crankshaft is rotated in parallel with the respective piston and the respective piston is at TDC. As illustrated in FIG. 1, split-cycle engine 100 is referred to as being at a 45° position because the angle of rotation of crankshaft 126 is at a 45° counter-clockwise position.

In such embodiments, piston 112 and piston 122 moves in parallel to each other. In some embodiments, intake valve 119 is formed in compression cylinder 110 to control the induction of working fluid into compression chamber 118. In some embodiments, port 134 is formed on the interface between compression cylinder 110 and transfer cylinder 130 (e.g., on the head of compression cylinder 110 and/or on the wall of transfer cylinder 130). In some embodiments, port 134 is formed near the upper-right edge of compression cylinder 110 (e.g., close to expansion cylinder 120). In some embodiments, port 134 is fluidly couple transfer chamber 132 (e.g., the volume within the transfer cylinder 130, as will be described in further detail below) with the compression chamber 118. In some embodiments, when compression cylinder 110 is performing compression (e.g., during the compression stroke), working fluid is transferred into transfer chamber 132 through port 134. In some embodiments, port 136 is formed on the interface between expansion cylinder 120 and transfer cylinder 130 (e.g., on the head of expansion cylinder 120 and/or on the wall of transfer cylinder 130). In some embodiments, port 136 is formed near the upper-left edge of the compression cylinder (e.g., close to the compression cylinder). In some embodiments, port 136 has a different width than port 134. In some embodiments, port 136 is wider than port 134 (or vice versa). In some embodiments, port 136 fluidly couples transfer chamber 132 with the expansion chamber 128. In some embodiments, when transfer chamber 132 is coupled to the expansion chamber 128, compressed working fluid in transfer chamber 132 is transferred to expansion chamber 128 through the port 136. In some embodiments, combustion occurs when transfer chamber 132 couples to the expansion chamber 128. In some embodiments, combustion occurs at any time before or after transfer chamber 132 fluidly couples with expansion chamber 128 (e.g., at an expansion crankshaft angle of −10°, −5°, 0°, 5°, or 10°). In some embodiments, an exhaust valve (not shown) is formed in expansion cylinder 120 to control the exhaustion of working fluid out of expansion chamber 128.

As used herein, the orientation "right" is understood to be in the direction of the expansion cylinder and "left" to mean in the direction of the compression cylinder. For example, a transfer piston moving from left to right moves in a direction from the compression cylinder to the expansion cylinder. In another example, a "right edge" of a transfer cylinder means the furthest point on the expansion cylinder side of the transfer cylinder. The specific position depends on the context—a right edge of the cylinder may mean the furthest point in the transfer cylinder on the expansion cylinder side; a right edge of the piston movement may mean the further position the piston reaches when travelling in the direction of the expansion cylinder; a right edge of a port may mean the edge of the port closest to the center of the expansion cylinder.

In some embodiments, the 2PTM is implemented by transfer cylinder 130. In some embodiments, transfer cylinder 130 includes piston 140 and piston 150 (e.g., a 2PTM). In some embodiments, piston 140 is coupled to connecting rod 142. In some embodiments, connecting rod 142 is coupled to crankshaft 144. In some embodiments, crankshaft 144 controls the reciprocating motion of piston 140. In some embodiments, crankshaft 144 converts rotational motion into reciprocating motion. It is understood that crankshaft 144 illustrated is a portion of a large crankshaft mechanism (e.g., including gearwheels). In some embodiments, piston 150 is coupled to connecting rod 152. In some embodiments, connecting rod 152 is coupled to crankshaft 154. In some embodiments, crankshaft 154 controls the reciprocating motion of piston 150. In some embodiments, crankshaft 154 converts rotational motion into reciprocating motion. It is understood that crankshaft 154 illustrated is a portion of a large crankshaft mechanism (e.g., including gearwheels). In some embodiments, crankshafts 144 and 154 are coupled to the same crankshaft mechanism. In some embodiments, crankshafts 144 and 154 are driven by independent crankshaft mechanisms. As used herein and shown in FIG. 1, the angle of rotation of crankshaft 144 in a clockwise direction is referred to as $\theta_{COLD}$ and the angle of rotation of crankshaft 154 in a counter-clockwise direction is referred to as $\theta_{HOT}$.

In some embodiments, piston 140 and piston 150 oppose each other (e.g., move in opposing directions). For example, piston 140 and connecting rod 142 are disposed on the left side of transfer chamber 130 (e.g., above the compression chamber) and piston 150 and connecting rod 152 are disposed on the right side of the transfer chamber (e.g., above the expansion chamber). As used herein and for ease of description, the left side of transfer chamber 130 refers to the portion of the transfer chamber above the compression chamber (e.g., the portion with port 134) and the right side of transfer chamber 130 refers to the portion of transfer chamber above the expansion chamber (e.g., the portion with port 136). In some examples, piston 140 travels from left to right during its motion from bottom dead center (BDC) to top dead center (TDC). In some examples, piston 150 travels from right to left during its motion from bottom dead center (BDC) to top dead center (TDC). In some embodiments, piston 140 and piston 150 define a transfer chamber (e.g., the volume in the transfer cylinder between piston 140 and piston 150 that is configured to house working fluid and moves between the compression cylinder 110 and combustion cylinder 120). In some embodiments, piston 140 is referred to as the cold transfer piston and piston 150 is referred to as the hot transfer piston.

In some embodiments, piston 140 and piston 150 move perpendicularly to piston 112 and piston 122. In some embodiments, the movement of the two pistons of the transfer cylinder 130 is synchronized and offset (e.g., have a phase lag as reflected in the differences in the angles of rotation of the respective crankshaft). In other words, the two pistons of the transfer chamber reach TDC or BDC at different times, but offset by the same amount (e.g., by the same amount of degrees of rotation) during each cycle. For example, piston 150 (e.g., the piston that lies overhead to the expansion chamber) reaches BDC before piston 140 (e.g., the piston that lies overhead to the compression chamber) reaches TDC. In some embodiments, piston 150 reaches TDC before piston 140 reaches BDC.

In some embodiments, the offset (e.g., phase lag) between the two pistons changes (e.g., the rotational velocities of the respective crankshafts can change during a cycle). In some embodiments, dynamically changing the offset (e.g., phase lag) can change the compression ratio of the engine. In some embodiments, the distance between the two pistons can be closer or farther apart. For example, during a first time period, the phase of piston 140 (e.g., crankshaft angle of piston 140) can be offset from the phase of piston 150 (e.g., crankshaft angle of piston 150) by a first offset amount and during a second time period (e.g., during the same engine cycle as the first time period and/or at a different engine cycle than the first time period), the phase of piston 140 can be offset from the crankshaft angle of piston 150 by a second, different, offset amount. In some embodiments, this distance can be pre-determined or can be dynamically adjusted. In some embodiments, adjusting the distance between the two pistons results in a change in the compression ratio of the engine (e.g., a smaller distance means a higher compression ratio and a larger distance means a lower compression ratio).

In some embodiments, pistons 140 and 150 selectively covers (e.g., seals) or uncover (e.g., exposes) port 134 and/or port 136. Thus, the movement of the pistons selectively fluidly couples (or decouples) transfer chamber 132 to compression chamber 118 and/or expansion chamber 128. In some embodiments, transfer chamber 132 concurrently couples to both compression chamber 118 and expansion chamber 128 (e.g., the pistons are not covering either port 134 or port 136).

Figure 2:
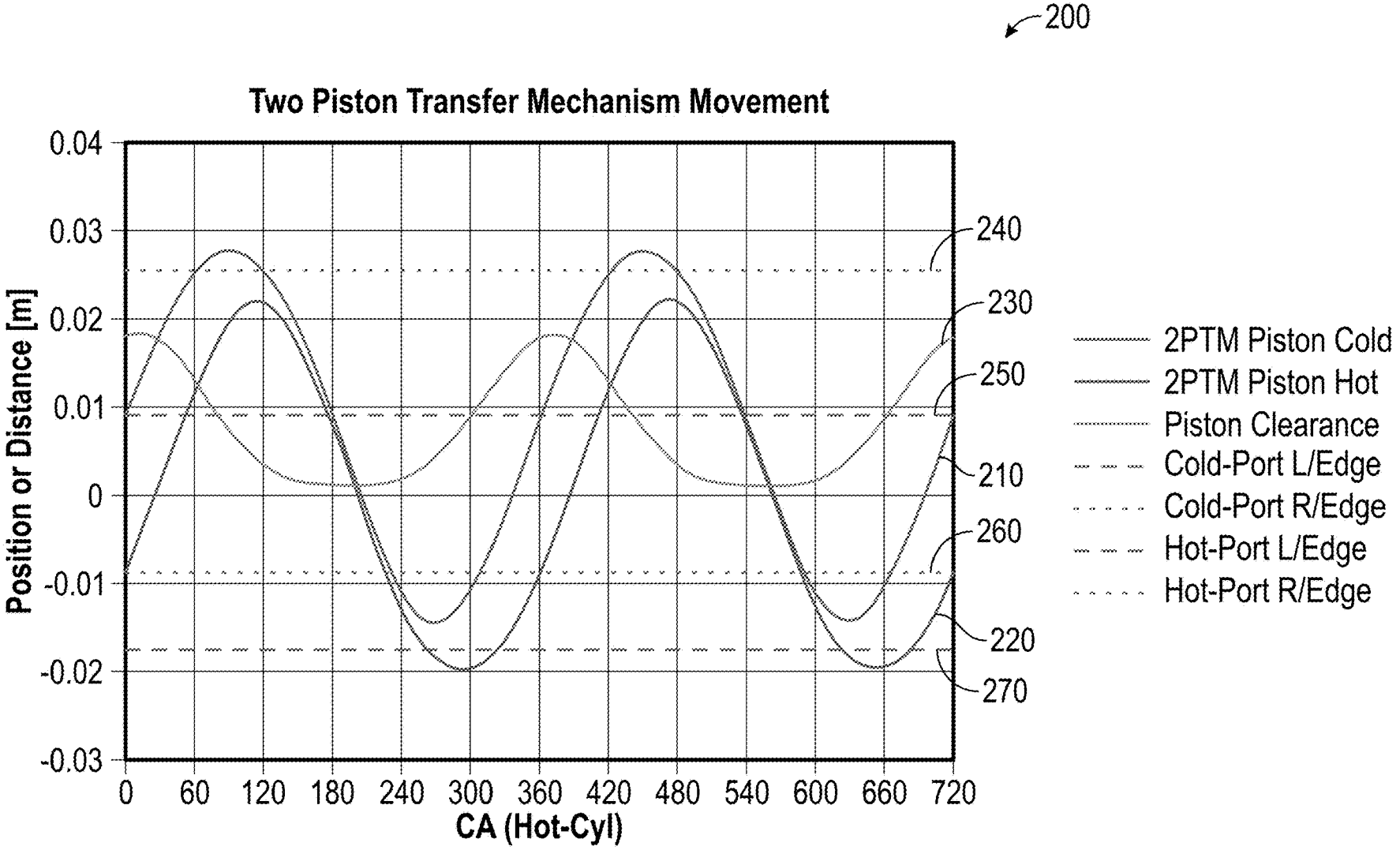
FIG. 2 illustrates a chart of an exemplary cycle of a split-cycle engine according to embodiments of the disclosure.

An exemplary method of operating a 2PTM of an exemplary split-cycle engine to transfer working fluid from a compression chamber to an expansion chamber will now be described. FIG. 2 illustrates a chart 200 of an exemplary cycle of a split-cycle engine according to embodiments of the disclosure. The x-axis of chart 200 represents the phase (e.g., angle) of crankshaft 126. The y-axis of chart 200 represents the horizontal position along transfer cylinder 130. For example, the 0 position on the y-axis represents the center position of transfer cylinder 130, positive y-values represent the right side of transfer cylinder 130 (e.g., overhead to expansion cylinder 120), and negative y-values represents the right edge of transfer cylinder 130 (e.g., overheard to compression cylinder 110). Although the y-axis of chart 200 describes particular distances and scales, this is meant only to be representative. It is understood that other distances can be used without departing from the scope of the invention. As shown, chart 200 includes graph 210, 220, and 230, and boundary 240, 250, 260, and 270. Graph 210 represents an exemplary motion of the leading edge of piston 150 (e.g., edge 150A) in accordance with embodiments of this disclosure. Graph 220 represents an exemplary motion of the leading edge of piston 140 (e.g., edge 140A) in accordance with embodiments of this disclosure. Graph 230 represents the distance between the leading edge of piston 150 (e.g., edge 150A) and the leading edge of piston 140 (e.g., edge 140A), also referred to as piston clearance, in accordance with embodiments of this disclosure. In some embodiments, the distance between the leading edge of piston 150 and the leading edge of piston 140 can dictate the volume of transfer chamber 132 (e.g., based on the radius of transfer cylinder 130). Boundary 240 represents the right edge of port 136 (e.g., edge 136B). Boundary 250 represents the left edge of port 136 (e.g., edge 136A). Boundary 260 represents the right edge of port 134 (e.g., edge 134B). Boundary 270 represents the left edge of port 134 (e.g., edge 134A).

As described above, piston 140 and piston 150 move reciprocally within transfer cylinder 130 and selectively fluidly couple transfer chamber 132 to compression chamber 118 and expansion chamber 128. For ease of description, description of a cycle of split-cycle engine 100 will begin at 0° (e.g., the angle of rotation of crankshaft 126 is at 0°). As shown in FIG. 2, in some embodiments, when split-cycle engine 100 is at 0°, the leading edge of piston 140 (e.g., edge 140A) is at boundary 260 (e.g., the right edge of port 134: edge 134B). Thus, piston 140 is covering port 134 and thus fluidly decoupling transfer chamber 132 from compression chamber 118. In some embodiments, when split-cycle engine 100 is at 0°, graph 210 is at boundary 250 (e.g., the leading edge of piston 150 (e.g., edge 150A) is at the left edge of port 136: edge 136A). Thus, piston 150 is fully covering port 136 and thus fluidly decoupling transfer chamber 132 from expansion chamber 118. As shown, in some embodiments, the volume of transfer chamber 132 is the volume between piston 140 and 150.

The movement of pistons 112, 122, 140, and 150 in accordance with chart 200 will now be described. As shown in FIG. 2, as split-cycle engine 100 transitions through the engine cycles, graph 210 and 220 are quasi-sinusoidal graphs that are offset both in the x-axis (e.g., phase of the piston) and y-axis (e.g., position within transfer cylinder 130).

In some embodiments, starting at 0°, graph 210 increases at a particular slope (e.g., piston 150 moves rightward in transfer cylinder 130 at a particular speed), and graph 220 increases at a particular slope (e.g., piston 140 moves rightward in transfer cylinder 130 at a particular speed). In some embodiments, during a portion of the cycle (e.g., at or around 0° to 60°), the slope (e.g., speed) of graph 210 and graph 220 is the same or substantially the same (e.g., within 80%, 90%, 95%, 99%). In some embodiments, the slope of graph 210 is larger than the slope of graph 220 until a particular inflection point and then the slope of graph 210 is smaller than the slope of graph 220. As reflected in graph 230, the piston clearance can increase for a portion of the engine cycle (e.g., at or around 0° when the slope of graph 210 is larger than the slope of graph 220) and decrease during a subsequent portion of the engine cycle (e.g., at or around 30°-180° when the slope of graph 210 is smaller than the slope of graph 220). For example, during the portion of the cycle when the slope of graph 210 is larger than the slope of graph 220 (e.g., the speed of piston 150 to the right is greater than the speed of piston 140 to the right), the distance between edge 140A and edge 150A can increase, which in turn can increase the piston clearance. In some embodiments, graph 230 (e.g., the piston clearance) begins to decrease during the portion of the cycle when slope of graph 210 is less than the slope of graph 220 (e.g., the speed of piston 150 to the right is smaller than the speed of piston 140 to the right, causing a decrease in the volume of transfer chamber 132). In some embodiments, as piston 140 and piston 150 move to the right, port 136 is uncovered, causing transfer chamber 132 to become fluidly coupled to expansion chamber 128, as shown by graph 210 being at a y-position above boundary 250 (e.g., piston 150 is not fully covering port 136). In some embodiments, as shown, graph 220 can increase above boundary 250 (e.g., piston 140 begins to partially cover port 136). Thus, in some embodiments as shown, port 136 begins to become uncovered and reach a maximum uncovered width during one portion of the cycle and then begin to become covered and reach a fully-covered state during a second portion of the cycle. In some embodiments, port 136 can be partially covered by piston 140 without affecting the ability to transfer working fluid from transfer chamber 132 to expansion chamber 128 (e.g., because most of the working fluid has already transferred at the time when the port begins to become partially covered by piston 140). Thus, in some embodiments, as the volume of transfer chamber 132 begins to decrease (e.g., as graph 230 decreases), working fluid begins transferring from transfer chamber 132 to expansion chamber 128. In some embodiments, the working fluid is ignited by an ignition source (e.g., a spark plug). In some embodiments, ignition can be achieved by compression of the working fluid (e.g., compression-ignition). In some embodiments, ignition can occur any time before or after transfer chamber 132 fluidly couples to expansion chamber 128 as was described in more detail above.

In some embodiments, graph 210 reaches a peak value (e.g., at or around 90°) and begins to decrease at a particular slope (e.g., piston 150 moves leftward in transfer cylinder 130 at a particular speed and reaches BDC and begins moving rightwards), and graph 220 continues increasing at a particular slope (e.g., piston 140 continues moving rightward in transfer cylinder 130 at a particular speed). In some embodiments, when graph 210 is at its peak, graph 210 is above boundary 250 (e.g., piston 150 is fully unblocking port 136). In some embodiments, when graph 210 is at its peak, graph 220 is above boundary 250 (e.g., piston 140 is partially blocking port 136). In some embodiments, graph 220 reaches a peak and begins to decrease at a particular slope (e.g., piston 140 moves leftward in transfer cylinder 130 at a particular speed). In some embodiments, the negative slope of graph 210 is greater than the negative slope of graph 220 during a first portion of the downward cycle, and the negative slope of graph 210 is less than the negative slope of graph 220 during a second portion of the downward cycle. Thus, in such embodiments, graph 230 (e.g., the volume of transfer chamber 132) reaches a minimum level and remains constant or substantially constant during a portion of the cycle (e.g., when the slope of graph 210 is equal to or substantially equal to the slope of graph 220). In some embodiments, graph 230 does not reach a 0 level (e.g., the volume of transfer chamber 132 does not become 0 because piston 140 and piston 150 do not touch). In some embodiments, piston 140 and piston 150 can touch and graph 230 can reach a 0 level. In some embodiments, all or substantially all of the working fluid is transferred from transfer chamber 132 to expansion chamber 128 (e.g., 80%, 90%, 95%, 99%). It is understood that some working fluid (burned or unburned) can remain in the transfer chamber (e.g., due to working fluid remaining in the transfer chamber, in the volume of port 136 and/or other crevices) without departing from the scope of this disclosure. In some embodiments, graph 210 and graph 220 decrease below boundary 250 (e.g., piston 140 moves leftwards and clears port 136 and piston 150 moves leftwards and fully covers port 136). Thus, in some embodiments, when port 136 is covered, transfer chamber 132 is fluidly decoupled from expansion chamber 128.

In some embodiments, graph 210 and graph 220 decrease below a y-axis 0 value (e.g., when the edge of the head of pistons 140A and 150A move beyond the center point of transfer cylinder 130 in a leftwards direction) (e.g., at or around 180-210°). In some embodiments, when graph 210 and graph 220 reaches an inflection point and the slope of the graph begins to increase. In some embodiments, because graph 210 and graph 220 are offset, the slope of graph 210 is greater than the slope of graph 220 during the trough of the quasi-sinusoidal waveform. In some embodiments, when the slope of graph 210 is greater than the slope of graph 220, graph 230 increases (e.g., piston 140 moves leftwards at a faster rate than piston 150 and the volume of transfer chamber 132 increases).

In some embodiments, graph 220 crosses below boundary 260 (e.g., piston 140 moves leftwards and begins to uncover port 134). In some embodiments, graph 210 crosses below boundary 260 after graph 220 crosses boundary 260 (e.g., piston 150 moves leftwards and begins to partially cover port 134). In some embodiments, port 134 can be partially covered by piston 150 without affecting the ability to transfer working fluid from compression chamber 118 to transfer chamber 132 (e.g., because most of the working fluid has already transferred at the time when the port begins to become partially covered by piston 150). In some embodiments, graph 210 reaches a minimum value before graph 220 (e.g., piston 150 moves leftwards and reaches TDC). In some embodiments, the offset between when graph 210 and graph 220 reach their respective minimum values is the same as the offset between when graph 210 and graph 220 reach their respective maximums (e.g., the offset is maintained throughout the cycle). In some embodiments, when graph 220 is at its minimum, graph 220 is below boundary 270 (e.g., piston 140 is fully unblocking port 134). In some embodiments, when graph 220 is at its minimum, graph 210 is below boundary 260 (e.g., piston 150 is partially blocking port 134). Thus, in some embodiments, the volume of transfer chamber 132 increases and working fluid begins transferring from compression chamber 118 to transfer chamber 132.

In some embodiments, after graph 210 and graph 220 reaches a minimum (e.g., around 270-300°), graph 210 and graph 220 begins increasing sinusoidally (e.g., a sinusoid-like shape). In some embodiments, graph 210 begins increasing before graph 220 reaches a minimum (e.g., piston 150 begins moving rightwards while piston 140 continues moving leftwards). In some embodiments, graph 210 increases above boundary 260 (e.g., piston 150 moves rightwards and clears port 134). In some embodiments, graph 220 increases above boundary 260 (e.g., piston 140 moves rightwards and fully covers port 134). Thus, in some embodiments as shown, port 134 begins to become uncovered and reaches a maximum uncovered width during one portion of the cycle and then begins to become covered and reach a fully-covered state during a second portion of the cycle. In some embodiments, all or substantially all of the working fluid is transferred from compression chamber 118 to transfer chamber 132 (e.g., 80%, 90%, 95%, 99%). It is understood that some working fluid can remain in compression chamber 118 (e.g., due to working fluid remaining in the compression chamber, in the volume of port 134 and/or other crevices) without departing from the scope of this disclosure. In some embodiments, graph 210 increases and reaches boundary 250 (e.g., the top edge of piston 150 (e.g., 150A) is at the left edge of port 136 (e.g., 136A)). Thus, one full cycle of split-cycle engine 100 is completed and the next cycle begins.

In some embodiments, during one exemplary cycle of split-cycle engine 100, angles $\phi_{HOT}$, $\phi_{COLD}$, $\theta_{HOT}$, and $\theta_{COLD}$ corresponding to crankshafts 126, 116, 154, and 144, respectively, follows the pattern shown below in Table 1.

TABLE 1

| $\phi_{HOT}$ | $\phi_{COLD}$ | $\theta_{HOT}$ | $\theta_{COLD}$ |
|---|---|---|---|
| 0 | 0 | 90 | 246 |
| 30 | 30 | 120 | 276 |
| 60 | 60 | 150 | 306 |
| 90 | 90 | 180 | 336 |
| 120 | 120 | 210 | 6 |
| 150 | 150 | 240 | 36 |
| 180 | 180 | 270 | 66 |
| 210 | 210 | 300 | 96 |
| 240 | 240 | 330 | 126 |
| 270 | 270 | 360 | 156 |
| 300 | 300 | 30 | 186 |
| 330 | 330 | 60 | 216 |

As will be appreciated by those skilled in the art, the angles given in Table 1 are exemplary. Other embodiments include cycles with different relative crankshaft angles. Further, the crankshaft angles in Table 1 are approximate. As will be appreciated by those skilled in the art, all angles given in this disclosure are exemplary and are approximate, unless the context calls for a specific angle.

As discussed above, graph 230's minimum ends when graphs 210 and 220 are between the cold-port left edge 270 and cold-port right edge 260 (in the illustrative example of FIG. 2, from approximately 220 degrees to 260 degrees hot cylinder crankshaft angle). It will be appreciated by those skilled in the art that a changing volume reaches a minimum level (or, equivalently, "is at a minimum") when the second time derivative of the volume is zero. In some embodiments, the volume is at a minimum level when the volume reaches zero. In other embodiments, the volume is at a minimum when the volume is non-zero. For example, two metal pistons may require a non-zero clearance (e.g., 1 mm) as a safety tolerance. In some embodiments, the minimum is a global minimum (i.e., the volume is at its lowest for a full cycle). In other embodiments, the minimum is a local minimum (i.e., the volume is at its lowest for a portion of the cycle). As illustrated in FIG. 1, the volume of the transfer chamber can, in some embodiments, be described by the movement of two walls of the transfer chamber (e.g., the volume can be equivalently described by the distance between two boundaries of the transfer chamber multiplied by the surface area of the boundaries).

This arrangement advantageously provides for a minimum volume of the transfer chamber 132 when the compression piston 122 is first transferring working fluid to the transfer chamber 132. In this way, the volume of the transfer chamber 132 can increase from its minimum (zero volume, or a practical approximation of zero volume) and allow the compression piston 122 to transfer working fluid to the transfer chamber 132 without any, or with minimal, work loss. In other words, the energy expended when the engine compressed working fluid in the compression chamber 118 is not lost (or is minimized) when the compressed working fluid is transferred to the transfer chamber 132.

In some embodiments, as the transfer chamber volume increases, the volume in the compression chamber 118 decreases faster. This advantageously allows the shared volume (of the transfer and compression chambers) to never increase (which would waste energy by lowering the pressure of already-compressed working fluid). In some embodiments, the volume of the transfer chamber 132 increases for a portion or all of the time that the transfer chamber 132 and compression chamber 118 are coupled. In some embodiments, the transfer chamber 132's volume decreases after the transfer chamber 132 is decoupled from the compression chamber 118. In some embodiments, the volume of the transfer chamber 132 decreases before the transfer chamber 132 couples to the expansion chamber 128.

In some embodiments, transfer chamber 132 and expansion chamber 128 fluidly couple when transfer pistons 140 and 150 are at their maximum speed. In this way, the transfer chamber 132 can quickly and fully couple to expansion chamber 128, thereby allowing the compressed working fluid to transfer to the expansion chamber 128 quickly. By reducing or minimizing the flow restriction (e.g., the time between transfer chamber decoupling from the compression chamber and coupling to the expansion chamber), embodiments herein may advantageously reduce power loss and thereby increase engine efficiency.

As discussed above, graph 230's minimum is when graphs 210 and 220 are between the hot-port left edge 250 and cold-port right edge 260 (in the illustrative example of FIG. 2, from approximately 480 degrees to 540 degrees hot cylinder crankshaft angle). This arrangement advantageously provides for a full (as practically defined by the minimum volume of the transfer chamber 132) transfer of working fluid from the transfer chamber 132 to the expansion chamber 128 and minimizing EGR in the transfer chamber 132. The volume remains at a minimum until after the transfer chamber has fully decoupled from the hot port (after 540 degrees hot cylinder crankshaft angle). In this way, when the transfer chamber 132 first couples to the compression chamber 118, minimal EGR is present.

In some embodiments, an engine described herein is designed for a specific peak compression pressure according to its mode of operation (spark-ignited vs. compression-ignited) to ensure stable combustion because each type of air/fuel mixture has a pressure limit for which auto-ignition occurs. In some embodiments, the peak compression pressure is a function of manifold pressure and compression ratio and can is designed for a large range of peak compression pressures to accommodate both gaseous fuels (e.g., natural gas, Methane, Propane, etc.) and liquid fuels (e.g., gasoline, gasoline/ethanol blends, diesel, bio-diesel, etc.). In some embodiments, the liquid fuel is gasoline (e.g., a stoichiometric gasoline combustion engine) and the peak compression pressure lies between 14 and 30 bar (in some embodiments, between 16 and 28 bar) and the peak combustion pressure is less than 70 bar (in some embodiments, less than 40 bar). In some embodiments, the liquid fuel is diesel and the peak compression pressure lies between 29 and 60 bar (in some embodiments, between 35 and 50 bar) and the peak combustion pressure is less than 150 bar (in some embodiments, less than 100 bar). In some embodiments, the gaseous fuel is natural gas e.g., a stoichiometric natural gas combustion engine) and the peak compression pressure lies between 17 and 46 bar (in some embodiments, between 18 and 34 bar) and the peak combustion pressure is less than 80 bar (in some embodiments, less than 50 bar). In some embodiments, combustion rely on excess air (e.g. lean burn for natural gas, homogeneous charge compression ignition and related methods for gasoline, etc.) can allow for a further increase in compression ratio and/or boost pressure which in turn will increase both peak compression pressure and peak combustion pressures. When the fuel is gasoline or natural gas, for example, the peak compression pressure and peak combustion pressures might increase by an additional 10-25%.

Figure 3:
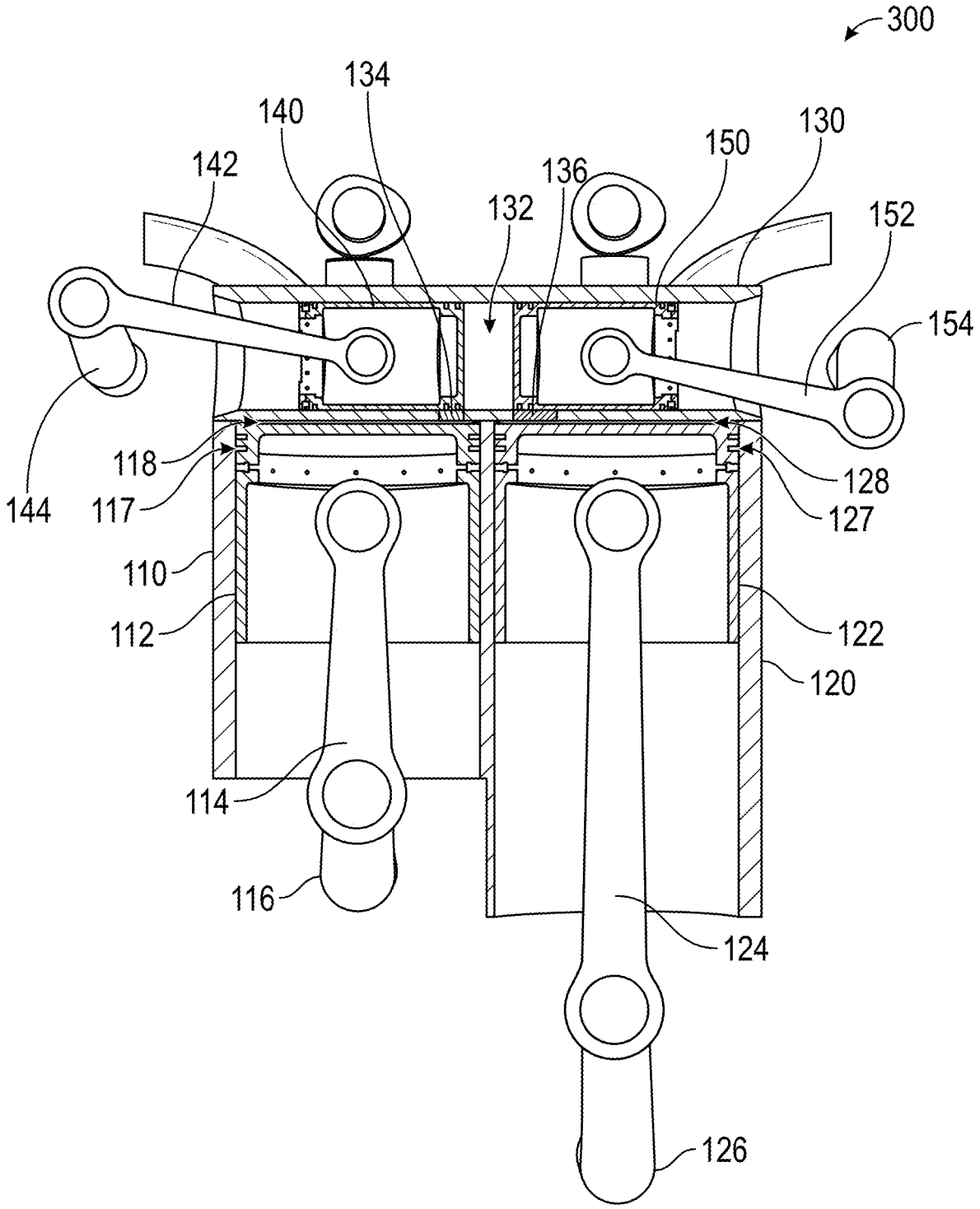
FIG. 3 illustrates a cross-sectional illustration of a split-cycle engine implementing an exemplary 2PTM at an expansion crankshaft angle of 0° in accordance with embodiments of the disclosure.

FIGS. 3-14 illustrate twelve snapshots of an exemplary cycle of a split-cycle engine corresponding to the twelve entries in Table 1 above according to embodiments of the disclosure. FIG. 3 illustrates a cross-sectional illustration of a split-cycle engine 300 implementing an exemplary 2PTM at an expansion crankshaft angle of 0° in accordance with embodiments of the disclosure. In some embodiments, when split-cycle engine 100 is at 0° (e.g., when the angle of rotation of crankshaft 126 is at 0°), piston 112 and piston 122 are both at TDC. In some embodiments, the intake and exhaust ports are both closed and piston 112 just completed its compression stroke and piston 122 just completed its exhaustion stroke. In some embodiments, when split-cycle engine 100 is at 0°, transfer chamber is decoupled from either compression cylinder 110 or expansion cylinder 120 (e.g., by pistons 140 and 150 covering ports 134 and 136, respectively). In some embodiments, when both piston 112 and piston 122 are at TDC and there is little or no fluid in either compression cylinder 110 or expansion cylinder 122, transfer chamber 132 (e.g., the volume between piston 140 and piston 150) houses all or substantially all of the working fluid in split-cycle engine 100. In some embodiments, some working fluid remains in the volume of port 134 or port 136 and not transferred to transfer chamber 132. In some embodiments, the working fluid in transfer chamber 132 is compressed working fluid at a particular pressure (e.g., compressed by piston 112 during a compression stroke). In some embodiments, volume 132 maintains the working fluid at the same, similar, or substantially similar (e.g., 80%, 90%, 95%, 99%) pressure as compressed by piston 112 in compression cylinder 110. In some embodiments, maintaining the same pressure in transfer chamber 132 as the pressure created by compression cylinder 110 during the compression stroke allows split-cycle engine 100 to maintain a desired compression ratio and reduce pumping losses, thus increasing efficiency. As described above, the reciprocating motion of piston 140 and piston 150 follows a pattern such that the volume of transfer chamber 132 remains constant or substantially constant (e.g., 90%, 95%, 98%, 99%) during the time after transfer chamber 132 decouples from compression chamber 118 and before transfer chamber 132 couples to expansion chamber 128 (e.g., during a transition period when transfer chamber 132 is coupled to neither compression or expansion chambers).

In some embodiments, when split-cycle engine 300 is at the 0° position, crankshaft 154 can be at an angle of 90°. In some embodiments, when crankshaft 154 is at an angle of 90° the linear velocity (e.g., the reciprocating motion) of piston 150 is at a maximum. In some embodiments, having the linear velocity of piston 150 at maximum speed at the moment when port 136 is uncovered allows port 136 to be uncovered quickly (e.g., more quickly than if crankshaft 154 is not at an angle of 90°) and causes working fluid in transfer chamber 132 to be transferred into expansion chamber 128 quickly (e.g., more quickly than if crankshaft 154 is not at an angle of 90°). It is understood that crankshaft 154 can be at an angle other than 90° at the moment when port 136 is uncovered by piston 150 without departing from the scope of the disclosure.

In some embodiments, when split-cycle engine 300 is at the 0° position, a spark ignition system (e.g., spark plug, not shown) can ignite the compressed working fluid. In some embodiments, ignition can occur before 0° or after 0° (e.g., −10°, −5°, 5°, 10°). In some embodiments, the ignition occurs at any time when transfer chamber 132 is fluidly coupled to expansion chamber 128, any time before transfer chamber 132 has transferred the working fluid into expansion chamber 128, or any time after transfer chamber 132 has transferred the working fluid into expansion chamber 128. In some embodiments, ignition occurs just before transfer chamber 132 is fluidly coupled to expansion chamber 128 to provide time for combustion development before fluidly coupling transfer chamber 132 to expansion chamber 128. In some embodiments, the resulting expansion of the ignited working fluid expands into expansion chamber 128. In some embodiments, the expansion of the working fluid causes piston 122 to travel from TDC to BDC and perform a power (expansion) stroke.

Although FIG. 3 illustrates port 136 and piston 150 as being positioned such that piston 150 is fully covering port 136 at 0° (e.g., such that port 136 will begin to become uncovered immediately after 0°), it is understood that port 136 is positioned anywhere along the interface between transfer cylinder 130 and expansion cylinder 120 to adjust and/or delay the time in which transfer chamber 132 is coupled to expansion chamber (e.g., to control, modify, or adjust the engine timing). In such embodiments, port 136 begins to become uncovered at any angle above or below 0° (e.g., −10°, −5°, 5° 10° etc.).

Figure 4:
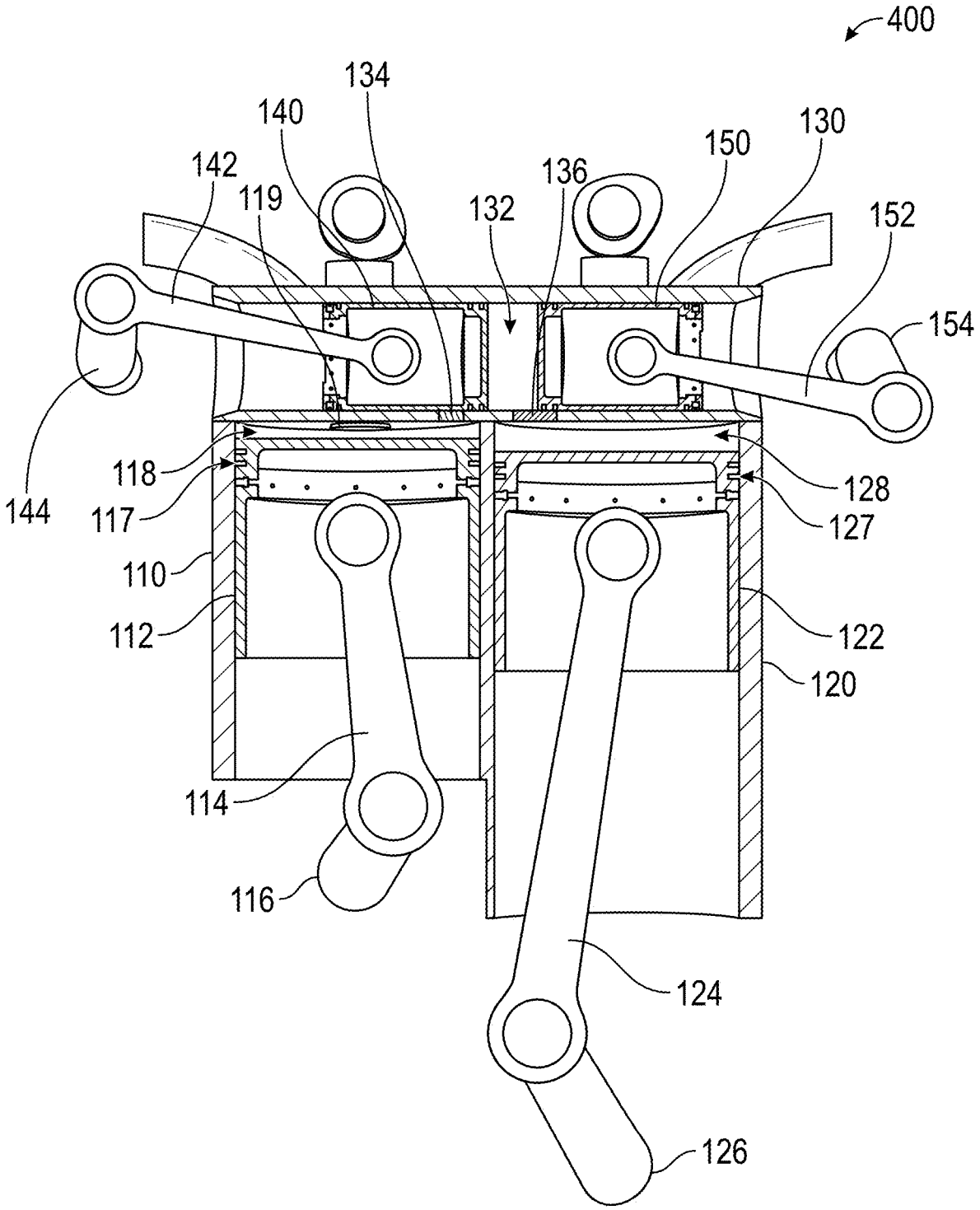
FIG. 4 illustrates a cross-sectional illustration of a split-cycle engine implementing an exemplary 2PTM at an expansion crankshaft angle of 30° in accordance with embodiments of the disclosure.

FIG. 4 illustrates a cross-sectional illustration of a split-cycle engine 400 implementing an exemplary 2PTM at an expansion crankshaft angle of 30° in accordance with embodiments of the disclosure. In some embodiments, when split-cycle engine 200 is at 30°, piston 140 and/or piston 150 travels rightwards and transfer chamber 132 can also be moving rightwards (e.g., causing working fluid to also be moving rightwards). As discussed above with respect to FIG. 2, piston 150 is moving at a different speed than piston 140. In some embodiments, the volume of transfer chamber 132 is reduced. In some embodiments, piston 150 partially unblocks port 136, thus fluidly coupling transfer chamber 132 to expansion chamber 128. In some embodiments, piston 150 partially blocks port 136. In some embodiments, piston 150 fully unblocks port 136. In some embodiments, piston 122 is no longer at TDC and travels downwards and back towards BDC. In some embodiments, the movement of piston 122 increases the volume of expansion chamber 128. In some embodiments, unblocking port 136 (partially or otherwise) causes transfer chamber 132 to fluidly couple to expansion chamber 128. In some embodiments, compressed working fluid from transfer chamber 132 can transfer to expansion chamber 128. In some embodiments, reducing the volume of transfer chamber 132 facilitates the transfer of working fluid from transfer chamber 132 to expansion chamber 128, and performing mechanical work on piston 122. Thus, the volume of transfer chamber 132 continues reducing as working fluid is transferred to expansion chamber 128 (e.g., working fluid is transferred and/or expanded into expansion chamber 128 due to ignition).

In some embodiments, when split-cycle engine 400 is at 30°, transfer chamber 132 remains decoupled from compression chamber 118 (e.g., piston 140 remains covering port 134). In some embodiments, piston 112 of expansion cylinder 110 begins traveling from TDC to BDC. In some examples, the motion of piston 112 increases the volume of expansion chamber 118. In some embodiments, expansion chamber 118 is empty. In some embodiments, fresh working fluid (e.g., air/fuel mixture) is induced (e.g., enter) into compression chamber 118 in preparation for the next compression stroke (e.g., via direct injection, vacuum injection, or otherwise). In some embodiments, intake valve 119 begins to be opened to facilitate the entry of working fluid into compression chamber 118. In other words, compression cylinder 110 begins performing the intake phase of the next engine cycle. In some embodiments, the intake phase occurs any time before or after 30° (e.g., as soon as piston 112 moves past TDC).

Figure 5:
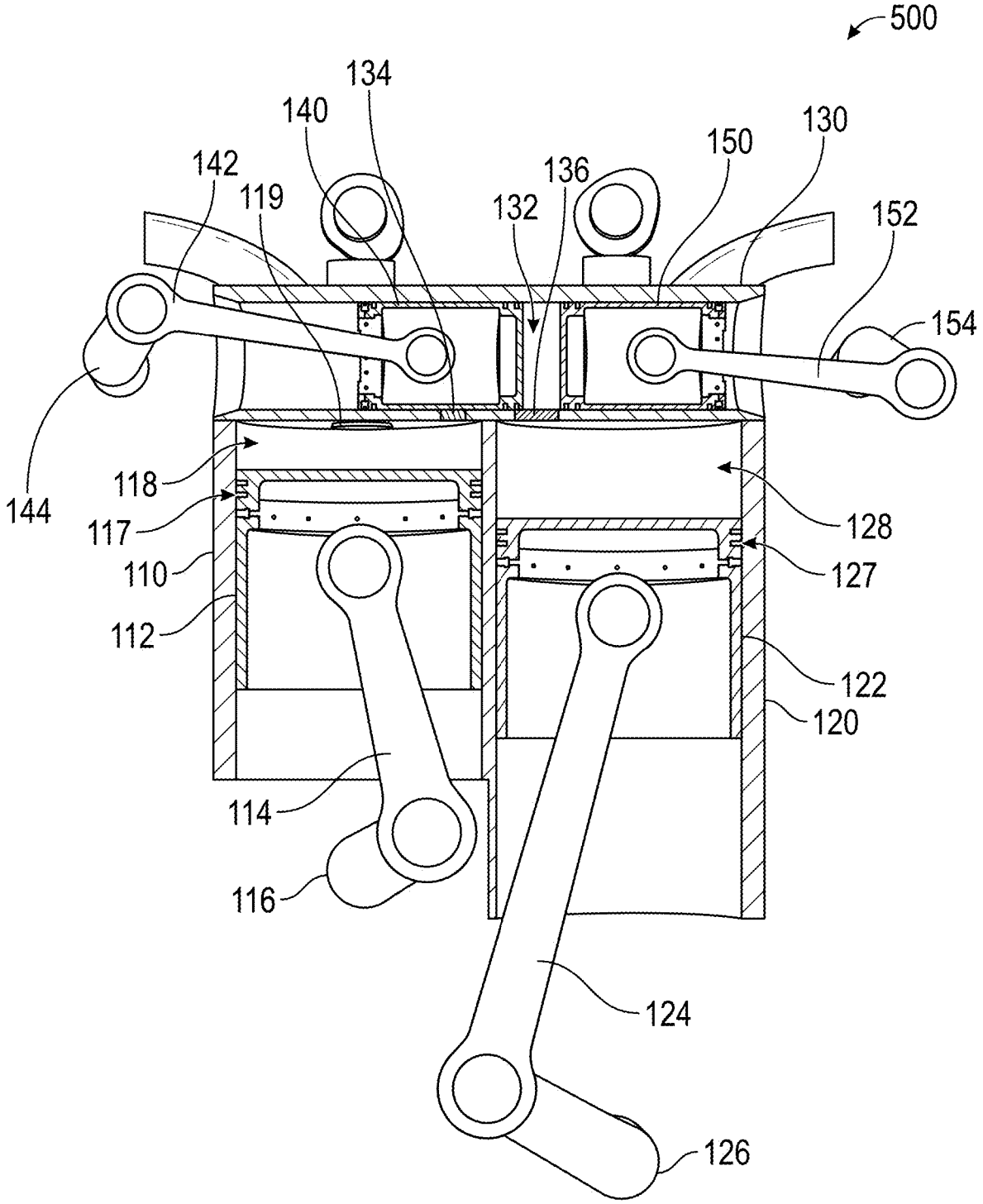
FIG. 5 illustrates a cross-sectional illustration of a split-cycle engine implementing an exemplary 2PTM at an expansion crankshaft angle of 60° in accordance with embodiments of the disclosure.

FIG. 5 illustrates a cross-sectional illustration of a split-cycle engine 500 implementing an exemplary 2PTM at an expansion crankshaft angle of 60° in accordance with embodiments of the disclosure. In some embodiments, when split-cycle engine 500 is at 60°, piston 140 and/or piston 150 can travel farther rightwards. As discussed above with respect to FIG. 2, piston 150 is moving at a different speed than piston 140. In some embodiments, piston 140 partially covers port 136. In some embodiments, piston 150 does not cover port 136. In some embodiments, port 136 is at least partially uncovered and transfer chamber 132 is fluidly coupled to expansion chamber 128. In some embodiments, the volume of transfer chamber 132 is reduced (e.g., due to piston 140 traveling at a speed faster than piston 150). In some embodiments, reducing the volume of transfer chamber 132 facilitates the transfer of working fluid from transfer chamber 132 to expansion chamber 128. Thus, the volume of transfer chamber 132 can continue reducing as working fluid is transferred to expansion chamber 128 (e.g., working fluid is transferred and/or expanded into expansion chamber 128 due to ignition). In some embodiments, piston 122 continues traveling towards BDC and expansion cylinder 120 continues the expansion stroke (e.g., power stroke). In some embodiments, compression cylinder 110 continues the intake stroke and compression chamber 118 increases and fresh working fluid continues to be induced into compression chamber 118. In some embodiments, intake valve 119 is opened (e.g., opened further) to induce working fluid into compression chamber 118.

Figure 6:
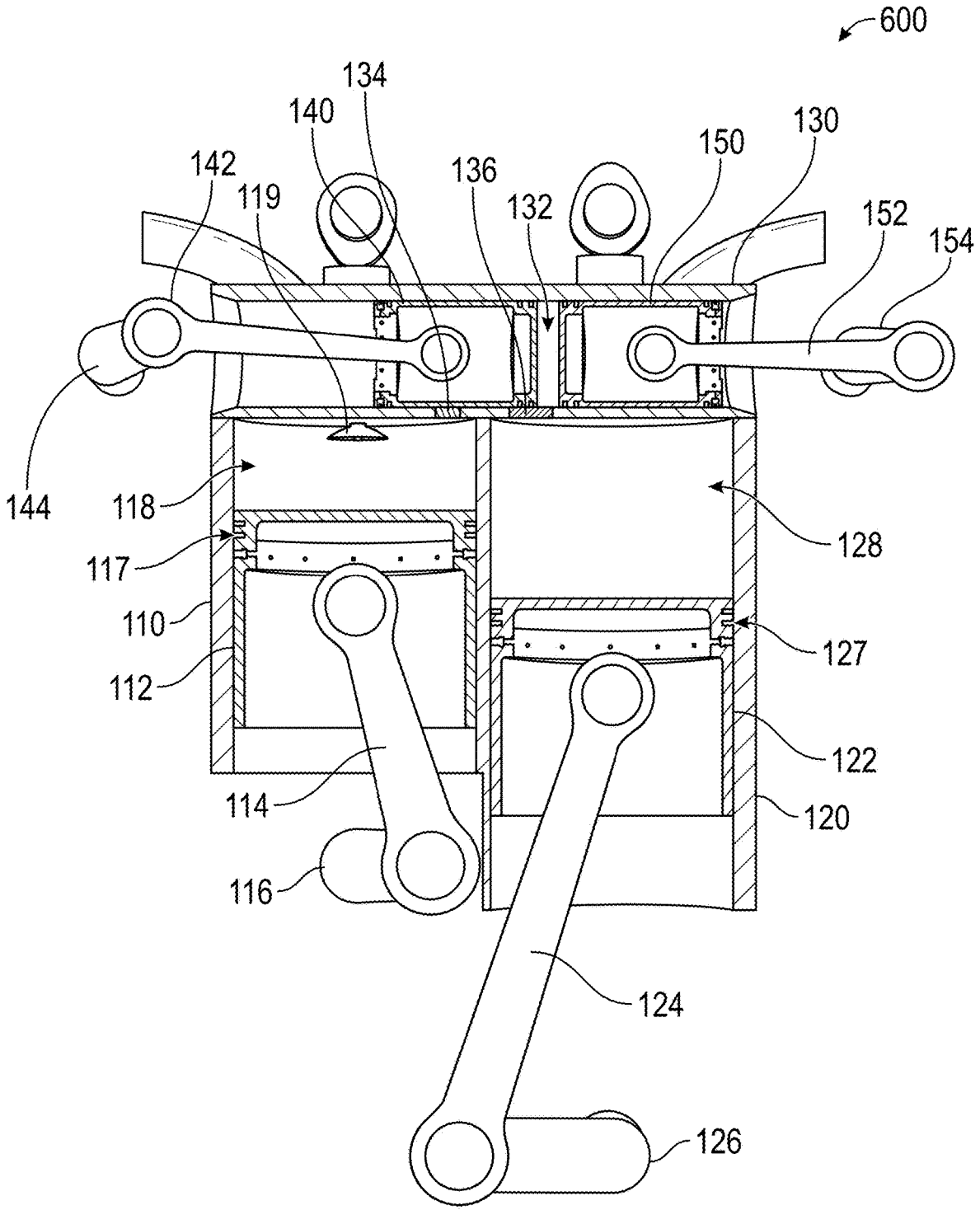
FIG. 6 illustrates a cross-sectional illustration of a split-cycle engine implementing an exemplary 2PTM at an expansion crankshaft angle of 90° in accordance with embodiments of the disclosure.

FIG. 6 illustrates a cross-sectional illustration of a split-cycle engine 600 implementing an exemplary 2PTM at an expansion crankshaft angle of 90° in accordance with embodiments of the disclosure. In some embodiments, when split-cycle engine 600 is at 90%, piston 140 and/or piston 150 travel farther rightwards. In some embodiments, piston 140 is partially covering port 136. In some embodiments, port 136 is halfway covered by piston 140. In some embodiments, piston 150 is not covering or obscuring port 136. In some embodiments, piston 150 is at or near BDC. In some embodiments, transfer chamber 132 continues to be fluidly coupled to expansion chamber 128. In some embodiments, the volume of transfer chamber 132 is further reduced. In some embodiments, reducing the volume of transfer chamber 132 facilitates the transfer of working fluid from transfer chamber 132 to expansion chamber 128. Thus, the volume of transfer chamber 132 can continue reducing as working fluid is transferred to expansion chamber 128 (e.g., working fluid is transferred and/or expanded into expansion chamber 128 due to ignition). In some embodiments, piston 122 continues traveling towards BDC and expansion cylinder 120 continues the expansion stroke (e.g., power stroke). In some embodiments, compression cylinder 110 continues the intake stroke and so compression chamber 118's volume is increasing and fresh working fluid enters into compression chamber 118 (e.g., by direct injection or otherwise). In some embodiments, intake valve 119 is opened (e.g., opened further) to induce working fluid into compression chamber 118.

Figure 7:
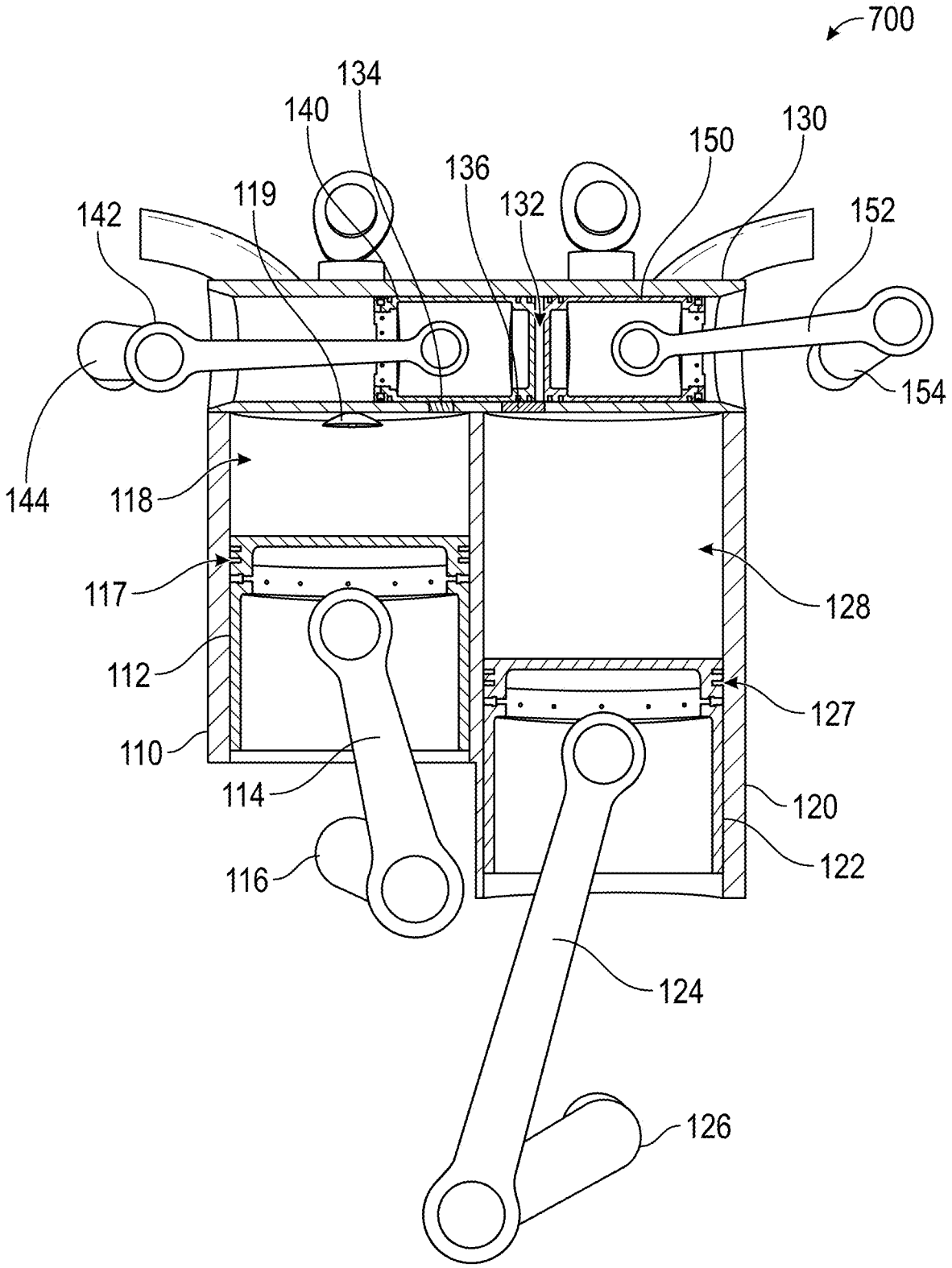
FIG. 7 illustrates a cross-sectional illustration of a split-cycle engine implementing an exemplary 2PTM at an expansion crankshaft angle of 120° in accordance with embodiments of the disclosure.

FIG. 7 illustrates a cross-sectional illustration of a split-cycle engine 700 implementing an exemplary 2PTM at an expansion crankshaft angle of 120° in accordance with embodiments of the disclosure. In some embodiments, when split-cycle engine 700 is at 120°, piston 140 is at or near TDC. In some embodiments, piston 140 partially covers port 136. In some embodiments, piston 150 is not covering or obscuring port 136. In some embodiments, piston 150 is past BDC and is traveling back towards TDC. In some embodiments, transfer chamber 132 continues to be fluidly coupled to expansion chamber 128. In some embodiments, the volume of transfer chamber 132 is further reduced (e.g., due to piston 140 traveling rightwards while piston 150 traveling leftwards). In some embodiments, reducing the volume of transfer chamber 132 facilitates the transfer of working fluid from transfer chamber 132 to expansion chamber 128. Thus, the volume of transfer chamber 132 can continue reducing as working fluid is transferred to expansion chamber 128 (e.g., working fluid is transferred and/or expanded into expansion chamber 128 due to ignition). In some embodiments, piston 122 continues traveling towards BDC and expansion cylinder 120 can continue the expansion stroke (e.g., power stroke). In some embodiments, compression cylinder 110 continues the intake stroke and compression chamber 118 is increasing and fresh working fluid continues to be induced into compression chamber 118. In some embodiments, intake valve 119 is opened (e.g., beginning to close but still opened) to induce working fluid into compression chamber 118.

Figure 8:
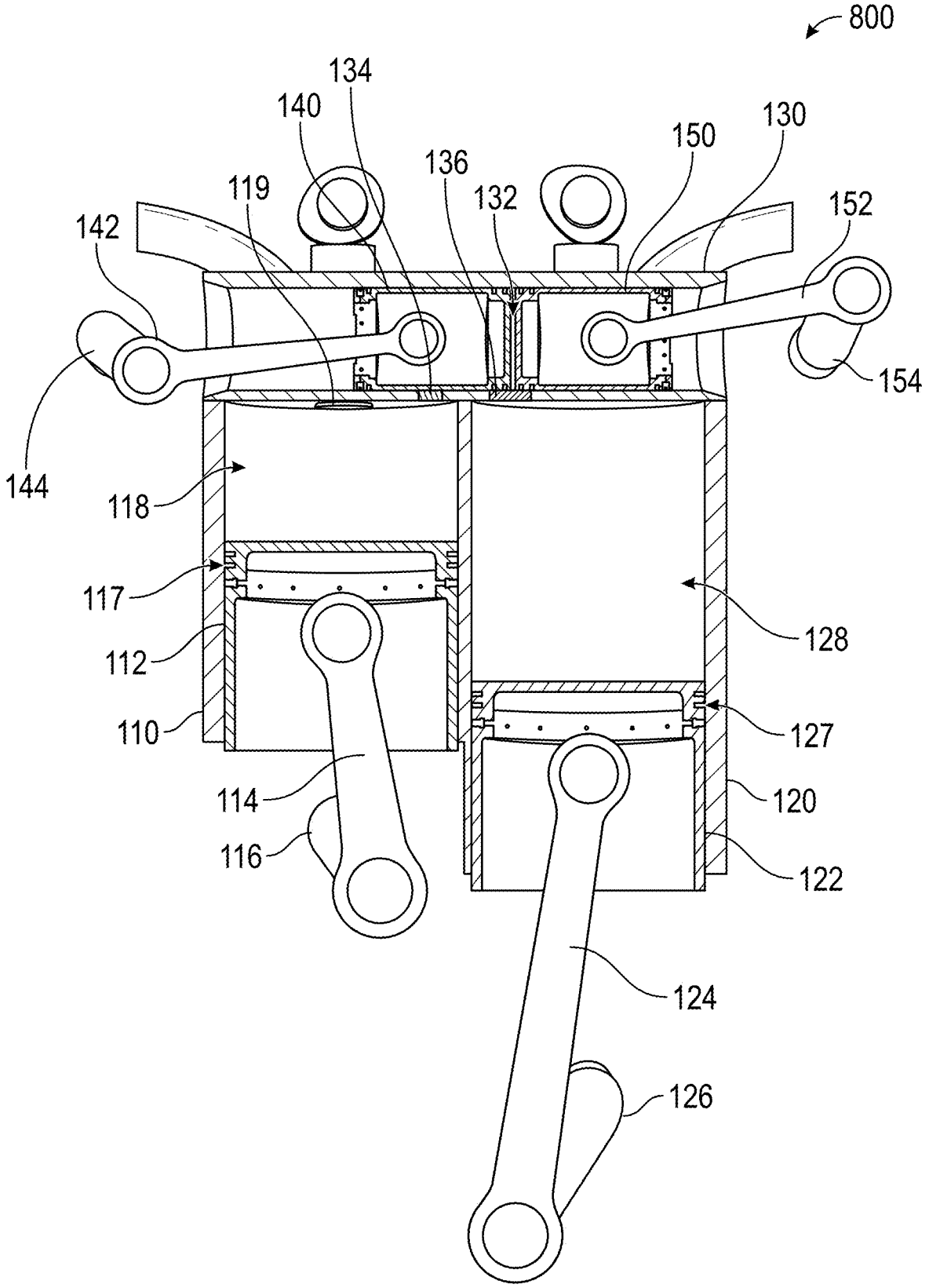
FIG. 8 illustrates a cross-sectional illustration of a split-cycle engine implementing an exemplary 2PTM at an expansion crankshaft angle of 150° in accordance with embodiments of the disclosure.

FIG. 8 illustrates a cross-sectional illustration of a split-cycle engine 800 implementing an exemplary 2PTM at an expansion crankshaft angle of 150° in accordance with embodiments of the disclosure. In some embodiments, when split-cycle engine 800 is at 150°, piston 140 is past TDC and traveling towards BDC. In some embodiments, piston 140 continues partially covering port 136. In some embodiments, piston 150 is traveling towards TDC and is partially covering or obscuring port 136. In some embodiments, port 136 is mostly covered by piston 140 and piston 150. In some embodiments, transfer chamber 132 continues to be fluidly coupled to expansion chamber 128. In some embodiments, the volume of transfer chamber 132 is further reduced (e.g., due to piston 140 traveling leftwards slower than piston 150's leftwards travel). In some embodiments, reducing the volume of transfer chamber 132 facilitates the transfer of working fluid from transfer chamber 132 to expansion chamber 128. Thus, the volume of transfer chamber 132 continues reducing as working fluid is transferred to expansion chamber 128 (e.g., working fluid is transferred and/or expanded into expansion chamber 128 due to ignition). In some embodiments, when split-cycle engine 800 is at 150°, the working fluid is fully combusted or substantially combusted (e.g., 90%, 95%, 98%, 99% of the air/fuel mixture has reacted). In some embodiments, the fluid in transfer chamber 132 and expansion chamber 128 is primarily combustion products. In some embodiments, because the volume of transfer chamber 132 has decreased to a relatively small volume, the amount of combustion product remaining in transfer chamber 132 is relatively small (e.g., most of the uncombusted, combusting, and combusted working fluid has been transferred to expansion chamber 128). In some embodiments, piston 122 can continue traveling towards BDC and expansion cylinder 120 can continue the expansion stroke (e.g., power stroke). In some embodiments, compression cylinder 110 continues the intake stroke and compression chamber 118 is increasing and fresh working fluid continues to be induced into compression chamber 118. In some embodiments, intake valve 119 is opened (e.g., closing but still opened) to induce working fluid into compression chamber 118.

Figure 9:
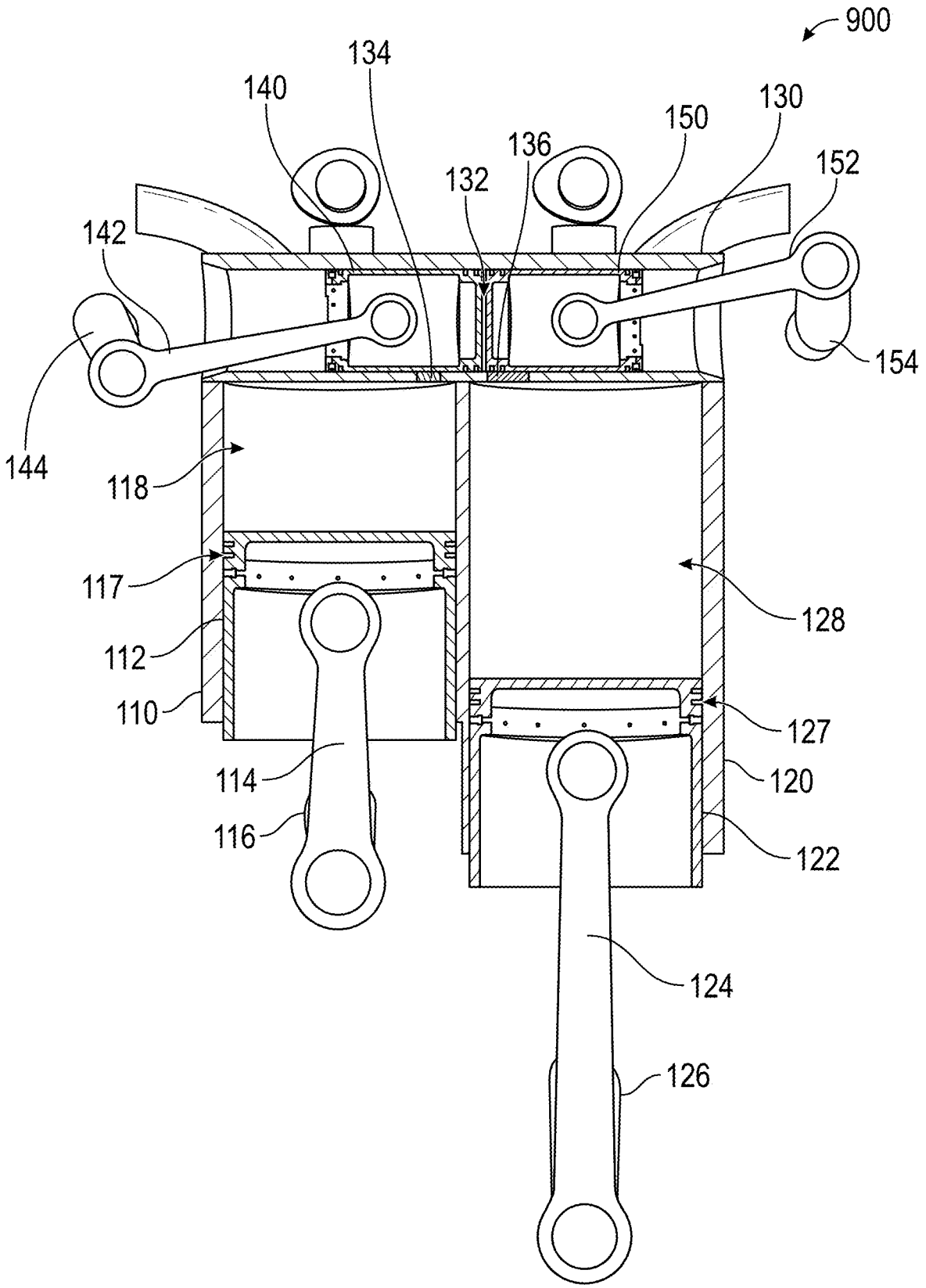
FIG. 9 illustrates a cross-sectional illustration of a split-cycle engine implementing an exemplary 2PTM at an expansion crankshaft angle of 180° in accordance with embodiments of the disclosure.

FIG. 9 illustrates a cross-sectional illustration of a split-cycle engine 900 implementing an exemplary 2PTM at an expansion crankshaft angle of 180° in accordance with embodiments of the disclosure. In some embodiments, when split-cycle engine 900 is at 180°, piston 112 and/or piston 122 are at or near BDC. In some embodiments, piston 140 and/or piston 150 is traveling leftwards. In some embodiments, piston 140 is no longer covering port 136. In some embodiments, piston 150 is fully covering or obscuring port 136. In other words, transfer chamber 132 is decoupled from expansion chamber 128. In some embodiments, at the time when transfer chamber 132 becomes decoupled from volume 128 (e.g., when piston 150 fully covers port 136), transfer chamber 132 is at a minimum volume. In some embodiments, when transfer chamber 132 is at a minimum volume, piston 140 and piston 150 is not touching (e.g., transfer chamber 132 can always have a certain amount of volume). In some embodiments, because transfer chamber 132 is at a minimum volume when transfer chamber 132 decouples from expansion chamber 128, all or substantially all of the working fluid is transferred to expansion chamber 128 from transfer chamber 132 (e.g., 80%, 90%, 95%, 99%). In some embodiments, some residual working fluid (e.g., combustion product in the form of EGR) remains in transfer chamber 132 (e.g., less than 20%, 10%, 5% or 1%). In some embodiments, when split-cycle engine 900 is at 180°, working fluid is fully combusted or substantially combusted (e.g., 90%, 95%, 98%, 99% of the air/fuel mixture has reacted). In some embodiments, the remaining fluid in transfer chamber 132 is hot EGR (e.g., residual combustion products). In some embodiments, because the volume of transfer chamber 132 has decreased to a relatively small volume, the amount of combustion product remaining in transfer chamber 132 and returning as EGR is relatively small (e.g., most of the uncombusted, combusting, and combusted working fluid has been transferred to expansion chamber 128). In some embodiments, the relatively small volume of transfer chamber 132 allows split-cycle engine 900 to reduce or minimize the amount of exhaust gas from returning to compression chamber 118. In some embodiments, reducing or minimizing EGR reduces or minimizes dilution of the fresh working fluid used in the next engine cycle by reducing or preventing the introduction of working fluid that has already been burned and/or any combustion products into the fresh working fluid. Reducing or preventing dilution of the fresh working fluid can improve the combustion quality of the engine. Thus, the volumetric efficiency of the split-cycle engine is improved, thus resulting in improved overall efficiency.

In some embodiments, piston 122 is at or near BDC and expansion cylinder 120 completed the expansion stroke (e.g., power stroke). In some embodiments, piston 112 is at or near BDC and compression cylinder 110 is at or near the end of its intake stroke. In some embodiments, the intake valve is closed to end the induction of working fluid (e.g., thus ending the intake stroke). In some embodiments, the intake valve is opened and can continue to induce working fluid into the compression cylinder 110 beyond piston 112's BDC (e.g., thus continuing the intake stroke beyond BDC).

Figure 10:
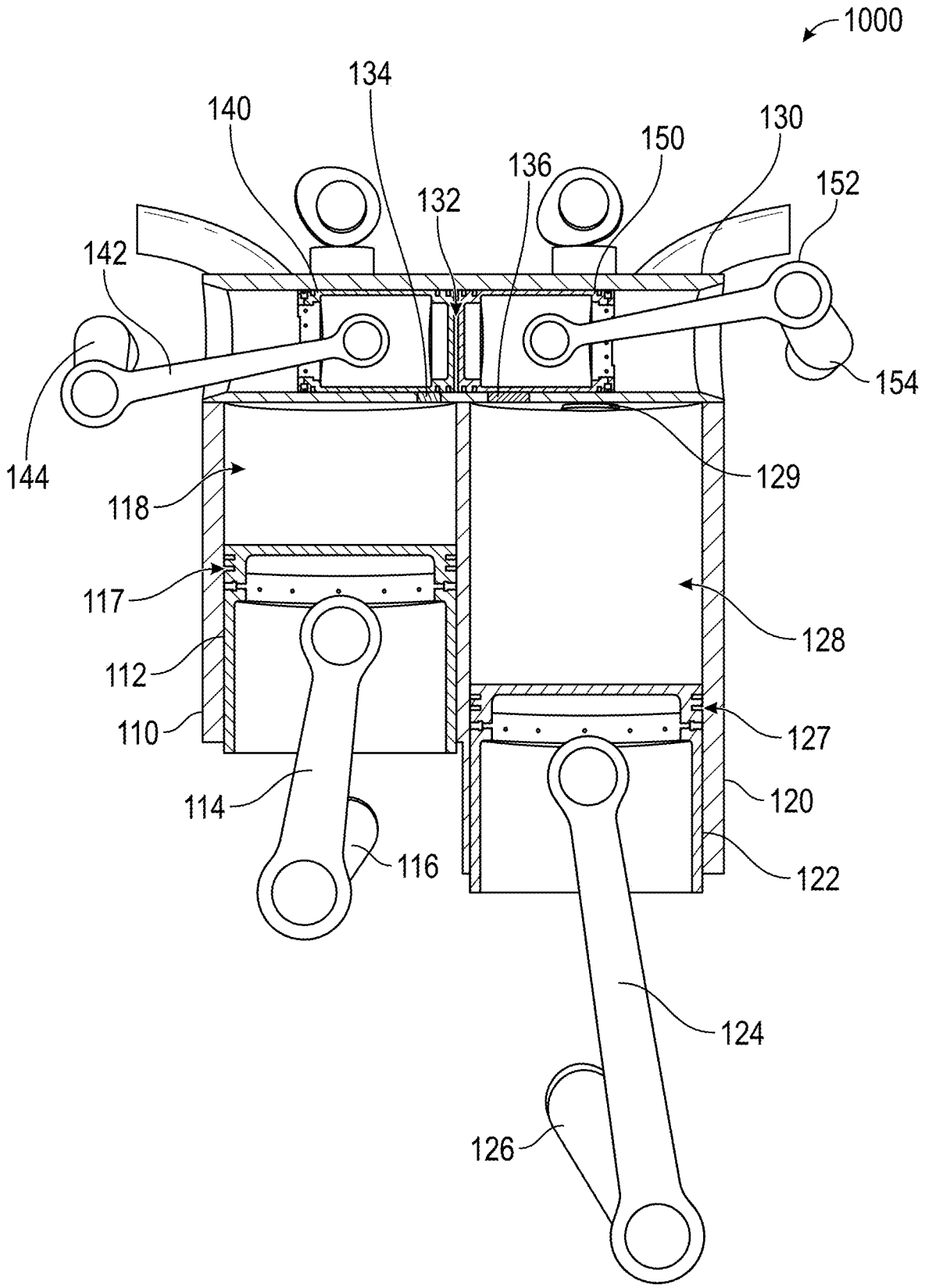
FIG. 10 illustrates a cross-sectional illustration of a split-cycle engine implementing an exemplary 2PTM at an expansion crankshaft angle of 210° in accordance with embodiments of the disclosure.

FIG. 10 illustrates a cross-sectional illustration of a split-cycle engine 1000 implementing an exemplary 2PTM at an expansion crankshaft angle of 210° in accordance with embodiments of the disclosure. In some embodiments, piston 112 is past BDC and compression cylinder 110 begins the compression stroke (e.g., begin compressing the working fluid in compression chamber 118). In some embodiments, piston 140 and/or piston 150 continues traveling leftwards. In some embodiments, piston 140 is no longer covering port 136. In some embodiments, piston 140 is in a position between port 136 and port 134 and fully covering or obscuring port 134. In some embodiments, piston 150 is traveling towards TDC and is fully obscuring port 136. In other words, transfer chamber 132 is decoupled from expansion chamber 128. In some embodiments, transfer chamber 132 is at or near a minimum volume and is the same or similar volume as when the split-cycle engine was at 180° (as described above with respect to FIG. 2). In some embodiments, piston 140 and piston 150 continue not touching. In some embodiments, transfer chamber 132 is at or near a minimum volume at or just before transfer chamber 132 fluidly couples with compression chamber 118 (and as shown in FIG. 2). In some embodiments, transfer chamber 132 having a minimum or near-minimum volume reduces or minimizes the amount of exhaust gas returning to compression chamber 118.

In some embodiments, piston 122 is past BDC and is in the exhaust stroke. In some embodiments, expansion cylinder 120 is opening exhaust port 129 to exhaust burned working fluid (e.g., combustion product) from split-cycle engine 800.

Figure 11:
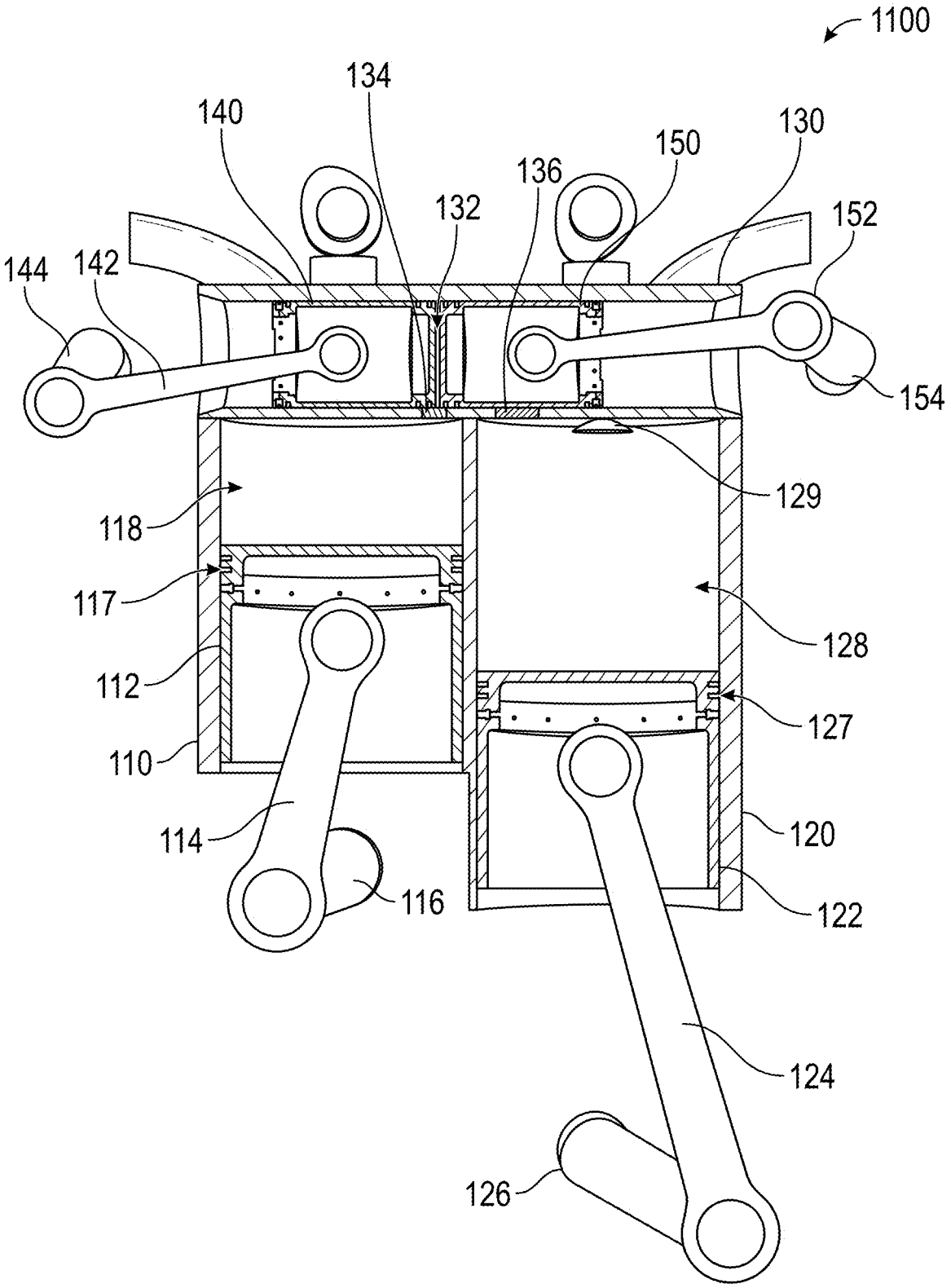
FIG. 11 illustrates a cross-sectional illustration of a split-cycle engine implementing an exemplary 2PTM at an expansion crankshaft angle of 240° in accordance with embodiments of the disclosure.

FIG. 11 illustrates a cross-sectional illustration of a split-cycle engine 1100 implementing an exemplary 2PTM at an expansion crankshaft angle of 240° in accordance with embodiments of the disclosure. In some embodiments, piston 112 is moving towards TDC during a compression stroke (e.g., compressing the working fluid in compression chamber 118). In some embodiments, piston 140 is moving leftwards (e.g., towards BDC) and is partially covering port 134. In some embodiments, piston 150 is moving leftwards (e.g., towards TDC) and is partially covering port 134. In some examples, port 134 is partially covered and partially uncovered and thus, transfer chamber 132 is fluidly coupled to compression chamber 118. Thus, in some embodiments, working fluid from compression chamber 118 is in transferring to transfer chamber 132. It is understood that when transfer chamber 132 is fluidly coupled with compression chamber 118, an amount of hot EGR is mixed with fresh working fluid from compression chamber 118 without departing from the scope of the disclosure. In some embodiments, transfer chamber 132 is expanding or otherwise larger than when split-cycle engine is at 210° (e.g., as in FIG. 10). In some embodiments, the volume of transfer chamber 132 remains the same such that the working fluid is further compressed while transferring from the compression chamber 118 to transfer chamber 132. In some embodiments, the volume of transfer chamber 132 is increasing during the transfer of working fluid from compression chamber 118 to transfer chamber 132. In some embodiments, the rate of increase of the volume of transfer chamber 132 is the same as the rate of decrease of the volume of compression chamber 118 (e.g., such that the pressure of the working fluid is maintained) or the rate of increase of the volume of transfer chamber 132 is less than the rate of decrease of the volume of compression chamber 118 (e.g., such that the pressure of the working fluid continues to increase). Thus, the desired compression ratio of split-cycle engine 1100 (e.g., pressure of the working fluid at the end of the compression and transfer) is achieved. Thus, in some embodiments, the total volume of chambers 118 and 132 continues decreasing and piston 112 further compresses the working fluid in compression chamber 118 and into transfer chamber 132. In some embodiments, further compressing the working fluid while transferring the working fluid reduces or minimizes unnecessary work performed by the transfer pistons and/or can reduce or prevent flow of EGR into compression chamber 118. In some embodiments, piston 122 is past BDC and can continue the exhaust stroke (e.g., exhausting burned working fluid). In some embodiments, exhaust port 129 is opening to exhaust burned working fluid (e.g., combustion product) from expansion chamber 128.

Figure 12:
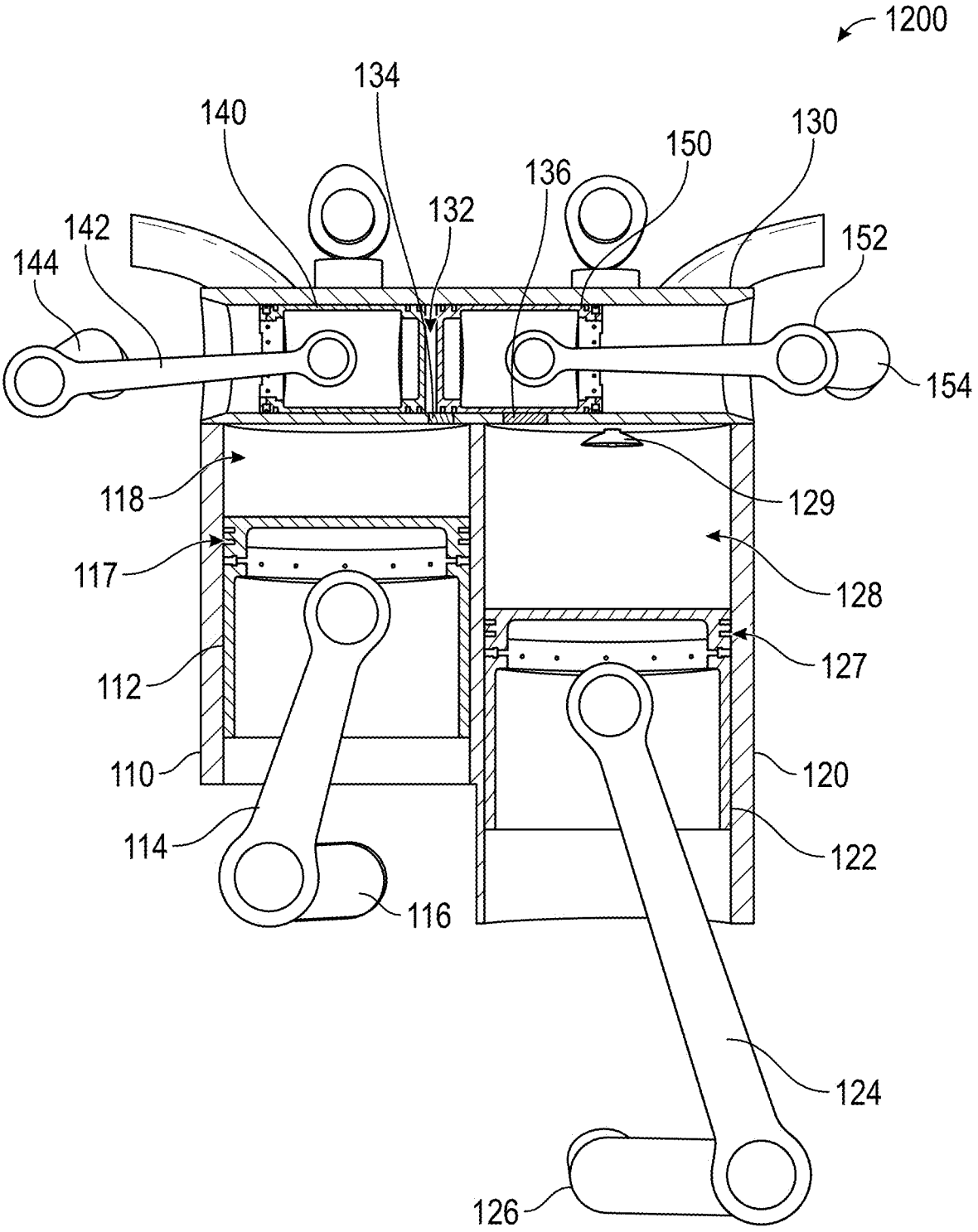
FIG. 12 illustrates a cross-sectional illustration of a split-cycle engine implementing an exemplary 2PTM at an expansion crankshaft angle of 270° in accordance with embodiments of the disclosure.

FIG. 12 illustrates a cross-sectional illustration of a split-cycle engine 1200 implementing an exemplary 2PTM at an expansion crankshaft angle of 270° in accordance with embodiments of the disclosure. In some embodiments, piston 112 is moving towards TDC during a compression stroke (e.g., compressing the working fluid in compression chamber 118 and/or transfer chamber 132). In some embodiments, piston 140 is moving leftwards (e.g., towards BDC) and is no longer covering port 134. In some embodiments, piston 150 is at or near TDC and can continue partially covering port 134. In some examples, port 134 is partially uncovered and partially uncovered and thus, transfer chamber 132 is fluidly coupled to compression chamber 118. Thus, in some embodiments, working fluid from compression chamber 118 continues transferring to transfer chamber 132. In some embodiments, transfer chamber 132 is expanding or otherwise larger than when split-cycle engine is at 240° (e.g., as in FIG. 11). In some embodiments, the total volume of chambers 118 and 132 continues decreasing and piston 112 further compresses the working fluid in compression chamber 118 and into transfer chamber 132. In some embodiments, piston 122 is past BDC and continues the exhaust stroke (e.g., exhausting burned working fluid). In some embodiments, exhaust port 129 is opening to exhaust burned working fluid (e.g., combustion product) from expansion chamber 128.

Figure 13:
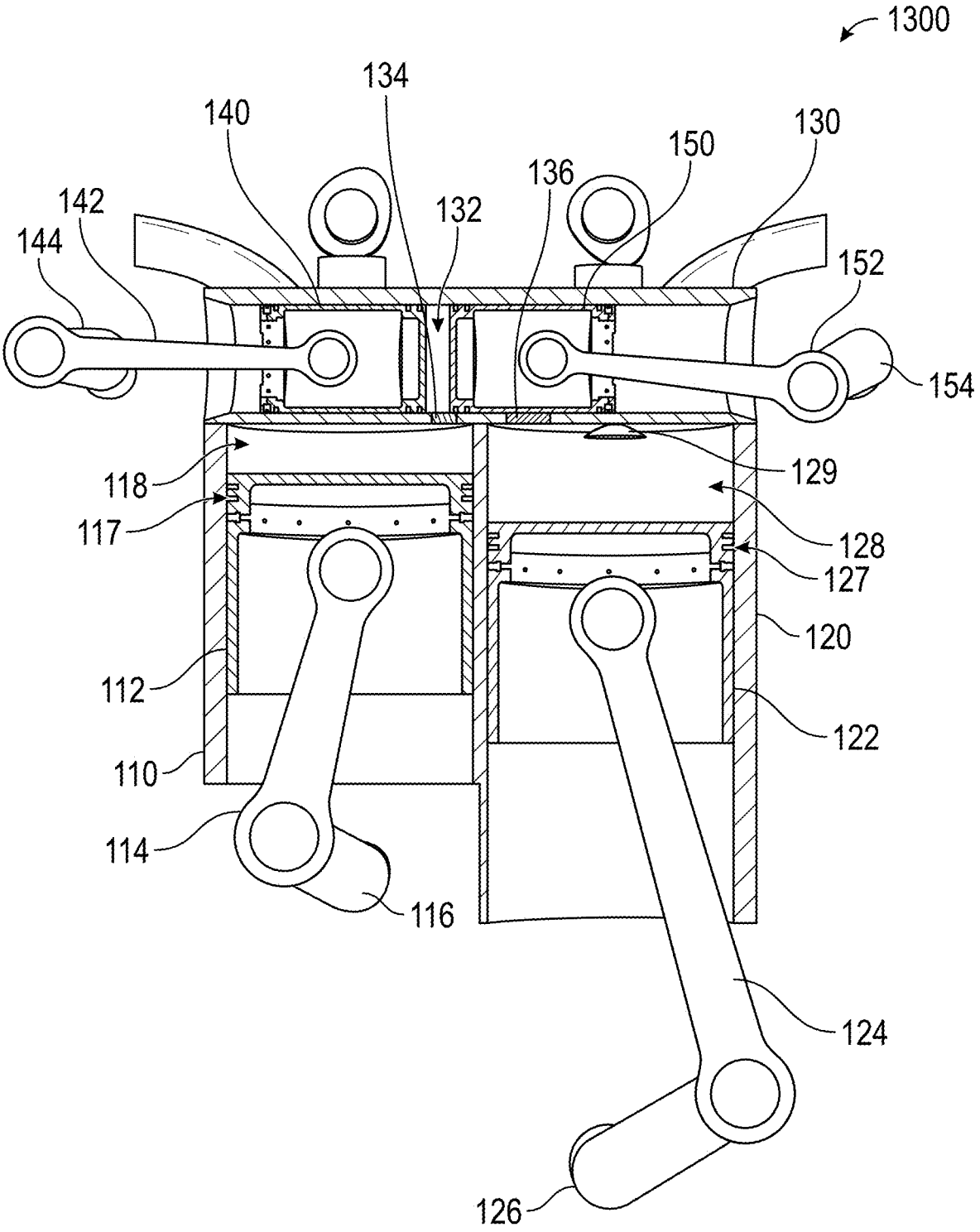
FIG. 13 illustrates a cross-sectional illustration of a split-cycle engine implementing an exemplary 2PTM at an expansion crankshaft angle of 300° in accordance with embodiments of the disclosure.

FIG. 13 illustrates a cross-sectional illustration of a split-cycle engine 1300 implementing an exemplary 2PTM at an expansion crankshaft angle of 300° in accordance with embodiments of the disclosure. In some embodiments, piston 112 is moving towards TDC during a compression stroke (e.g., compressing the working fluid in compression chamber 118 and/or transfer chamber 132). In some embodiments, piston 140 is past BDC and is moving rightwards (e.g., towards TDC) and is not covering port 134. In some embodiments, piston 150 is past TDC, is moving rightwards, and can continue partially covering port 134. In some examples, port 134 is partially covered and partially uncovered and thus, transfer chamber 132 is fluidly coupled to compression chamber 118. Thus, in some embodiments, working fluid from compression chamber 118 can continue transferring to transfer chamber 132. In some embodiments, transfer chamber 132 is expanding or otherwise larger than when split-cycle engine is at 270° (e.g., as in FIG. 12). In some embodiments, the total volume continues decreasing and piston 112 further compresses the working fluid in compression chamber 118 and into transfer chamber 132. In some embodiments, piston 122 is past BDC and continues the exhaust stroke (e.g., exhausting burned working fluid). In some embodiments, exhaust port 129 is open (e.g., starting to close but still open) to exhaust burned working fluid (e.g., combustion product) from expansion chamber 128

Figure 14:
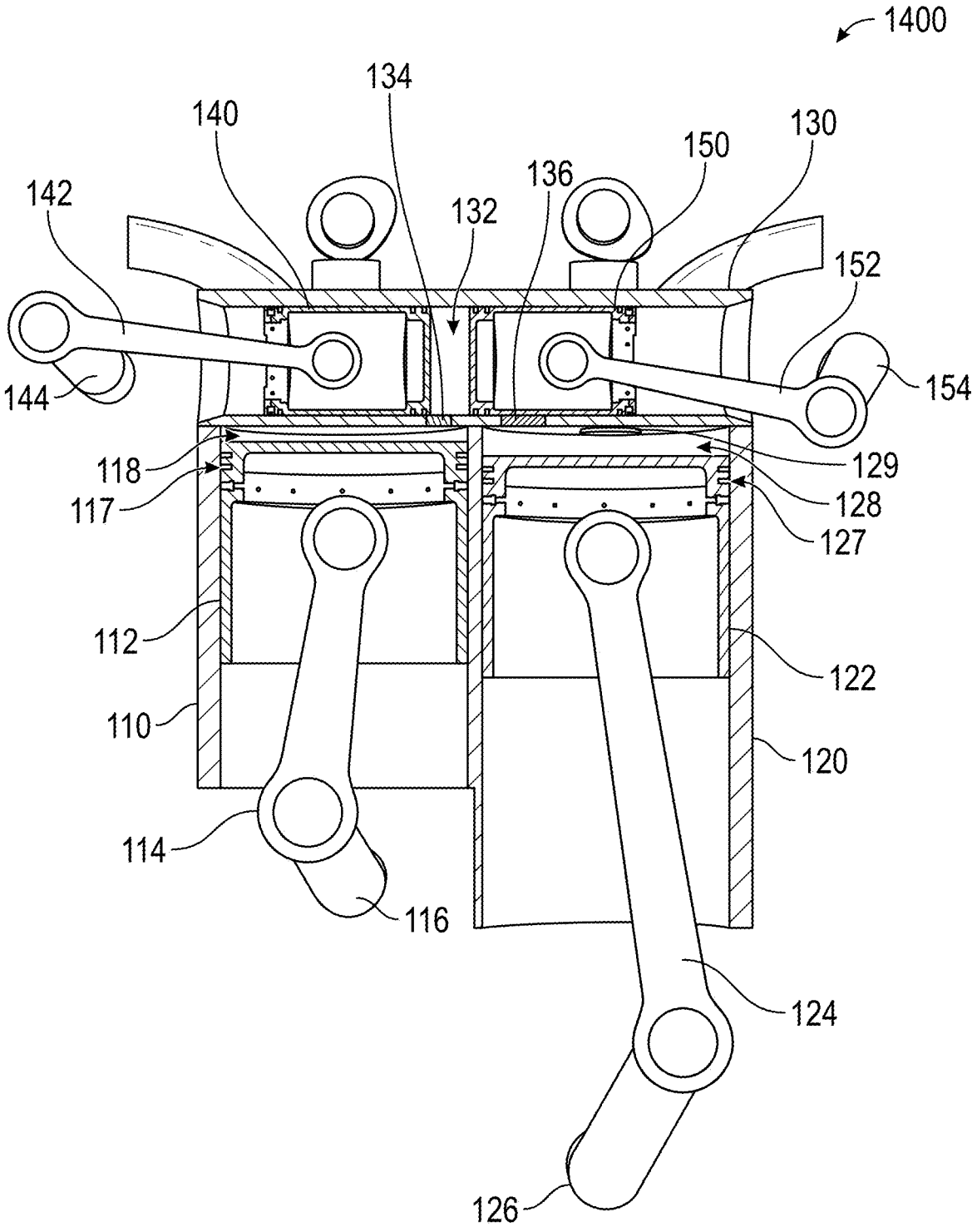
FIG. 14 illustrates a cross-sectional illustration of a split-cycle engine implementing an exemplary 2PTM at an expansion crankshaft angle of 330° in accordance with embodiments of the disclosure.

FIG. 14 illustrates a cross-sectional illustration of a split-cycle engine 1400 implementing an exemplary 2PTM at an expansion crankshaft angle of 330° in accordance with embodiments of the disclosure. In some embodiments, piston 112 is moving towards TDC during a compression stroke (e.g., compressing the working fluid in compression chambers 118 and 132) and is nearing TDC. In some embodiments, piston 140 is moving rightwards (e.g., towards TDC) and is partially covering port 134. In some embodiments, piston 150 is moving rightwards (e.g., towards BDC) and is no longer covering port 134. In some examples, port 134 is partially covered and partially uncovered and thus, transfer chamber 132 is fluidly coupled to compression chamber 118. Thus, in some embodiments, working fluid from compression chamber 118 continues transferring to transfer chamber 132. In some embodiments, transfer chamber 132 is expanding or otherwise larger than when split-cycle engine is at 300° (e.g., as in FIG. 13). In some embodiments, when split-cycle engine is at 300°, the rate of increase in the volume of transfer chamber 132 is the same or similar as the rate of compression (e.g., decrease) in the volume of compression chamber 118. Thus, the compression ratio of split-cycle engine 1100 (e.g., pressure of the working fluid) is maintained or substantially maintained while transferring working fluid from compression chamber 118 to transfer chamber 132. In some embodiments, the total volume continues decreasing and piston 112 further compresses the working fluid in compression chamber 118 and into transfer chamber 132. In some embodiments, piston 122 is past BDC and can continue the exhaust stroke (e.g., exhausting burned working fluid). In some embodiments, exhaust port 129 is open (e.g., starting to close but still open) to exhaust burned working fluid (e.g., combustion product) from expansion chamber 128.

In some embodiments, after the snapshot shown in FIG. 14, the split-cycle engine will reach the 360° position (e.g., the angle of rotation of crankshaft 116 is at 360°). In other words, the split-cycle engine will return to the 0° position. Thus, in some embodiments, the split-cycle engine will return to the position of the cycle described in FIG. 3.

In some embodiments, a split-cycle engine implementing a 2PTM fluidly couples the transfer chamber to the compression chamber and the expansion chamber concurrently. In such embodiments, the compression cylinder transfers working fluid directly from the compression chamber into the expansion chamber via the transfer chamber. This embodiment is referred to as "port overlap" because the timing of when the port on the compression interface is fluidly coupled and the timing of when the port on the expansion interface is fluidly coupled overlaps. In some embodiments, the port overlap is achieved by changing the location of the ports along the interface between the respective cylinder and the transfer cylinder such that there is a period of time in which the two pistons of the transfer chamber do not fully cover both ports. In some embodiments, the port overlap is achieved by changing the timing of the pistons (e.g., by offsetting the timing of the pistons) such that one or both pistons do not fully cover both parts. In some embodiments, the port overlap is achieved by implementing a notch (e.g., a diagonal cut-out) on the head of one or both of the pistons in the transfer chamber.

Figure 15:
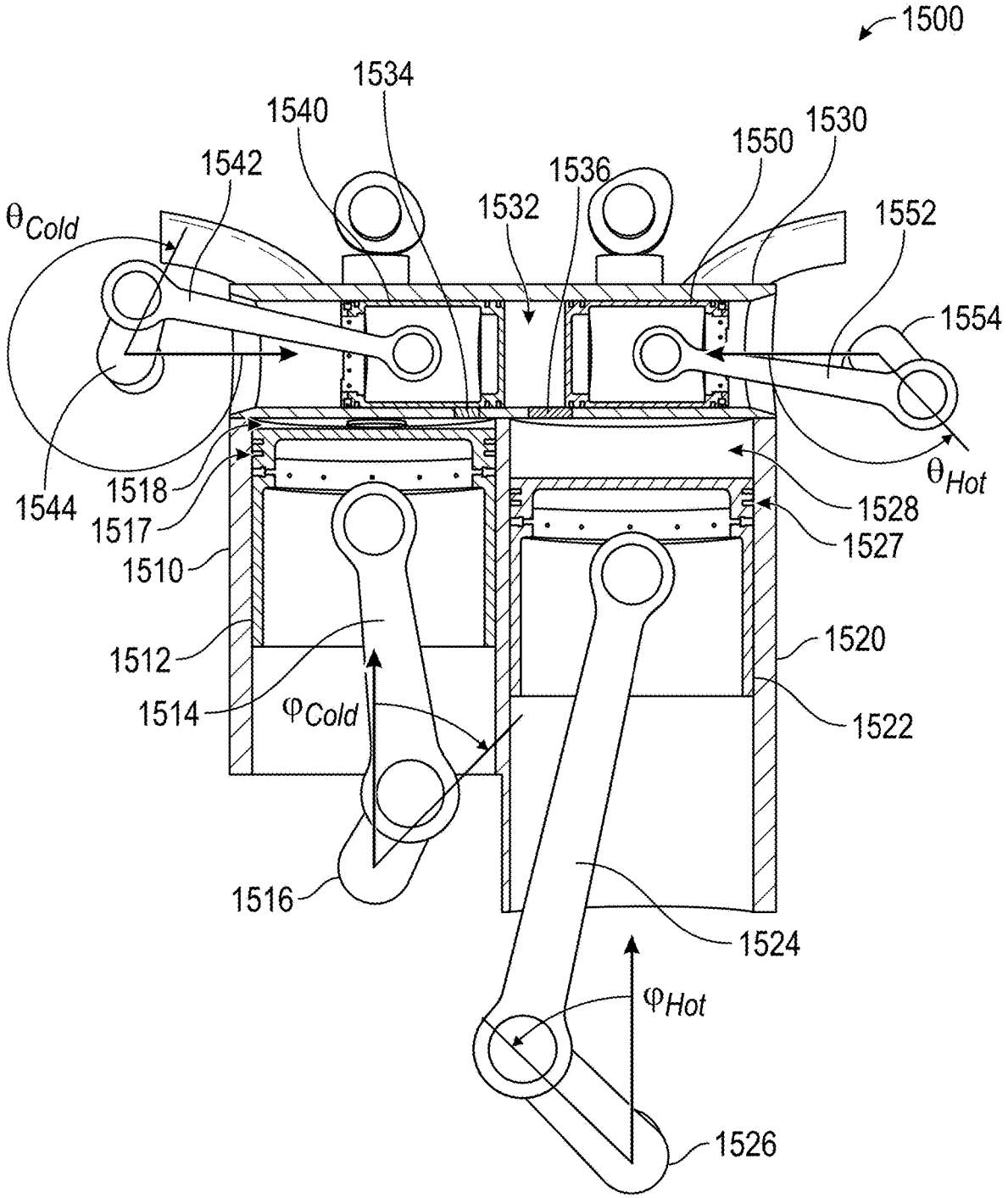
FIG. 15 illustrates a cross-sectional illustration of a split-cycle engine implementing an exemplary 2PTM at an expansion crankshaft angle of 45° with port overlap in accordance with embodiments of the disclosure.

FIG. 15 illustrates a cross-sectional illustration of a split-cycle engine 1500 implementing an exemplary 2PTM with port overlap in accordance with embodiments of the disclosure. For ease of description and illustration, FIG. 15 illustrates split-cycle engine 1500 at an angle of 45° (e.g., hot side/expansion crank angle of 45°) to provide an overview of the structure of an exemplary split-cycle engine with 2PTM with port overlap in accordance with embodiments of the disclosure. It is understood that further details with respect to particular angles of interest (e.g., corresponding to particular events during an engine cycle) are provided below with respect to FIGS. 16-18. Omission and/or simplification of description with respect to FIG. 15 is not to be interpreted as limiting the scope of the disclosure.

In some embodiments, split-cycle engine 1500 is similar to split-cycle engine 100 and can include compression cylinder 1510, expansion cylinder 1520, and transfer cylinder 1530 (e.g., which is the same or similar to compression cylinder 110, expansion cylinder 120, and transfer cylinder 130, respectively. In some embodiments, transfer cylinder 1530 can include piston 1540 and piston 1550 (e.g., which is the same or similar to piston 140 and piston 150, respectively).

In some embodiments, the diameters of the cylinders (e.g., compression cylinder 1510, expansion cylinder 1520, and transfer cylinder 1530) are smaller as compared to embodiments that do not implement port overlap. In some embodiments, decreasing the diameter of the cylinders (e.g., and thus the volume of the respective chambers) can help maintain a desired compression ratio for the engine. In some embodiments, decreasing the volume of the chambers results in the same volume for the working fluid as in the embodiment without port overlap (e.g., because all three chambers are fluidly coupled during a portion of the cycle, thus increasing the number of chambers for the working fluid to reside, as will be explained in more detail below).

In some embodiments, the timing of the rotation of piston 1512 and piston 1540 is delayed as compared to the split-cycle engine embodiment without port overlap. In other words, the cold-side pistons (e.g., piston 1512 and 1540) have a larger phase lag to the hot-side pistons (e.g., piston 1522 and piston 1550). In some embodiments, the phase lag is 19° for piston 1512 and 9' for piston 1540 (as compared to piston 112 and piston 140 on split-cycle engine 100). In some examples, having a larger phase lag between the cold side pistons and the hot side pistons changes the timing in which port 1534 is covered by piston 1540. In some embodiments, a larger phase lag delays the window of time in which port 1534 is covered by piston 1540. Thus, in some embodiments, port 1534 is at least partially uncovered and fluidly coupling compression chamber 1518 with transfer chamber 1532 when port 1536 is at least partially uncovered and fluidly coupling transfer chamber 1532 with expansion chamber 1528, thereby fluidly coupling compression chamber 1518 with expansion chamber 1528.

In some embodiments, during one exemplary cycle of split-cycle engine 1500, angles $\phi_{HOT}$, $\phi_{COLD}$, $\theta_{HOT}$, and $\theta_{COLD}$ corresponding to crankshafts 1526, 1516, 1554, and 1544, respectively, follows the pattern shown below in Table 2.

TABLE 2

| $\phi_{HOT}$ | $\phi_{COLD}$ | $\theta_{HOT}$ | $\theta_{COLD}$ |
|---|---|---|---|
| 0 | −19 | 90 | 237 |
| 10 | −9 | 100 | 247 |
| 19 | 0 | 109 | 256 |
| 30 | 11 | 120 | 267 |
| 60 | 41 | 150 | 297 |
| 90 | 71 | 180 | 327 |
| 120 | 101 | 210 | 357 |
| 150 | 131 | 240 | 27 |
| 180 | 161 | 270 | 57 |
| 210 | 191 | 300 | 87 |
| 240 | 221 | 330 | 117 |
| 270 | 251 | 360 | 147 |
| 300 | 281 | 30 | 177 |
| 330 | 311 | 60 | 207 |

Figure 16:
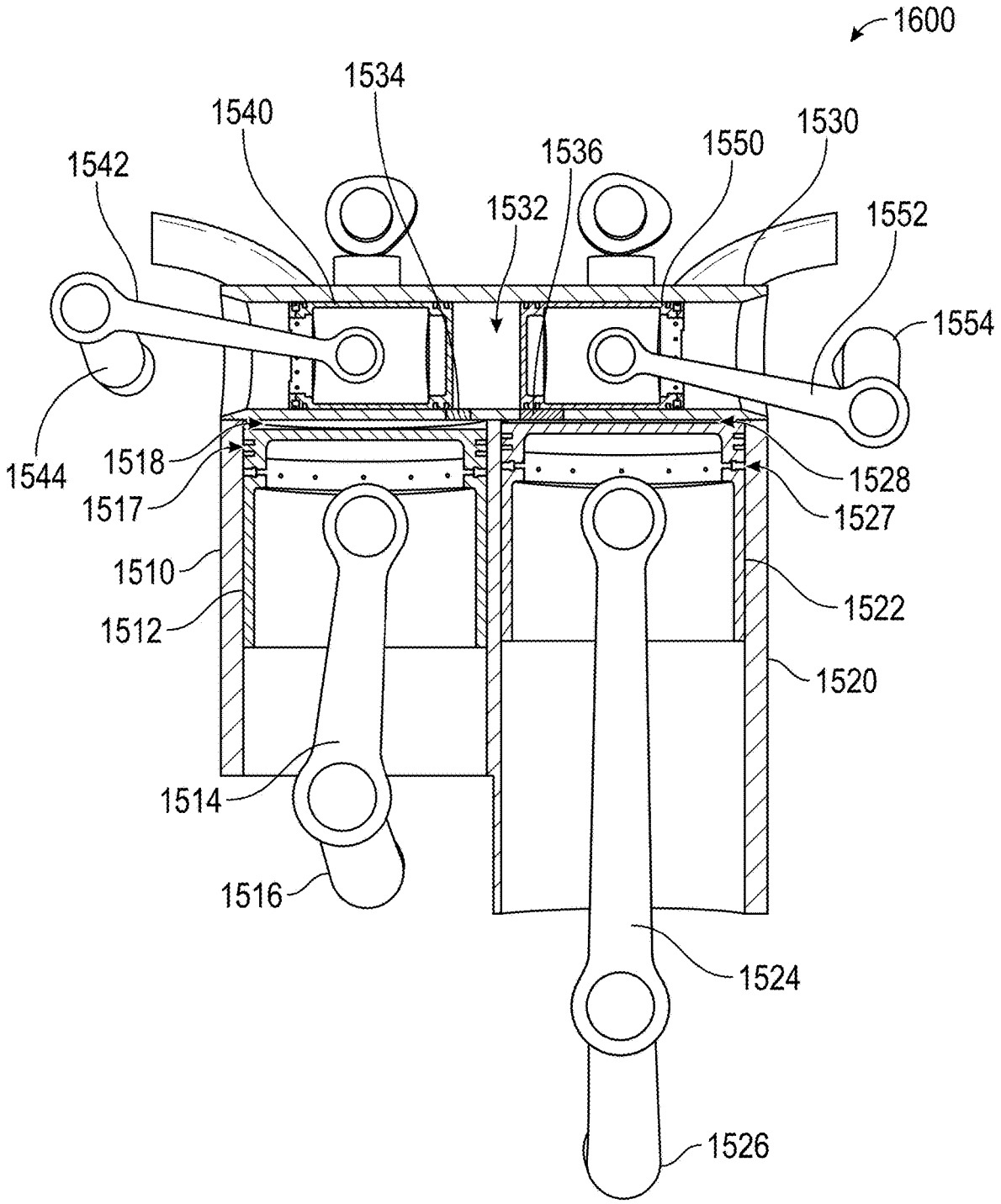
FIG. 16 illustrates a cross-sectional illustration of a split-cycle engine implementing an exemplary 2PTM with port overlap at an expansion crankshaft angle of 0° in accordance with embodiments of the disclosure.
Figure 17:
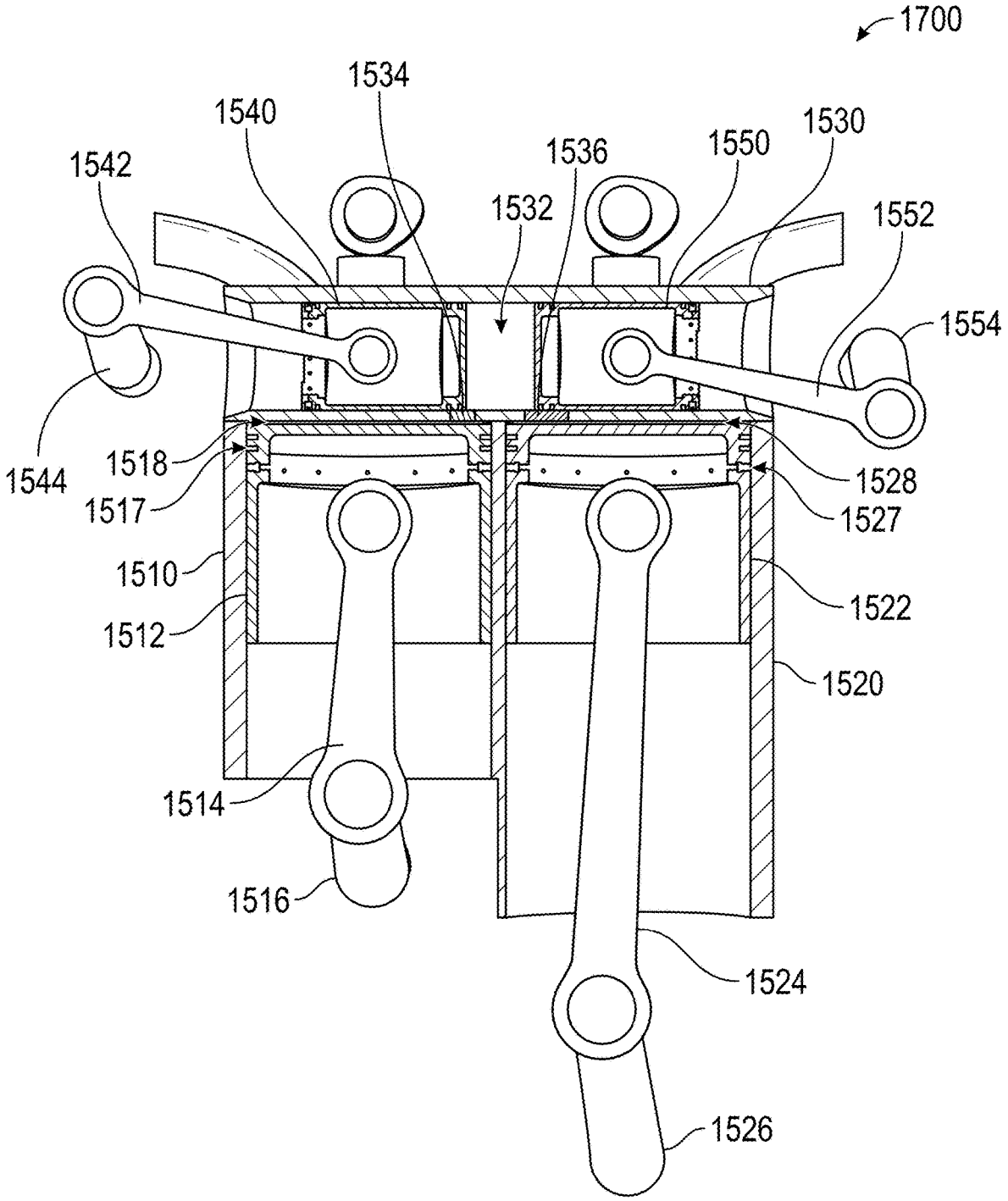
FIG. 17 illustrates a cross-sectional illustration of a split-cycle engine implementing an exemplary 2PTM with port overlap at an expansion crankshaft angle of 10° in accordance with embodiments of the disclosure.
Figure 18:
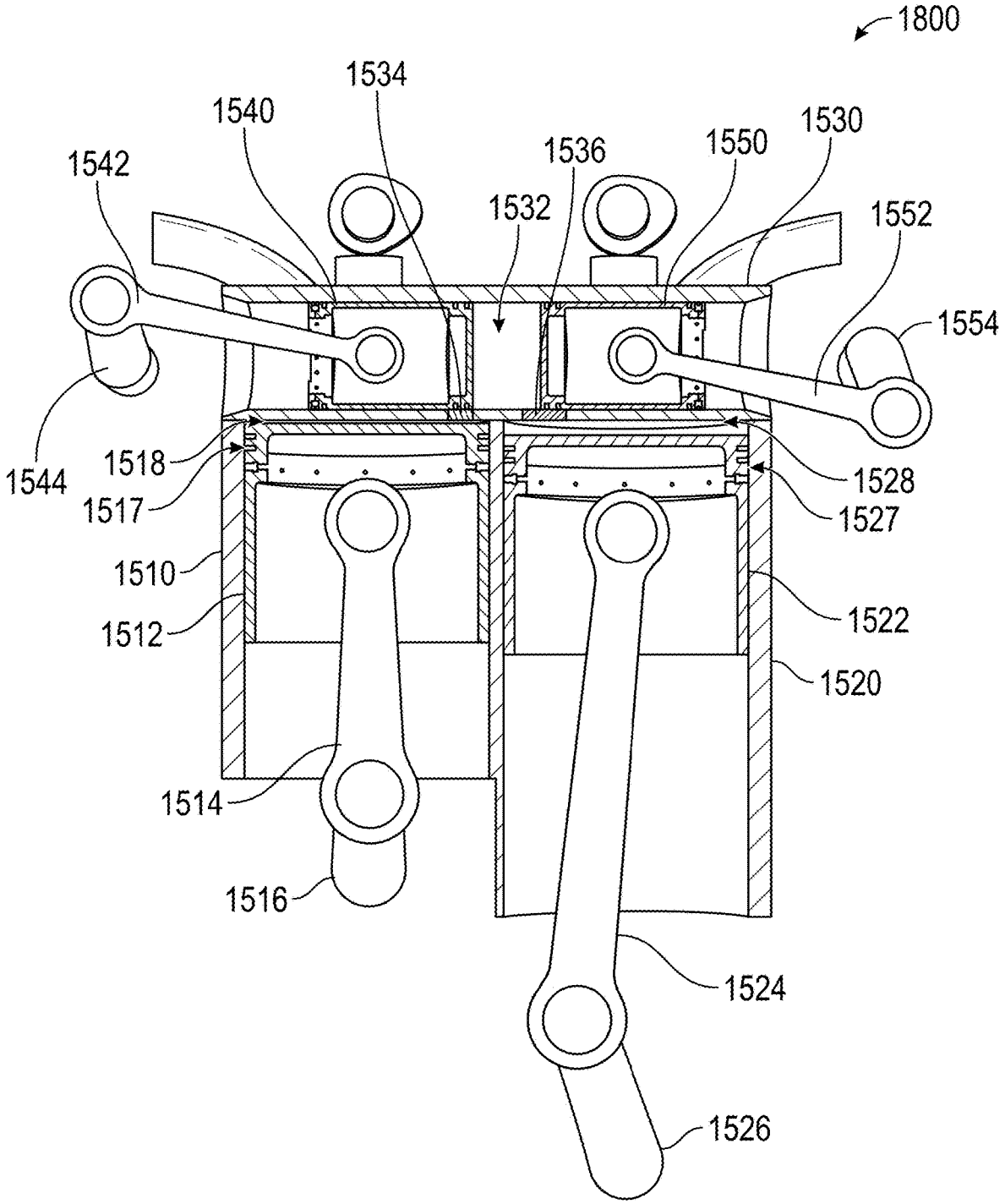
FIG. 18 illustrates a cross-sectional illustration of a split-cycle engine implementing an exemplary 2PTM with port overlap at an expansion crankshaft angle of 19° in accordance with embodiments of the disclosure.

FIGS. 16-18 illustrate three snapshots of an exemplary cycle of a split-cycle engine implementing port overlap according to embodiments of the disclosure. FIG. 16 illustrates a cross-sectional illustration of a split-cycle engine 1600 implementing an exemplary 2PTM with port overlap at an expansion crankshaft angle of 0° in accordance with embodiments of the disclosure. In some embodiments, when split-cycle engine 1600 is at 0° (e.g., when the angle of rotation of crankshaft 1526 is at 0°), piston 1522 is at TDC. In some embodiments, piston 1510 is moving upwards (e.g., towards TDC). In some embodiments, piston 1540 is partially covering port 1534. In some embodiments, when port 1534 is at least partially uncovered, transfer chamber 1532 is fluidly coupled to compression chamber 1518. In some embodiments, working fluid is flowing, transferring and/or compressing into transfer chamber 1532 (e.g., by compression cylinder 1510). In some embodiments, piston 1550 is covering port 1536. In some embodiments, transfer chamber 1532 is fluidly decoupled from expansion chamber 1528.

FIG. 17 illustrates a cross-sectional illustration of a split-cycle engine 1700 implementing an exemplary 2PTM with port overlap at an expansion crankshaft angle of 10° in accordance with embodiments of the disclosure. In some embodiments, when split-cycle engine 1700 is at 10° (e.g., when the angle of rotation of crankshaft 1526 is at 10°), piston 1522 is beyond TDC and is moving downwards (e.g., towards BDC). In some embodiments, piston 1510 is moving upwards (e.g., towards TDC). In some embodiments, piston 1550 is moving rightwards and partially unblocks port 1536, thus fluidly coupling transfer chamber 1532 to expansion chamber 1528. In some embodiments, piston 1540 is moving rightwards and partially unblocks port 1534, thus fluidly coupling transfer chamber 1532 to compression chamber 1518. Thus, in some embodiments, port 1534 and port 1536 is at least partially unblocked and transfer chamber 1532 is fluidly coupled to both compression chamber 1518 and expansion chamber 1528. In some embodiments, working fluid is flowing, transferring and/or compressing into transfer chamber 1532 and/or into expansion chamber 1528 (e.g., by compression cylinder 1510).

FIG. 18 illustrates a cross-sectional illustration of a split-cycle engine 1800 implementing an exemplary 2PTM with port overlap at an expansion crankshaft angle of 19° in accordance with embodiments of the disclosure. In some embodiments, when split-cycle engine 1700 is at 19° (e.g., when the angle of rotation of crankshaft 1526 is at 19°), piston 1522 is beyond TDC and is moving downwards (e.g., towards BDC). In some embodiments, piston 1510 is at TDC. In some embodiments, piston 1540 is moving rightwards and is fully blocking port 1534, thus fluidly decoupling transfer chamber 1532 from compression chamber 1518. In some embodiments, piston 1550 is moving rightwards and can partially unblock port 1536, thus fluidly coupling transfer chamber 1532 to expansion chamber 1528. In some embodiments, working fluid is flowing, transferring and/or expanding into expansion chamber 1528 (e.g., by ignition of working fluid). In some embodiments, the working fluid is ignited by an ignition source (e.g., a spark plug) any time while transfer chamber 1532 is fluidly coupled to expansion chamber 1528. In some embodiments, the working fluid is ignited before or after transfer chamber 1532 fluidly decouples from compression chamber 1518 (e.g., −10°, −5°, 0°, 5°, 10°).

Accordingly, some embodiments of this disclosure can implement a port overlap such that the compression chamber, transfer chamber, and expansion chamber are simultaneously fluidly coupled during a portion of the engine cycle. In some embodiments, implementing port overlap permits improved coupling between the transfer chamber and the expansion chamber at the time of combustion and can reduce the amount of crevice volumes (e.g., thus reducing the amount of combustion product that flows back to the compression chamber as EGR). In some embodiments, implementing port overlap and simultaneously fluidly coupling all three chambers minimizes or reduces a sudden pressure drop at the moment that the transfer chamber is fluidly coupled to the expansion chamber. In some embodiments, to achieve the desired compression ratio, the radius of the cylinders is reduced as compared to the embodiment without port overlap.

Although only three snapshots of an exemplary cycle of a split-cycle engine implementing port overlap are illustrated and described, it is understood that the remainder of the cycle of the split-cycle engine is extrapolated using the description above and/or the angles provided in Table 2.

Figure 19:
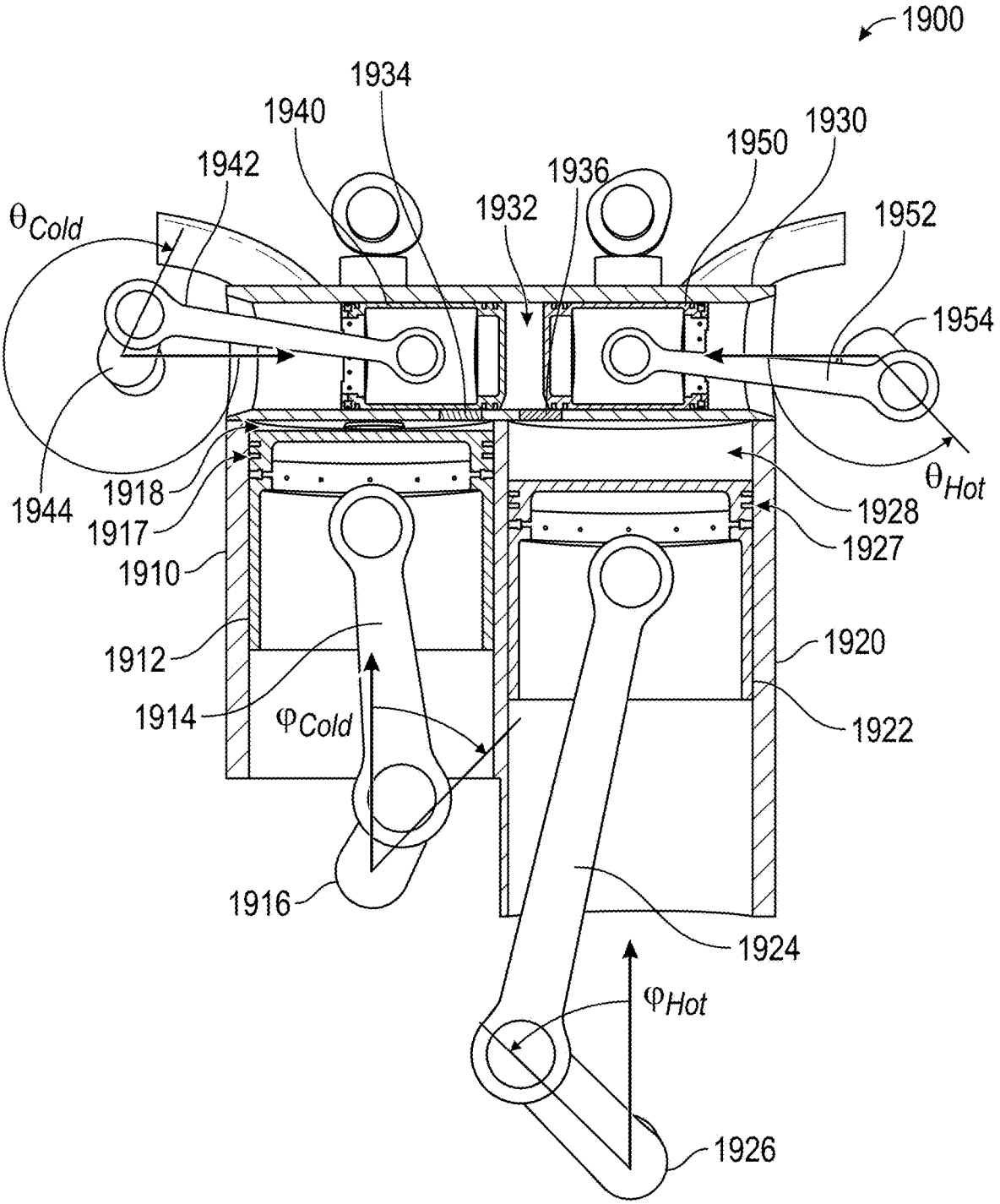
FIG. 19 illustrates a cross-sectional illustration of a split-cycle engine implementing an exemplary 2PTM with port overlap using one or more notched pistons in accordance with embodiments of the disclosure.

FIG. 19 illustrates a cross-sectional illustration of a split-cycle engine 1900 implementing an exemplary 2PTM with port overlap using notched pistons in accordance with embodiments of the disclosure. In some embodiments, using a notch allows a split cycle engine to implement port overlap without significant changes to the size (e.g., bore) of the 2PTM cylinder (e.g., transfer cylinder 1930). For example, as explained above, all three chambers are fluidly coupled during a portion of the cycle (e.g., compression chamber 1918, expansion chamber 1928, and transfer chamber 1932). In such examples, to maintain the same or similar compression ratio (e.g., as compared to a split-cycle engine that is not implementing port overlap), the volume of transfer chamber 1932 can be reduced to compensate for the increased volumes contributed by compression chamber 1918 and expansion chamber 1928. Thus, a particular compression ratio can be achieved with an engine implementing port overlap by reducing the size (e.g., bore) of transfer cylinder 1930 or adding notched pistons, as described, or a combination thereof. For example, small engines may be unable to further reduce the size of the cylinders. Thus, a notched piston head serves as an alternative method of achieving port overlap for a desired compression ratio. For ease of description and illustration, FIG. 19 illustrates split-cycle engine 1900 at an angle of 45° (e.g., hot side/expansion crank angle of 45°) to provide an overview of the structure of an exemplary split-cycle engine with 2PTM with port overlap using one or more notched pistons in accordance with embodiments of the disclosure. It is understood that further details with respect to particular angles of interest (e.g., corresponding to particular events during an engine cycle) are provided below with respect to FIGS. 20-22. Omission and/or simplification of description with respect to FIG. 19 is not to be interpreted as limiting the scope of the disclosure.

In some embodiments, split-cycle engine 1900 is similar to split-cycle engine 100 and split-cycle engine 1500 and can include compression cylinder 1910, expansion cylinder 1920, and transfer cylinder 1930 (e.g., which is the same or similar to compression cylinder 110, expansion cylinder 120, and transfer cylinder 130, respectively). In some embodiments, transfer cylinder 1930 can include piston 1940 and piston 1950 (e.g., which is the same or similar to piston 140 and piston 150, respectively).

In some embodiments, the timing of the rotation of piston 1912 and piston 1940 is delayed as compared to the split-cycle engine embodiment without port overlap and/or without notched pistons. In other words, the cold-side pistons (e.g., piston 1912 and 1940) can have a larger phase lag to the hot-side pistons (e.g., piston 1922 and piston 1950). In some embodiments, piston 1912 can have a 23° phase lag and piston 1540 has no phase lag (as compared to piston 112 and piston 140 on split-cycle engine 100). In some embodiments, one or both of piston 1940 and piston 1950 have a notch in the head of the piston. As used herein and as shown in FIG. 19, a notch is a diagonal cut-out on the head of the piston along the upper-inner side of the piston (e.g., on the side that interfaces with the ports. In some embodiments, the notch modifies and/or shifts the timing in which port 1934 is covered by piston 1940 and the timing in which port 1936 is covered by piston 1950. In some embodiments, the notch delays the window of time in which port 1934 is covered by piston 1934 and the window of time in which port 1936 is covered by piston 1950 (e.g., functionally causing more phase lag than without the notch) and enabling the fluid coupling of compression chamber 1918, transfer chamber 1932 and/or expansion chamber 1928 at a crankshaft angle combination that otherwise without the notches would not be coupled; i.e. enable port overlap. Thus, in some embodiments, port 1934 is at least partially uncovered and fluidly coupling compression chamber 1918 with transfer chamber 1932 when port 1936 is at least partially uncovered and fluidly coupling transfer chamber 1932 with expansion chamber 1928, thereby fluidly coupling compression chamber 1918 with expansion chamber 1928.

In some embodiments, during one exemplary cycle of split-cycle engine 1900, angles $\phi_{HOT}$, $\phi_{COLD}$, $\theta_{HOT}$, and $\theta_{COLD}$ corresponding to crankshafts 1926, 1916, 1954, and 1944, respectively, follows the pattern shown below in Table 3.

TABLE 3

| $\phi_{HOT}$ | $\phi_{COLD}$ | $\theta_{HOT}$ | $\theta_{COLD}$ |
|---|---|---|---|
| 0 | −23 | 90 | 246 |
| 12 | −11 | 102 | 258 |
| 23 | 0 | 113 | 269 |
| 30 | 7 | 120 | 276 |
| 60 | 37 | 150 | 306 |
| 90 | 67 | 180 | 336 |
| 120 | 97 | 210 | 6 |
| 150 | 127 | 240 | 36 |
| 180 | 157 | 270 | 66 |
| 210 | 187 | 300 | 96 |
| 240 | 217 | 330 | 126 |
| 270 | 247 | 360 | 156 |
| 300 | 277 | 30 | 186 |
| 330 | 307 | 60 | 216 |

Figure 20:
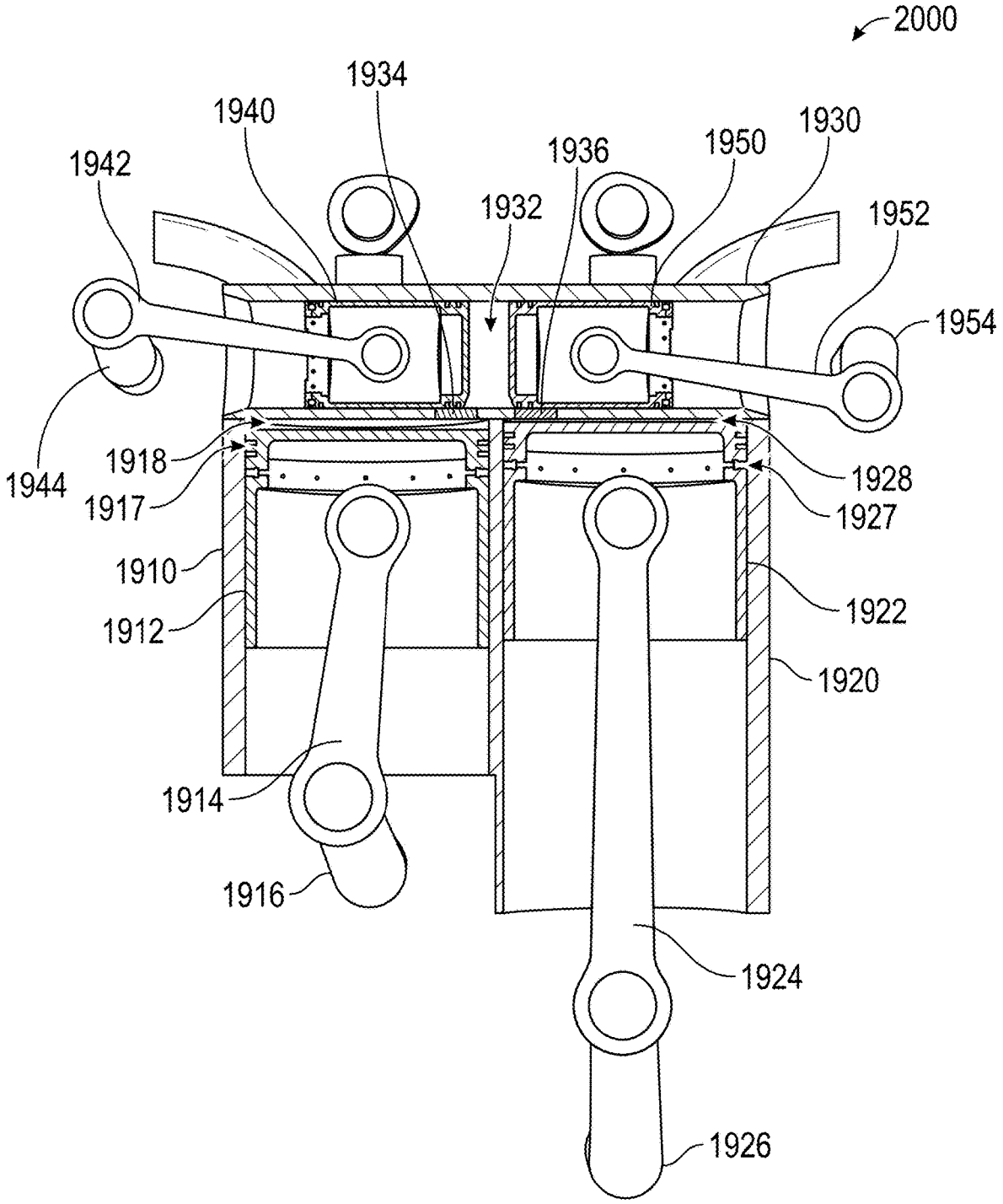
FIG. 20 illustrates a cross-sectional illustration of a split-cycle engine implementing an exemplary 2PTM with port overlap using one or more notched pistons at an expansion crankshaft angle of 0° in accordance with embodiments of the disclosure.
Figure 21:
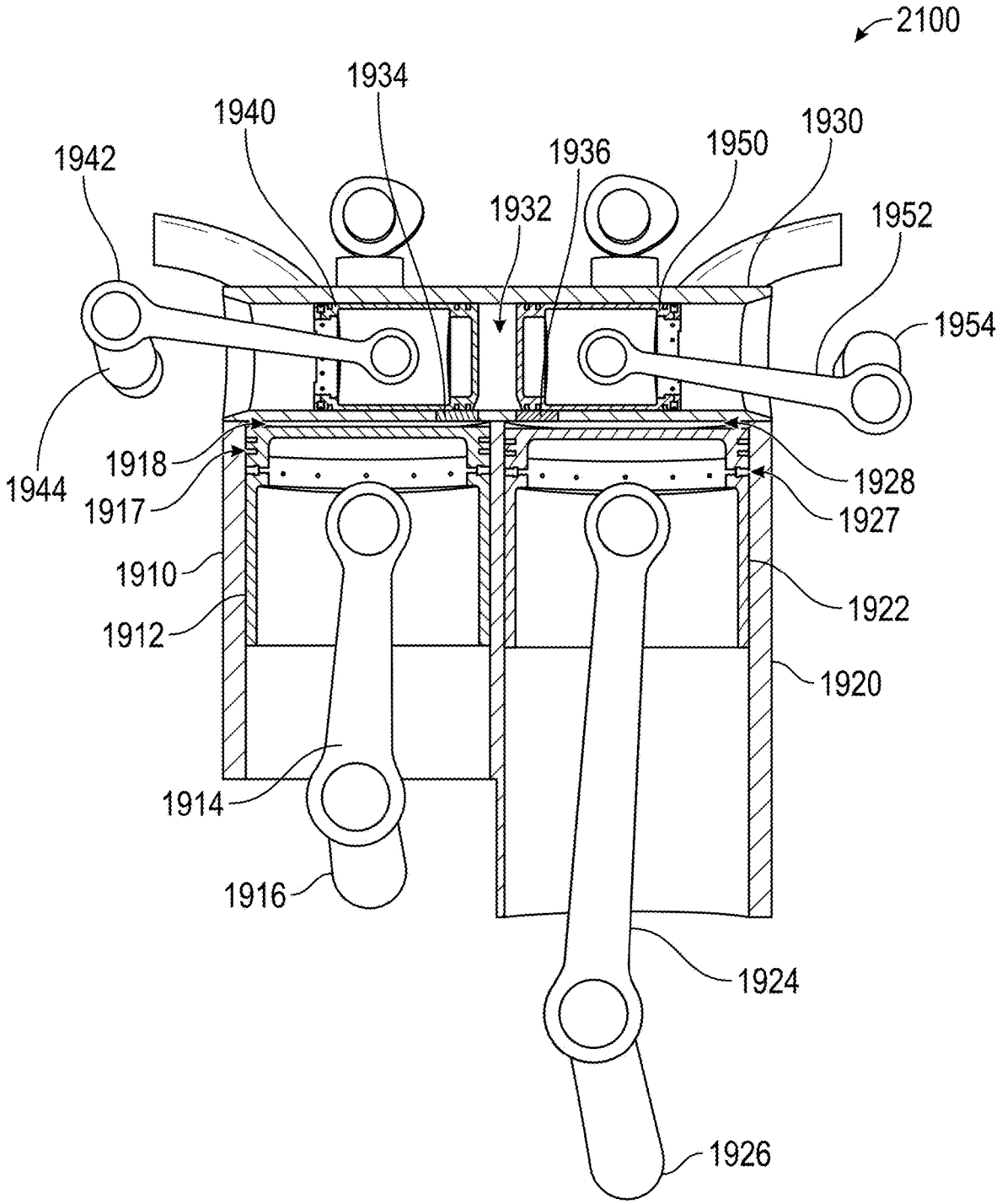
FIG. 21 illustrates a cross-sectional illustration of a split-cycle engine implementing an exemplary 2PTM with port overlap using one or more notched pistons at an expansion crankshaft angle of 12° in accordance with embodiments of the disclosure.
Figure 22:
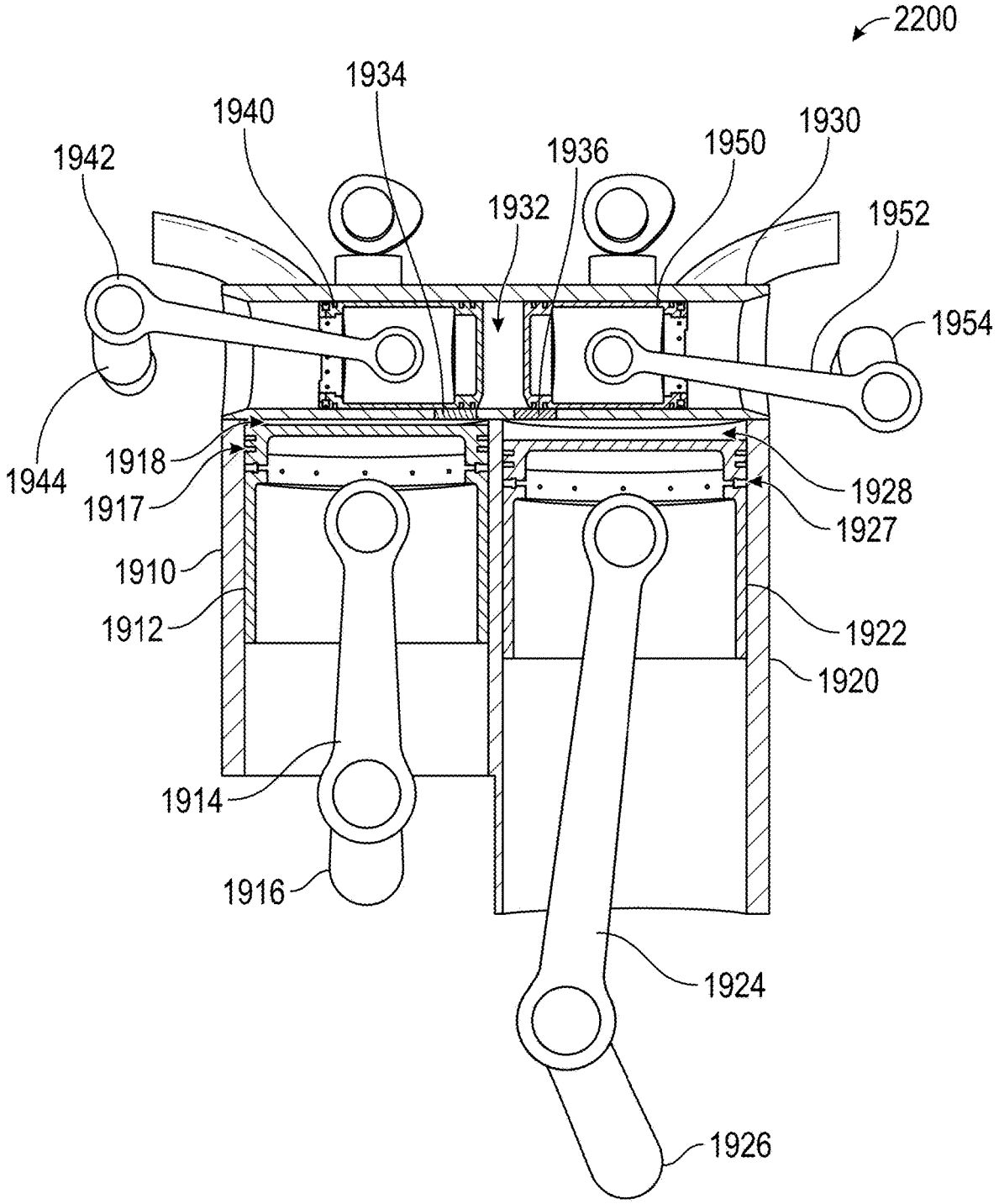
FIG. 22 illustrates a cross-sectional illustration of a split-cycle engine implementing an exemplary 2PTM with port overlap using one or more notched pistons at an expansion crankshaft angle of 23° in accordance with embodiments of the disclosure.

FIGS. 20-22 illustrate three snapshots of an exemplary cycle of a split-cycle engine implementing port overlap using one or more notched pistons in accordance with embodiments of the disclosure. FIG. 20 illustrates a cross-sectional illustration of a split-cycle engine 2000 implementing an exemplary 2PTM with port overlap using one or more notched pistons at an expansion crankshaft angle of 0° in accordance with embodiments of the disclosure. In some embodiments, when split-cycle engine 2000 is at 0° (e.g., when the angle of rotation of crankshaft 1926 is at 0°), piston 1922 is at TDC. In some embodiments, piston 1912 is moving upwards (e.g., towards TDC). In some embodiments, piston 1940 is partially covering port 1934. In some embodiments, the notch on piston 1940 is angled such that piston 1940 is partially uncovering port 1934. In other words, the notch shifts the interface of piston 1940 leftwards such that piston 1940 functions as if there is a greater phase lag than if piston 1940 did not have a notch. In other words, the distance between piston 1940 and piston 1950 is smaller compared to an engine with transfer pistons without notches. Since the distance between piston 1940 and piston 1950 is smaller, a larger diameter transfer cylinder 1930 is used for a given desired compression ratio. In some embodiments, when port 1934 is at least partially uncovered, transfer chamber 1932 is fluidly coupled to compression chamber 1918. In some embodiments, working fluid is flowing, transferring and/or compressing into transfer chamber 1932 (e.g., by compression cylinder 1910). In some embodiments, piston 1950 is covering port 1936 (e.g., the notch on piston 1950 does not cause port 1936 to be uncovered and piston 1950 is still covering port 1936 and decoupling transfer chamber 1932 from expansion chamber 1928). In some embodiments, transfer chamber 1932 is fluidly decoupled from expansion chamber 1928.

FIG. 21 illustrates a cross-sectional illustration of a split-cycle engine 2100 implementing an exemplary 2PTM with port overlap using one or more notched pistons at an expansion crankshaft angle of 12° in accordance with embodiments of the disclosure. In some embodiments, when split-cycle engine 2100 is at 12° (e.g., when the angle of rotation of crankshaft 1926 is at 12°), piston 1922 is beyond TDC and is moving downwards (e.g., towards BDC). In some embodiments, piston 1912 is moving upwards (e.g., towards TDC). In some embodiments, piston 1950 is moving rightwards and partially unblocks port 1936 (e.g., the notch causes piston 1950 to partially unblock port 1936 even though the leading edge of piston 1950 is farther left than port 1936), thus fluidly coupling transfer chamber 1932 to expansion chamber 1928. In some embodiments, piston 1940 is moving rightwards and can partially unblock port 1934 (e.g., the notch causes piston 1940 to partially unblock port 1934 even though the leading edge of piston 1940 is farther right than port 1934), thus fluidly coupling transfer chamber 1932 to compression chamber 1918. Thus, in some embodiments, port 1934 and port 1936 is at least partially unblocked and transfer chamber 1932 is fluidly coupled to both compression chamber 1918 and expansion chamber 1928. In some embodiments, working fluid is flowing, transferring and/or compressing into transfer chamber 1932 and/or into expansion chamber 1928 (e.g., by compression cylinder 1910).

FIG. 22 illustrates a cross-sectional illustration of a split-cycle engine 2200 implementing an exemplary 2PTM with port overlap using one or more notched pistons at an expansion crankshaft angle of 23° in accordance with embodiments of the disclosure. In some embodiments, when split-cycle engine 2200 is at 23° (e.g., when the angle of rotation of crankshaft 1926 is at 23°), piston 1922 is beyond TDC and is moving downwards (e.g., towards BDC). In some embodiments, piston 1912 is at TDC. In some embodiments, piston 1940 is moving rightwards and is fully blocking port 1934 (e.g., the notch on piston 1940 does not cause port 1934 to be uncovered and piston 1940 is still covering port 1934), thus fluidly decoupling transfer chamber 1932 from compression chamber 1918. In some embodiments, piston 1950 is moving rightwards and can partially unblock port 1936, thus fluidly coupling transfer chamber 1932 to expansion chamber 1928. In some embodiments, working fluid is flowing, transferring and/or expanding into expansion chamber 1928 (e.g., by ignition of working fluid). In some embodiments, the working fluid is ignited by an ignition source (e.g., a spark plug) any time while or before transfer chamber 1932 is fluidly coupled to expansion chamber 1928 (e.g., −10°, −5°, 0°, 5°, 10®). In some embodiments, ignition can be achieved by compression of the working fluid (e.g., compression-ignition). In some embodiments, the working fluid is ignited before or after transfer chamber 1932 fluidly decouples from compression chamber 1918.

Although only three snapshots of an exemplary cycle of a split-cycle engine implementing port overlap using one or more notched pistons are illustrated and described, it is understood that the remainder of the cycle of the split-cycle engine is extrapolated using the description above and/or the angles provided in Table 3.

Figure 23A:
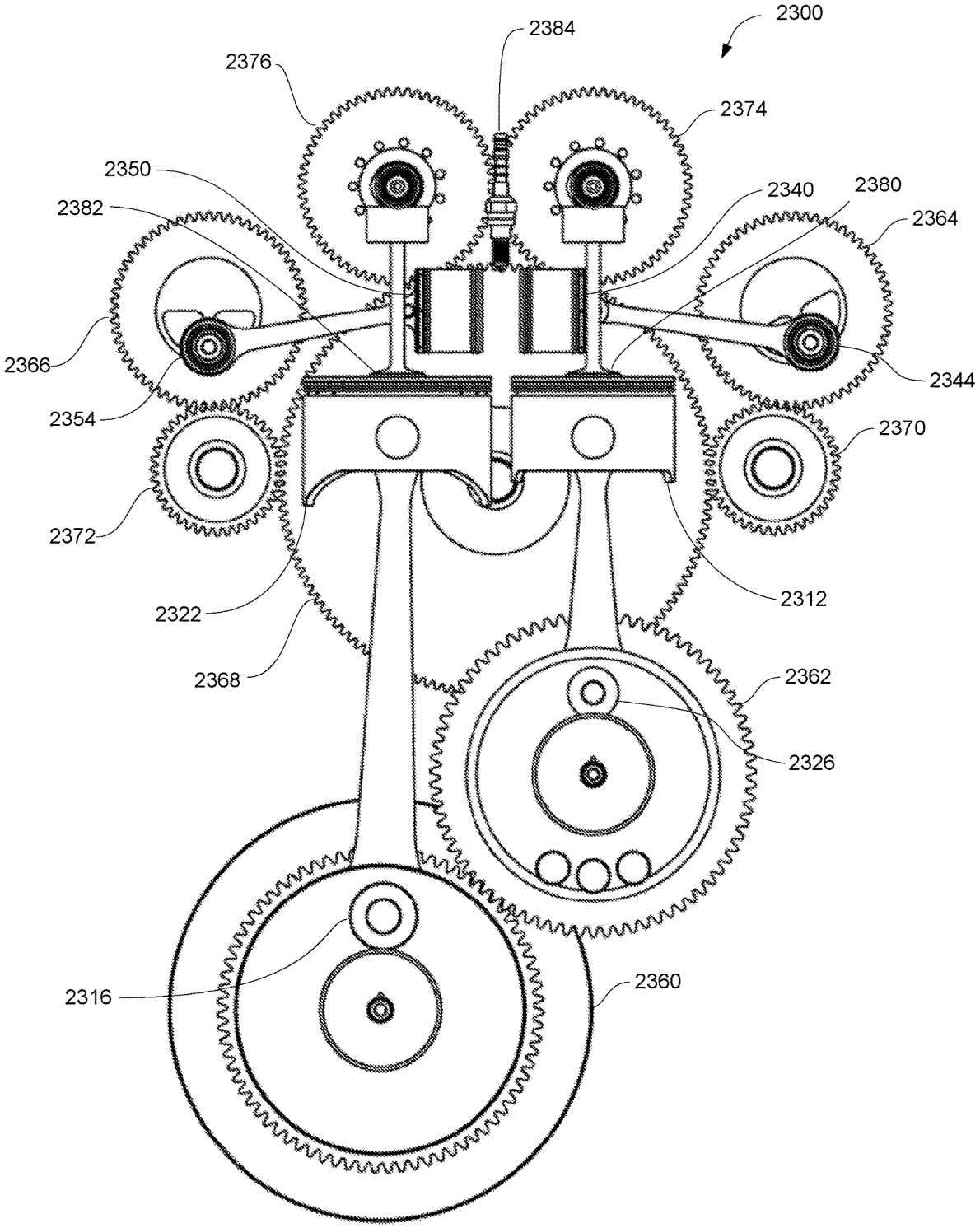
FIGS. 23A-B illustrate a front and back cross-sectional illustration of a split-cycle engine implementing an exemplary 2PTM with exemplary gear driving mechanisms in accordance with embodiments of the disclosure.
Figure 23B:
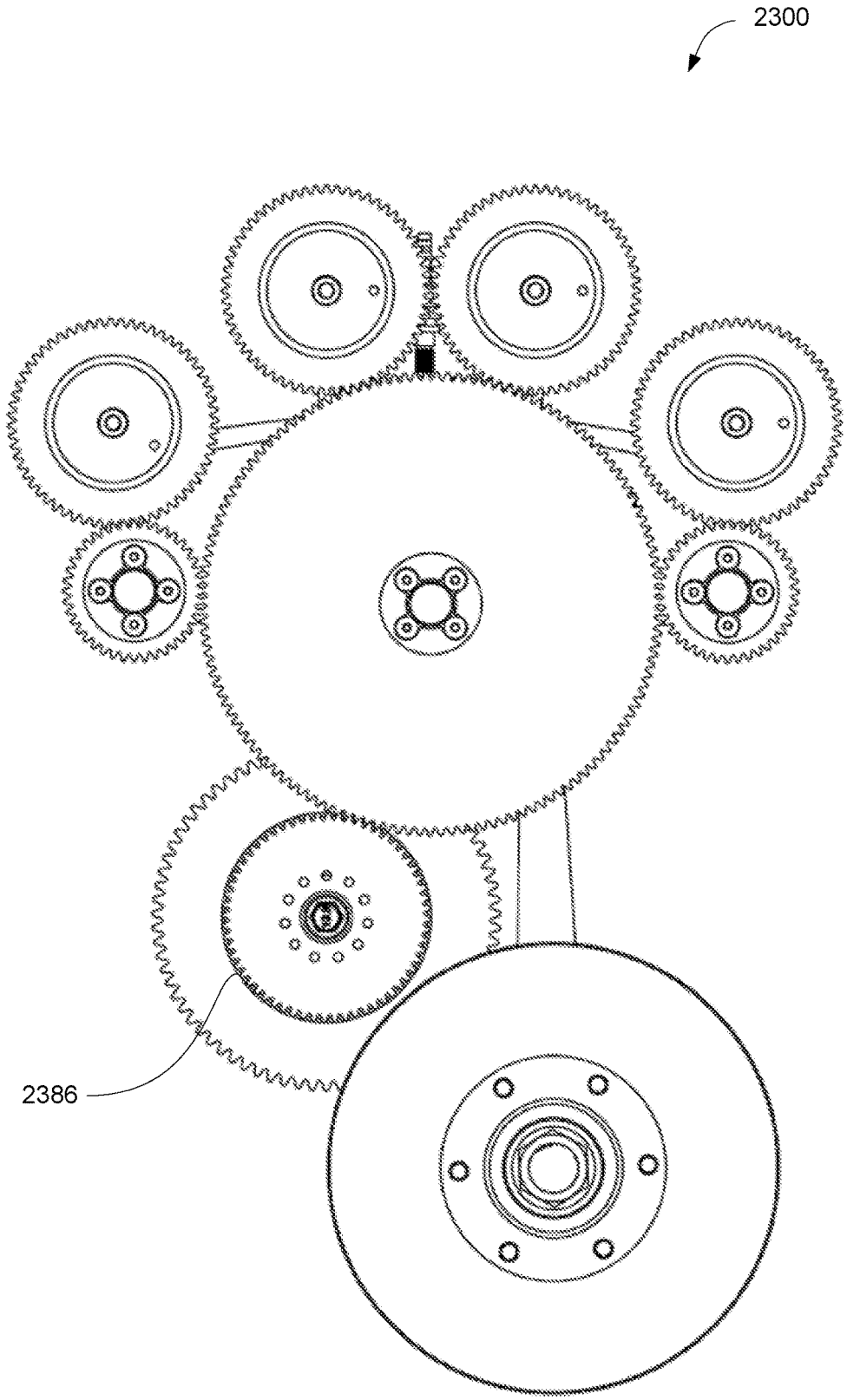

FIGS. 23A-B illustrate a front and back cross-sectional illustration of split-cycle engine 2300 implementing an exemplary 2PTM with exemplary gear driving mechanisms in accordance with embodiments of the disclosure. In some embodiments, split-cycle engine 2300 is similar to split-cycle engine 100 and includes a compression cylinder, expansion cylinder, and transfer cylinder (e.g., which is the same or similar to compression cylinder 110, expansion cylinder 120, and transfer cylinder 130, respectively). In some embodiments, the compression cylinder houses compression piston 2312, the expansion cylinder houses expansion piston 2322, and the transfer cylinder houses transfer pistons 2340 and 2350. In some embodiments, compression piston 2312 is coupled to a connecting rod, which is driven by crankshaft 2326. In some embodiments, expansion piston 2322 is coupled to a connecting rod and driven by crankshaft 2316. In some embodiments, piston 2340 is coupled to a connecting rod and driven by crankshaft 2344. In some embodiments, piston 2350 is coupled to a connecting rod and driven by crankshaft 2354. In some embodiments, the transfer cylinder can include spark plug 2384 configured to ignite compressed working fluid in the transfer chamber.

In some embodiments, split-cycle engine 2300 includes gears 2360, 2362, 2364, 2366, 2368, 2370, 2372, 2374, and 2376. In some embodiments, gear 2360 is coupled to crankshaft 2316. In some embodiments, the linear and reciprocating motion of piston 2322 (e.g., the power piston) can drive and control the rotational motion of gear 2360. In some embodiments, gear 2362 is coupled to crankshaft 2326 and drives piston 2312. In some embodiments, the rotation of gear 2362 controls the reciprocating motion of piston 2312. In some embodiments, gear 2364 is coupled to crankshaft 2344 and drives piston 2340. In some embodiments, the rotation of gear 2364 controls the reciprocating motion of piston 2340. In some embodiments, gear 2366 is coupled to crankshaft 2354 and drives piston 2350. In some embodiments, the rotation of gear 2366 controls the reciprocating motion of piston 2350. Thus, in some embodiments, piston 2322 controls the piston timing of split-cycle engine 2300 via driving the rotational motion of gears 2360, 2362, 2364, and 2366 (and thus the reciprocating motions of pistons 2312, 2340, and 2350).

In some embodiments, gear 2360 is coupled to gear 2362 (e.g., the teeth of gear 2360 are coupled to the teeth of gear 2362 such that the teeth of gear 2360 and the teeth of gear 2362 are in mesh). In some embodiments, rotating gear 2360 in one direction causes a corresponding and opposite rotation in gear 2362 (e.g., when gear 2360 rotates counterclockwise, then gear 2362 can rotate clockwise). In such embodiments, the movement (e.g., reciprocating motion) of piston 2312 and piston 2322 is synchronized. In some embodiments, gear 2362 is coupled to gear 2368. In some embodiments, gear 2362 has a smaller track of teeth or coaxial gear 2386 coupled to the back side of gear 2362 (as shown in FIG. 23B), which is in mesh with the teeth of gear 2368. In some embodiments, gear 2362 drives gear 2368 (e.g., the rotation of gear 2362 causes a corresponding and opposite rotation in gear 2368). Thus, in some embodiments, gear 2360 controls the rotation of gear 2362 and gear 2368, thereby controlling the reciprocating motion of piston 2312. In some embodiments, gear 2368 is referred to as an idler gear. Although gear 2368 is illustrated as coupling to gear 2362, which is itself coupled to gear 2360 (e.g., such that gear 2360 drives gear 2368 through gear 2362), it is understood that gear 2368 can alternatively be directly coupled to gear 2360, which is then coupled to gear 2362 (e.g., such that gear 2360 drives gear 2362 through gear 2368).

In some embodiments, gear 2364 is coupled to gear 2370 (e.g., the teeth of gear 2364 are in mesh with the teeth of gear 2370). In some embodiments, gear 2370 is coupled to gear 2368 (e.g., the teeth of gear 2370 are in mesh with the teeth of gear 2368). In some embodiments, rotating gear 2368 in one direction can cause a corresponding and opposite rotation in gear 2370, which can then cause a corresponding and opposite rotation in gear 2364. In some embodiments, gear 2366 is coupled to gear 2372 (e.g., the teeth of gear 2366 are in mesh with the teeth of gear 2372). In some embodiments, gear 2372 is coupled to gear 2368 (e.g., the teeth of gear 2372 are in mesh with the teeth of gear 2368). In some embodiments, rotating gear 2368 in one direction causes a corresponding and opposite rotation in gear 2372, which then causes a corresponding and opposite rotation in gear 2366. Thus, in some embodiments, gear 2368 controls the rotation of gear 2364 and gear 2366, thereby controlling the reciprocating motion of piston 2340 and piston 2350. In such embodiments, the motion of piston 2322, piston 2312, piston 2340, and piston 2350 is synchronized (e.g., due to all four being ultimately linked to gear 2360, which is driven by piston 2322).

In some embodiments, gear 2368 is coupled to gear 2374 and gear 2376. In some embodiments, gear 2374 controls poppet valve 2380. In some embodiments, poppet valve 2380 controls the flow of working fluid into the compression chamber (e.g., during an intake stroke). In some embodiments, gear 2376 controls poppet valve 2382. In some embodiments, poppet valve 2382 controls the flow of burned working fluid (e.g., combustion products) out of the expansion chamber (e.g., during an exhaust stroke). Thus, in some embodiments, gear 2368 controls the intake and exhaust timing of the compression and expansion cylinders. In some embodiments, the motion of poppet valve 2380 and poppet valve 2382 is synchronized to piston 2322, piston 2312, piston 2340, and piston 2350 (e.g., due to being ultimately controlled by gear 2368).

It is understood that the sizes (e.g., radii) of the gears correspond to proportion by which the rotational speed of one gear translates into its respectively coupled gear. For example, a first gear with a radius twice as large as a second gear that it is coupled to can perform one full rotation (e.g., 360 degrees) while the second gear performs two full rotations (e.g., 720 degrees). In some embodiments, the amount of translation is related to the number of teeth along the circumference of a given gear. Thus, as shown in FIGS. 23A-B, the radii of a respective gear control the speed of rotation of the respective gear and therefore the speed of the reciprocating motion of the respective piston. For example, the reciprocating motion of piston 2340 and piston 2350 has a same or similar speed (e.g., because the radii of gear 2364 and gear 2366 are the same or similar) and has the same or similar speed as the reciprocating motion of piston 2310 and piston 2320 (e.g., because the radii of gear 2364 and gear 2366 are the same as the radii of gear 2386).

In some embodiments, any of pistons 2312, 2322, 2340, and 2350 is coupled to its respective control arm using a biaxial wrist pin bearing. In some embodiments, a biaxial wrist pin bearing comprises a wrist pin bearing in which a section of the pin bearing is offset from another section of the pin bearing. For example, a wrist pin bearing has three sections: a left, right and center section (also known as "journals"). The left and right sections (e.g., journals) have the same axis (e.g., be aligned) while the center section (journal) can have an offset axis (e.g., misaligned from the left and right sections). Thus, using a biaxial wrist pin bearing allows the left and right sections to support the load of the piston during a portion of the cycle while the center section is not subject to the load. During a different portion of the cycle, the center section supports the load of the piston while the left and right sections are not subject to the load. Therefore, the biaxial wrist pin bearing has a rocking mechanism during usage, which enables entire length of the wrist pin bearing to be properly coated with oil (e.g., motor oil, transmission oil, or any other lubricant) and increases the durability of the components.

Figure 24:
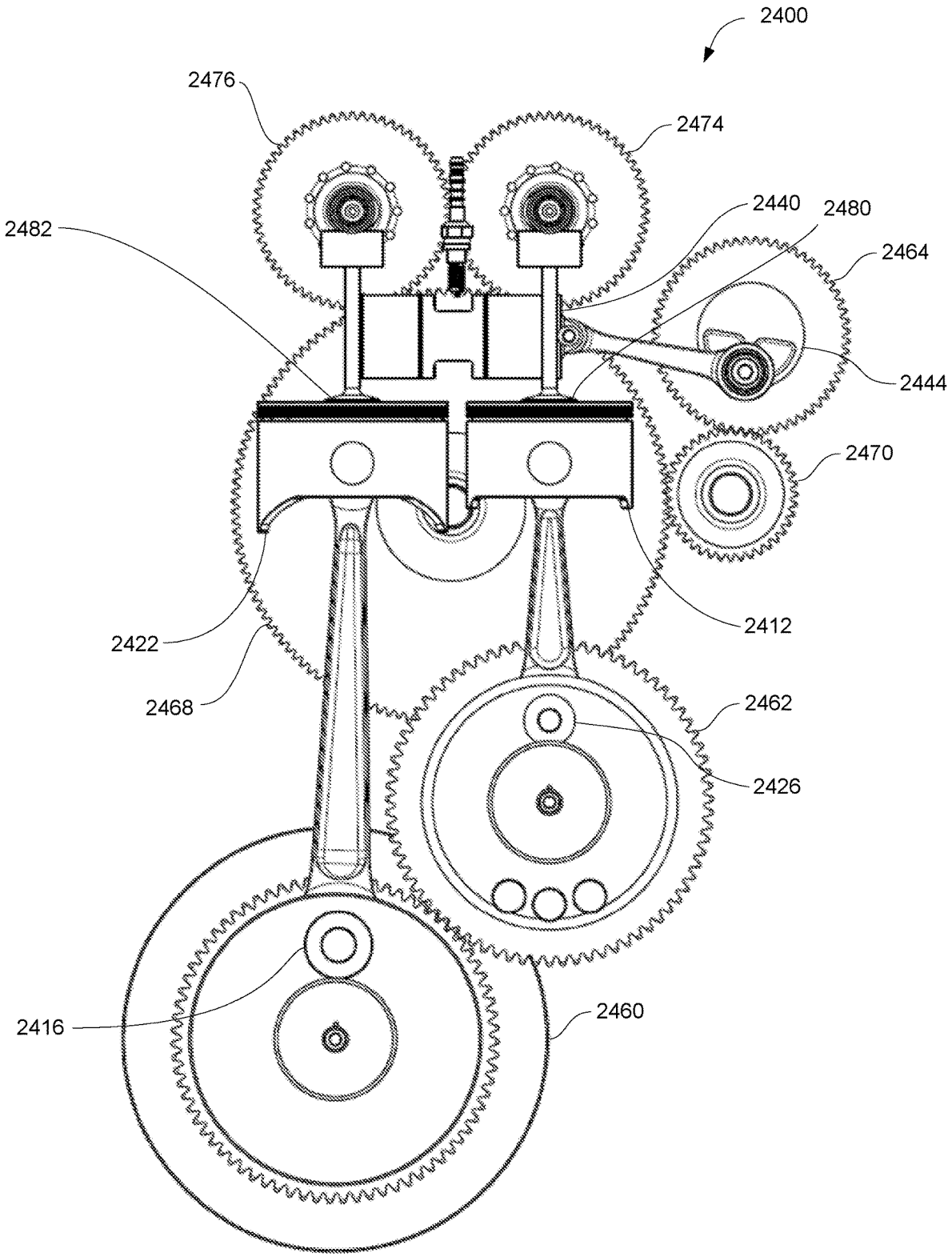
FIG. 24 illustrates a cross-sectional illustration of a split-cycle implementing a shuttle valve transfer mechanism with exemplary gear driving mechanisms in accordance with embodiments of the disclosure.

FIG. 24 illustrates a cross-sectional illustration of a split-cycle engine 2400 implementing a shuttle valve transfer mechanism with exemplary gear driving mechanisms in accordance with embodiments of the disclosure. A shuttle valve transfer mechanism is described in application Ser. No. 14/435,138 and application Ser. No. 15/256,343, which are incorporated by reference for all purposes. In some embodiments, the shuttle valve transfer mechanism is an alternative mechanism that transfers working fluid from a compression chamber to an expansion chamber. In some embodiments, the shuttle valve transfer mechanism comprises a moveable shuttle valve that moves linearly and reciprocally within the transfer cylinder and selectively couple the transfer chamber (e.g., the volume within the shuttle valve) to the compression chamber and/or the expansion chamber.

In some embodiments, split-cycle engine 2400 is similar to split-cycle engine 100 and includes a compression cylinder, expansion cylinder, and transfer cylinder (e.g., which is the same or similar to compression cylinder 110, expansion cylinder 120, and transfer cylinder 130, respectively). In some embodiments, the compression cylinder houses compression piston 2412, the expansion cylinder houses expansion piston 2422, and the transfer cylinder houses spool shuttle 2440. In some embodiments, compression piston 2412 is coupled to a connecting rod, which is driven by crankshaft 2426. In some embodiments, expansion piston 2422 is coupled to a connecting rod and driven by crankshaft 2416. In some embodiments, spool shuttle 2440 is coupled to a connecting rod and driven by crankshaft 2444. In some embodiments, the transfer cylinder includes a spark plug configured to ignite compressed working fluid in the transfer chamber.

In some embodiments, split-cycle engine 2400 includes gears 2460, 2462, 2464, 2468, 2470, 2474, and 2476. In some embodiments, gear 2460 is coupled to crankshaft 2426. In some embodiments, piston 2322 (e.g., power piston) controls and drives the rotational motion of gear 2460. In some embodiments, gear 2462 is coupled to crankshaft 2426 and drives piston 2412 (e.g., compression piston). In some embodiments, the rotation of gear 2462 controls the reciprocating motion of piston 2412. In some embodiments, gear 2464 is coupled to crankshaft 2444 and can drive piston 2440. In some embodiments, the rotation of gear 2464 controls the reciprocating motion of spool shuttle 2440. Thus, in some embodiments, piston 2422 controls the piston and spool shuttle timings of split-cycle engine 2400 via the rotational motion of gears 2460, 2462, and 2464 (and thus the reciprocating motions of piston 2412, and spool shuttle 2440).

In some embodiments, gear 2460 is coupled to gear 2462 (e.g., the teeth of gear 2460 are coupled to the teeth of gear 2462 such that the teeth of gear 2460 and the teeth of gear 2462 are in mesh). In some embodiments, rotating gear 2460 in one direction causes a corresponding and opposite rotation in gear 2462 (e.g., when gear 2460 rotates counterclockwise, then gear 2462 can rotate clockwise). In such embodiments, the movement (e.g., reciprocating motion) of piston 2412 and piston 2422 is synchronized. In some embodiments, gear 2462 is coupled to gear 2468. In some embodiments, gear 2462 has a smaller track of teeth or a coaxial gear coupled to the back side of gear 2462 (not shown), which is in mesh with the teeth of gear 2468. In some embodiments, gear 2468 can drive gear 2462 (e.g., the rotation of gear 2468 causes a corresponding and opposite rotation in gear 2462). Thus, in some embodiments, gear 2468 controls the rotation of gear 2460 and gear 2462, thereby controlling the reciprocating motion of piston 2422 and piston 2412. In some embodiments, gear 2468 is referred to as an idler gear. Although gear 2468 is illustrated as coupling to gear 2462, which is itself coupled to gear 2460 (e.g., such that gear 2460 drives gear 2368 through gear 2462), it is understood that gear 2468 can alternatively be directly coupled to gear 2460, which is then coupled to gear 2462 (e.g., such that gear 2460 drives gear 2462 through gear 2468).

In some embodiments, gear 2464 is coupled to gear 2470 (e.g., the teeth of gear 2464 are in mesh with the teeth of gear 2470). In some embodiments, gear 2470 is coupled to gear 2468 (e.g., the teeth of gear 2470 are in mesh with the teeth of gear 2468). In some embodiments, rotating gear 2468 in one direction causes a corresponding and opposite rotation in gear 2470, which then causes a corresponding and opposite rotation in gear 2464. Thus, in some embodiments, gear 2468 can control the rotation of gear 2464, thereby controlling the reciprocating motion of spool shuttle 2440. In such embodiments, the motion of piston 2422, piston 2412, and spool shuttle 2440 is synchronized (e.g., due to all three being ultimately driven by gear 2468).

In some embodiments, gear 2468 is coupled to gear 2474 and gear 2476. In some embodiments, gear 2474 controls poppet valve 2480. In some embodiments, poppet valve 2480 controls the flow of working fluid into the compression chamber (e.g., during an intake stroke). In some embodiments, gear 2476 controls poppet valve 2482. In some embodiments, poppet valve 2482 controls the flow of burned working fluid (e.g., combustion products) out of the expansion chamber (e.g., during an exhaust stroke). Thus, in some embodiments, gear 2468 controls the intake and exhaust timing of the compression and expansion cylinders. In some embodiments, the motion of poppet valve 2480 and poppet valve 2482 is synchronized to piston 242, piston 2412, and spool shuttle 2440 (e.g., due to being ultimately linked to gear 2460, which is driven by piston 2422).

It is understood that the sizes (e.g., radii) of the gears correspond to proportion by which the rotational speed of one gear translates into its respectively coupled gear. For example, a first gear with a radius twice as large as a second gear that it is coupled to can perform one full rotation (e.g., 360 degrees) while the second gear performs two full rotations (e.g., 720 degrees). In some embodiments, the amount of translation is related to the number of teeth along the circumference of a given gear. Thus, as shown in FIG. 24, the radiuses of a respective gear control the speed of rotation of the respective gear (e.g., rotational speed) and therefore the speed of the reciprocating motion of the respective piston (e.g., linear speed).

In some embodiments, any of pistons 2412 and 2422 is coupled to its respective control arm using a biaxial wrist pin bearing. In some embodiments, a biaxial wrist pin bearing comprises a wrist pin bearing in which a section of the pin bearing is offset from another section of the pin bearing. For example, a wrist pin bearing can have three sections: a left, right and center section (also known as "journals"). The left and right sections (e.g., journals) can have the same axis (e.g., be aligned) while the center section (journal) can have an offset axis (e.g., misaligned from the left and right sections). Thus, using a biaxial wrist pin bearing can allow the left and right sections to support the load of the piston during a portion of the cycle while the center section is not subject to the load. During a different portion of the cycle, the center section can support the load of the piston while the left and right sections are not subject to the load. Therefore, the biaxial wrist pin bearing can have a rocking mechanism during usage, which enables entire length of the wrist pin bearing is properly coated with oil (e.g., motor oil, transmission oil, or any other lubricant) and can increase the durability of the components.

Figure 25:
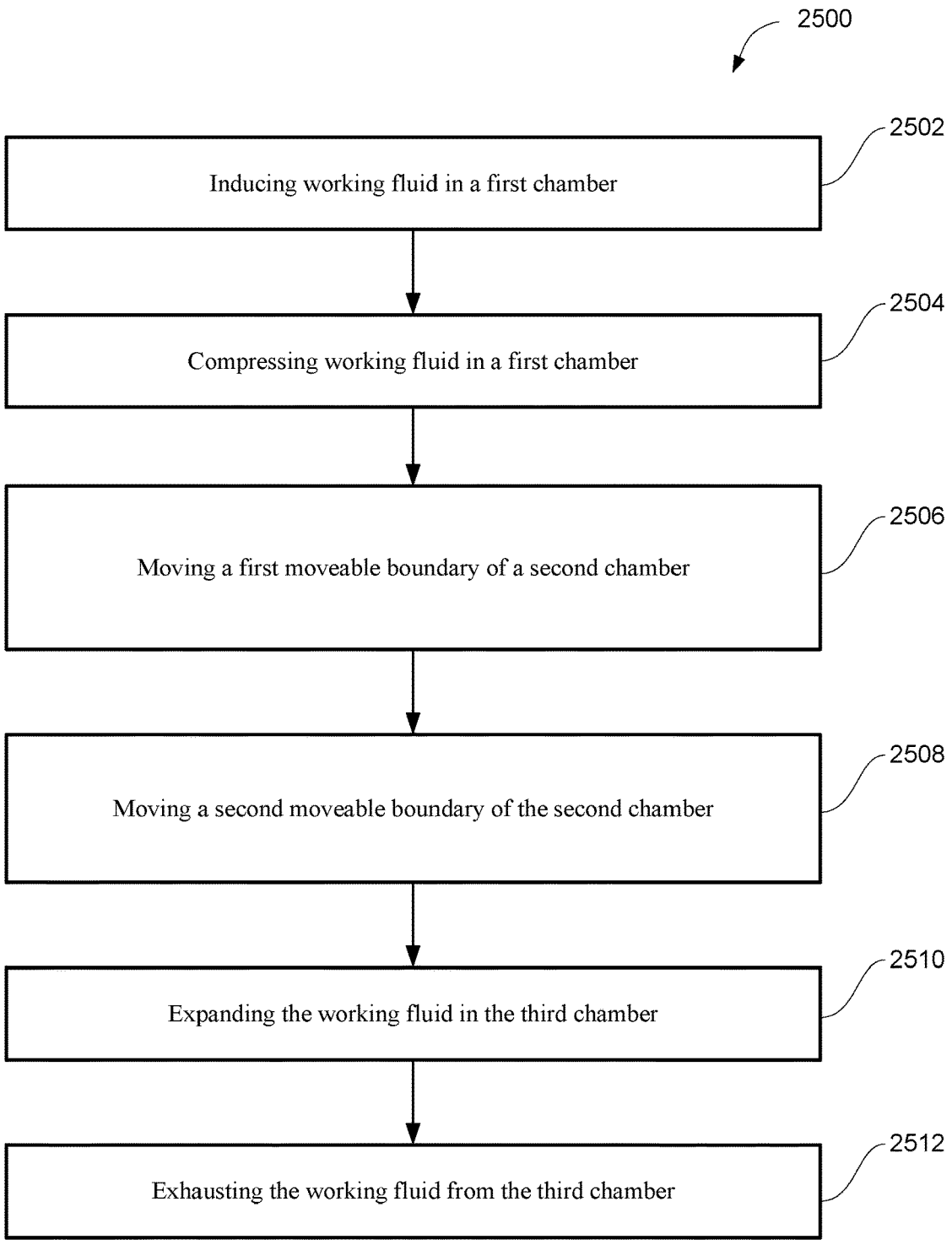
FIG. 25 illustrates an exemplary method of operating a split-cycle engine in accordance with embodiments of the disclosure.

FIG. 25 illustrates an exemplary method 2500 of operating a split-cycle engine in accordance with embodiments of the disclosure. At 2502, working fluid is induced in a first chamber (e.g., such as compression chambers 118, 1518, and/or 1918). In some embodiments inducing the working fluid can occur during the intake stroke of the split-cycle engine. In some embodiments, inducing the working fluid can comprise injecting working fluid into the first chamber.

In some embodiments, the working fluid is induced using an intake valve (e.g., a poppet valve).

At 2504, working fluid is compressed in a first chamber. In some embodiments, the first chamber is a volume in a first cylinder (e.g., such as compression cylinders 110, 1510, and/or 1910). In some embodiments, compressing working fluid in the first chamber is implemented using a piston in the first cylinder (e.g., such as piston 112, 1512, and/or 1912).

At 2506, a first moveable boundary of a second chamber is moved. In some embodiments, moving the first moveable boundary fluidly couples the first chamber with the second chamber and transfers the working fluid from the first chamber to the second chamber. In some embodiments, the first cylinder includes an outlet port (e.g., such as ports 134, 1534, and/or 1934). In some embodiments, the outlet port of the first cylinder is coupled to an inlet port on a second cylinder (e.g., such as transfer cylinders 130, 1530, and/or 1930). In some embodiments, the outlet port of the first cylinder is the same as the inlet port of the second cylinder (e.g., when the first cylinder and second cylinder share a boundary). In some embodiments, the first moveable boundary can selectively couple (e.g., uncover and/or expose) and decouple (e.g., cover and/or seal) the outlet port of the first cylinder and fluidly couple and decouple, respectively, the first chamber with the second chamber. In some embodiments, when the first chamber is fluidly coupled with the second chamber, working fluid can transfer (e.g., move, flow, diffuse) from the first chamber to the second chamber. In some embodiments, when the first chamber is fluidly decoupled from the second chamber, working fluid is prevented from transferring from the first chamber to the second chamber. Thus, during a first time period while the first moveable boundary is moving, the first chamber and second chamber is fluidly decoupled (e.g., when the outlet port of the first chamber is sealed), and during a second time period when the first moveable boundary is moving, the first chamber and the second chamber is fluidly coupled (e.g., when the outlet port of the first chamber is exposed). In some embodiments, the first moveable boundary is implemented using a piston in the transfer chamber (e.g., such as pistons 140, 1540, and/or 1940).

In some embodiments, step 2506 occurs at least partially at the same time as step 2504 (e.g., step 2506 occurs during a portion of step 2504 or step 2506 occurs during step 2504). In some embodiments, while working fluid is compressed in the first chamber, the first chamber is fluidly coupled to the second chamber, and compressing the working fluid in the first chamber also performs the function of transferring fluid from the first chamber to the second chamber and compressing fluid into the second chamber.

At 2508, a second moveable boundary of the second chamber is moved. In some embodiments, moving the second moveable boundary fluidly couples the second chamber with a third chamber (e.g., such as expansion chambers 128, 1528, and/or 1928) and transfers working fluid from the second chamber to the third chamber. In some embodiments, a third cylinder (e.g., such as expansion cylinder 120, 1520, 1920) includes an inlet port (e.g., such as ports 136, 1536, and/or 1936). In some embodiments, the inlet port of the third cylinder is coupled to an outlet port on a second cylinder. In some embodiments, the inlet port of the third cylinder is the same as the inlet port of the second cylinder (e.g., when the second cylinder and third cylinder share a boundary). In some embodiments, the second moveable boundary can selectively couple (e.g., uncover and/or expose) and decouple (e.g., cover and/or seal) the outlet port of the second cylinder and fluidly couple and decouple, respectively, the second chamber with the third chamber. In some embodiments, when the second chamber is fluidly coupled with the third chamber, working fluid can transfer (e.g., move, flow, diffuse) from the second chamber to the third chamber. In some embodiments, when the second chamber is fluidly decoupled from the third chamber, working fluid is prevented from transferring from the second chamber to the third chamber. Thus, during a third time period while the second moveable boundary is moving, the second chamber and third chamber is fluidly decoupled (e.g., when the inlet port of the third chamber is sealed), and during a fourth time period when the second moveable boundary is moving, the second chamber and the third chamber is fluidly coupled (e.g., when the inlet port of the third chamber is exposed). In some embodiments, the second moveable boundary is implemented using a piston in the transfer chamber (e.g., such as pistons 150, 1550, and/or 1950). In some embodiments, the first and second moveable boundaries are concurrently moved (e.g., step 2508 can occur during a portion of step 2506 or step 2508 can occur during step 2506). In some embodiments, the first, second, and third chambers is concurrently fluidly coupled. In some embodiments, any of the first, second, third, and fourth time periods is partially overlapping or fully overlapping.

At 2510, working fluid is expanded in the third chamber. In some embodiments, an ignition source ignites the working fluid causing the working fluid to expand in the third chamber and/or in the second chamber. In some embodiments, the ignition source is one or more spark plugs. In some embodiments, spark plugs are disposed in the second chamber, third chamber, the transfer port between the second and third chamber, or any combination thereof. In embodiments with multiple spark plugs, the spark plugs may ignite simultaneously. In other embodiments, some of the spark plugs may ignite sequentially. In some embodiments, ignition can be achieved by compression of the working fluid (e.g., compression-ignition). In some embodiments, expanding the working fluid in the second and third chamber is transformed into useful work (e.g., via a power stroke). In some embodiments, step 2510 occurs at least partially at the same time as step 2508. In some embodiments, while working fluid is expanding in the third chamber, the third chamber is fluidly coupled to the second chamber, and expanding the working fluid in the third chamber occurs at the same time as while the working fluid is transferred from the second chamber to the third chamber.

At 2512, the burned working fluid (e.g., combustion products) is exhaust from the third chamber. In some embodiments exhausting the working fluid can occur during the exhaustion stroke of the split-cycle engine. In some embodiments, exhausting the working fluid can opening an exhaust valve (e.g., a poppet valve) and expelling the working fluid via the movement of the expansion piston. In some embodiments, the second chamber is still fluidly coupled to the third chamber while working fluid is exhaust from the third chamber. In such embodiments, the working fluid is also exhaust from the second chamber.

Figure 26A:
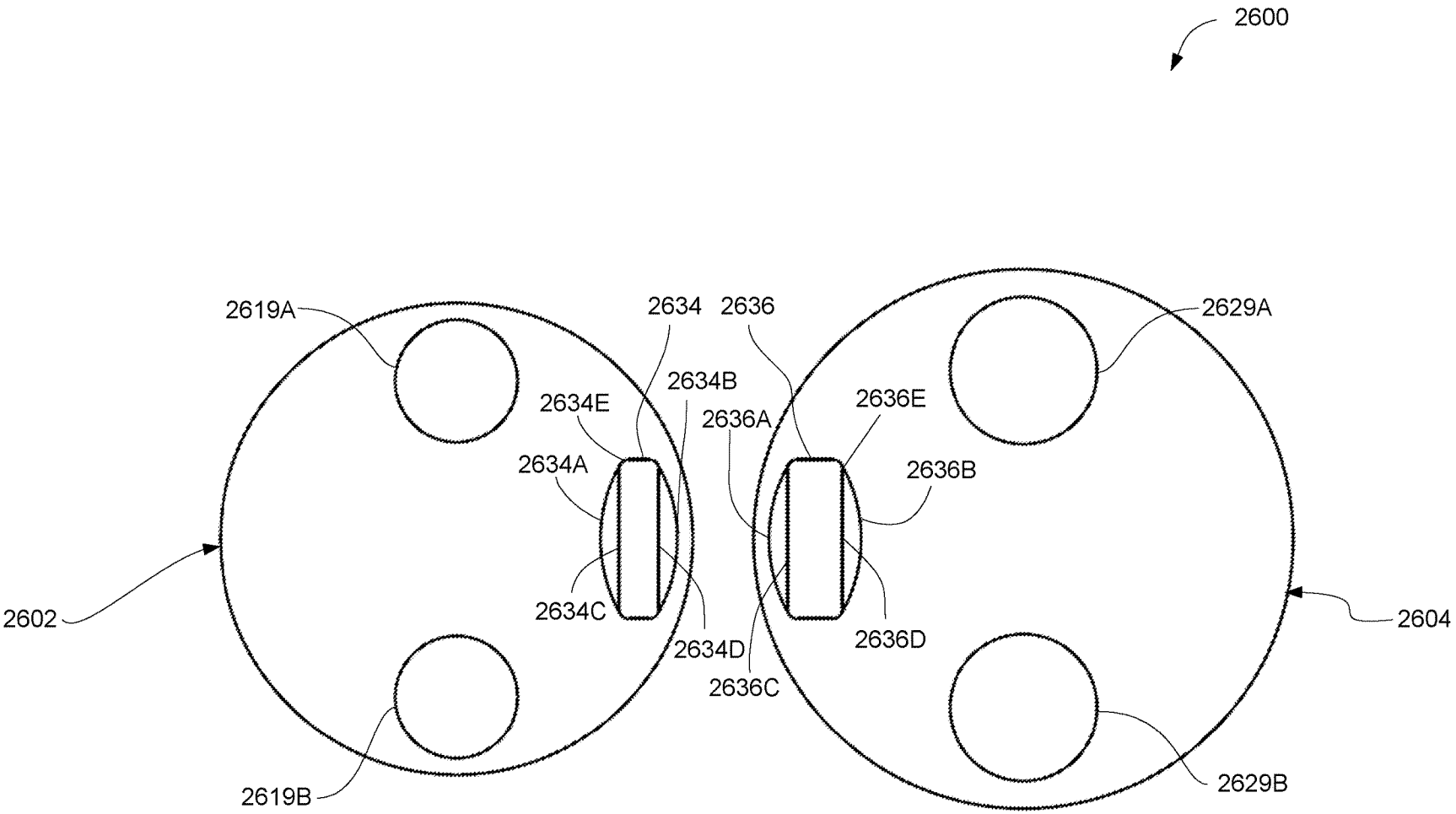
FIG. 26A illustrates a cross-section of a split-cycle engine implementing a 2PTM with beveled transfer ports in accordance with embodiments of the disclosure.

FIG. 26A illustrates a cross-section 2600 of a split-cycle engine implementing a 2PTM with beveled transfer ports 2634 and 2636 in accordance with embodiments of the disclosure. In some embodiments, transfer port 2634 replaces 134, 1534, and 1934 in the engines described above. The description of those transfer ports (and associated engine structure, function, and timing) applies mutatis mutandis to transfer port 2634 and is not repeated for the sake of brevity. In some embodiments, transfer port 2636 replaces 136, 1536, and 1936 in the engines. The description of those transfer ports (and associated engine structure, function, and timing) applies mutatis mutandis to transfer port 2636 and is not repeated for the sake of brevity.

The cross-section of FIG. 26A is taken through a head of a compression cylinder 2602 and the head of an expansion cylinder 2604. In some embodiments, compression cylinder 2602 is 118, 1518, and 1918 in the engines described above. The description of those compression cylinders (and associated engine structure, function, and timing) applies mutatis mutandis to compression cylinder 2602 and is not repeated for the sake of brevity. In some embodiments, expansion cylinder 2604 is 128, 1528, and 1928 in the engines described above. The description of those expansion cylinders (and associated engine structure, function, and timing) applies mutatis mutandis to expansion cylinder 2604 and is not repeated for the sake of brevity.

Compression cylinder 2602 includes intake valves 2619A and 2619B. In some embodiments, intake valves 2619A and 2619B are intake valves 119, in the engines described above. The description of those valves (and associated engine structure, function, and timing) applies mutatis mutandis to intake valves 2619A and 2619B and is not repeated for the sake of brevity. Expansion cylinder 2604 includes exhaust valves 2629A and 2629B. In some embodiments, exhaust valves 2629A and 2629B are exhaust valves 129 in the engines described above. The description of those valves (and associated engine structure, function, and timing) applies mutatis mutandis to exhaust valves 2629A and 2629B and is not repeated for the sake of brevity.

Each of transfer ports 2634 and 2636 includes a beveled left-edge (2634A and 2636A, respectively) and beveled right edge (2634B and 2636B, respectively). Advantageously, the beveled edge may ease a sealing ring of two 2PTM pistons (not shown) into and out of ports 2634 and 2636 and into and out of having full contact with the transfer cylinder bore (transfer cylinder 130 in FIG. 1; described below with respect to FIG. 26B) of the 2PTM. Using the left edge of transfer port 2634 (2634A) as an example (with the understanding that the following description applies equally to the right edge of transfer port 2634 (2634B) and the right and left edges of transfer port 2636; 2636A and 2636B, respectively), the left edge has an upper portion 2634A that lies to the left of a lower portion 2634C (similarly, upper portions 2634B, 3636A, and 2636B have lower portions 2634D. 3636C, and 2636D, respectively). The lower portion 2634C might correspond to the left edge of the compression cylinder head at the top of the compression chamber. In a direction starting at the compression chamber and moving toward the transfer chamber, the port widens to upper portion 2634A. In some embodiments, the ports have a constant width near the compression chamber, and then starts to widen. As shown in FIG. 26A, the port edge may also widen along its length (from top to bottom, as shown in FIG. 26A), with the widest portion in the middle of the port and then narrowing down. The left portion 2634A may take a variety of shapes, including oval and circular. In some embodiments, the port edge widening does not vary along its length; in such embodiments, the upper portion 2634A may be a straight line, such as a linear slope from 2634A to 2634C.

Advantageously, the oval and beveled left edge of transfer port 2634 reduces the impact experienced by a sealing ring moving over the edge. For example, a compression ring on transfer piston 140 may wear as it travels from right to left over the step-like edge 134A of transfer port 134. When the compression ring first contacts the edge, any sag in the compression ring toward the compression chamber (caused by e.g., the rings tension, gravity, or material expansion due to temperature) will lead to the ring falling into the port and to a snaling of the compression ring and the port edge, which might cause structural damage to both the rings and the port edge. In contrast, an oval and beveled port edge (such as those described with respect to FIGS. 26A and 26B), and for example 2634A port edge that widens gradually in the direction from the compression chamber to the transfer chamber allows any sagging of the compression ring to gradually fall into the port. More importantly, an oval and beveled port edge for example 2634B port edge that narrows gradually in the direction from the compression chamber to the transfer chamber allows any sagged compression ring to gradually climb out of the port. Initially, the middle of the sag (likely corresponding to the furthest point from the piston head) is pushed back toward the ring groove of the 2PTM piston. As the 2PTM piston continues to move right to left, more of the sagged compression ring is pushed toward the 2PTM piston ring groove, until ultimately the entire compression ring is contacting and concentric with the transfer cylinder bore. This may be particularly advantageous in the 2PTM engines described herein where the pistons travel at close to maximum speed when passing over the edges of the ports.

An oval shaped bevel (as depicted in FIG. 26A) may further reduce impact as more of the compression ring makes contact with the edge. In some embodiments, a bar may cover the transfer port opening in addition to, or in place of, the beveled edge in FIG. 26A and FIG. 26B to reduce the impact when a compression ring makes contact with a transfer port edge. Additional beveling at the ends of the upper portions (e.g., curves 2634E and 2636E) may further reduce wear on the compression ring.

It will be appreciated by those skilled in the art that the port width need not widen in a direction from the compression/expansion chambers to the transfer chamber (e.g., FIG. 26B below). In those embodiments, the change in width across (right to left) the port may be sufficient to reduce the impact on a sealing ring (see below). In further embodiments, the edge of port may be rounded (or otherwise modified) to ease the impact of the compression ring as it contacts the transfer bore.

In exemplary embodiments, the diameter of compression cylinder 2602 is 77 mm, the diameter of expansion cylinder 2604 is 88 mm, the length (top to bottom as shown in FIG. 26A) of transfer ports 2634 and 2636 is 26 mm, the radius of upper portions 2634A, 2634B, 2636A, and 2636B is 24.76 mm, the radius of 2634E and 2636E is 1.6 mm, the widest point of each of transfer ports 2634 and 2636 is 15 mm, the transfer ports are separated by 15 mm at their closest points, the largest width (left to right as shown in FIG. 26A) of transfer port 2634 is 12.5 mm, and the largest width of transfer port 2636 is 15 mm.

Figure 26B:
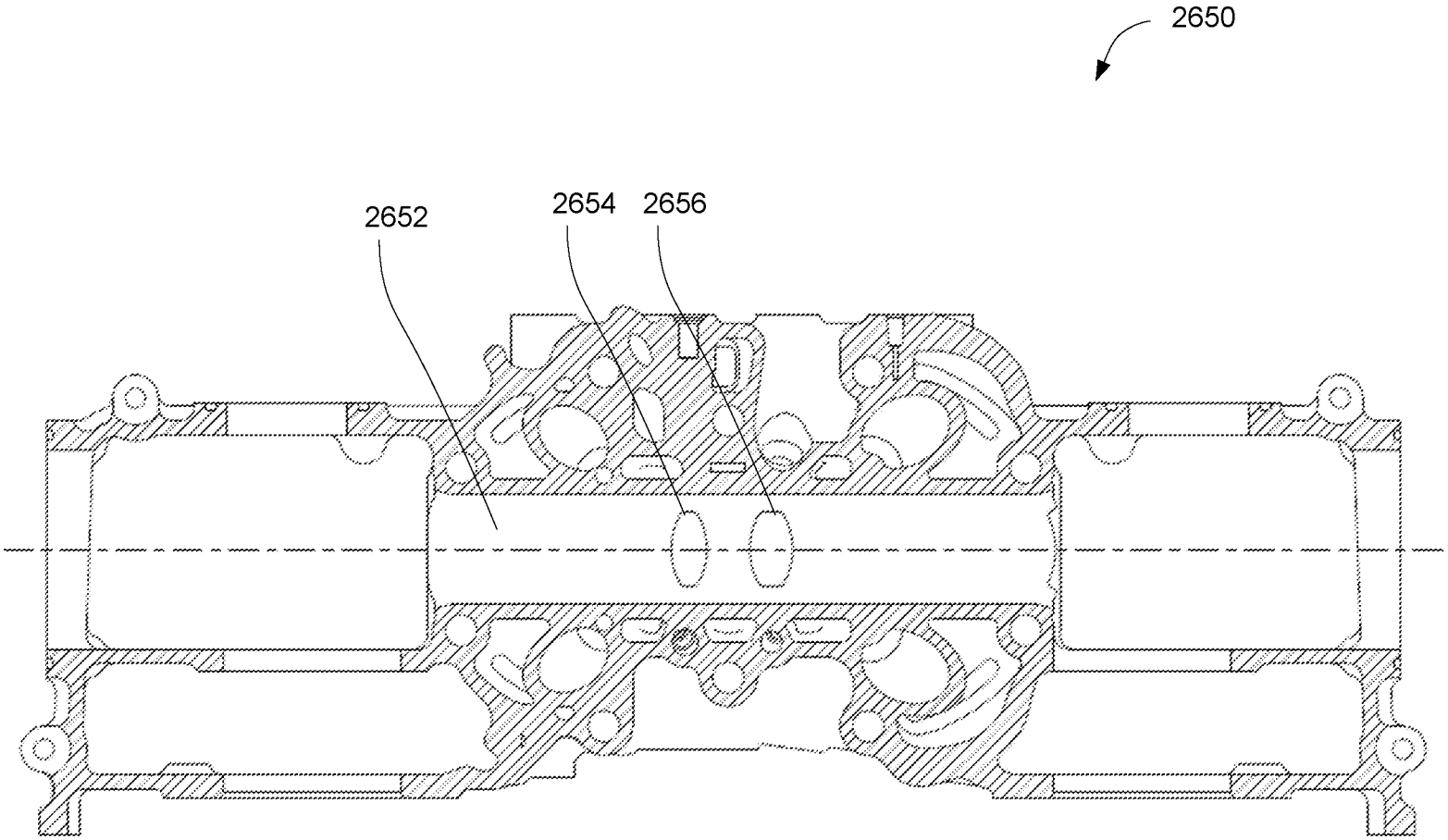
FIG. 26B illustrates a cross-section of a split-cycle engine implementing a 2PTM with beveled transfer ports in accordance with embodiments of the disclosure.

FIG. 26B illustrates a different cross-section 2650 of a split-cycle engine. In FIG. 26B, the cross section is taken through the bore 2652 of the cylinder of the transfer chamber. The bore 2652 includes a cold transfer port 2654 and a hot transfer port 2656 with beveled edges. FIG. 26B illustrates an image of the surface of the bore 2650 from inside the bore and looking toward the expansion and compression chambers. In other words, the edges of transfer ports 2654 and 2656 (as shown in FIG. 26B) are edges contacted by compression rings on the 2PTM pistons travelling within the transfer cylinder. As shown in FIG. 26B, the ports' cross-sectional widths do not change in a direction from the compression/expansion chamber to the transfer chamber (the width is constant from the compression/expansion chamber to the transfer chamber, but varies across the port). In other embodiments, the lower edges of the bore—the edges closer to the compression and expansion chambers—are those depicted in the embodiment of FIG. 26A.)

It will be appreciated by those skilled in the art that the term "beveled edge" does not require the transfer port edge be manufactured through beveling. In some embodiments, the cylinder head is manufactured from a mold where the beveled edge is pre-cast in the mold.

Although the above disclosure describes a transfer mechanism with two pistons, it is understood that other structures is used to implement the above-disclosed method of transferring fluid from a compression chamber to an expansion chamber. For example, the transfer cylinder can have one piston and a moveable interface (e.g., moveable boundary). In some embodiments, the transfer cylinder can have two moveable interfaces (e.g., two moveable boundaries). In some embodiments, the moveable interfaces are planar or non-planar. In some embodiments, a rotary mechanism is used.

In some embodiments, a split-cycle engine includes: a compression chamber, housing a first piston, that induces and compresses working fluid; an expansion chamber, housing a second piston, that expands and exhausts the working fluid; and a transfer chamber having a variable volume that selectively fluidly couples to the compression chamber and the expansion chamber.

In some embodiments of the split-cycle engine, the volume of the transfer chamber decreases while the transfer chamber is fluidly coupled to the expansion chamber.

In some embodiments of the split-cycle engine, the volume of the transfer chamber increases while the transfer chamber is fluidly coupled to the compression chamber, then decreases.

In some embodiments of the split-cycle engine, when the transfer chamber decouples from the expansion chamber, the volume is at a minimum.

In some embodiments of the split-cycle engines, when the transfer chamber couples to the compression chamber, the volume is at a minimum.

In some embodiments, the transfer chamber houses a third piston and a fourth piston, wherein the third piston and the fourth piston move relatively to vary the volume within the transfer chamber. In some embodiments, the volume within the transfer chamber comprises a volume between the third piston and the fourth piston. In some embodiments, the third piston opposes the fourth piston. In some embodiments, the volume within the transfer chamber remains substantially constant during a portion of the cycle of the engine after the transfer chamber fluidly decouples from the expansion chamber. In some embodiments, the compression chamber includes an outlet port; the expansion chamber includes an inlet port; and the relative movement of the third piston and the fourth piston selectively seals and exposes the outlet port of the compression chamber and the inlet port of the expansion chamber. In some embodiments, the third and the fourth pistons move perpendicularly to the first and the second piston. In some embodiments, a phase of the third piston is offset from a phase of the fourth piston. In some embodiments, the phase of the third piston and the phase of the fourth piston is offset by a first offset during a first time period and offset by a second offset, different from the first offset, during a second time period, thereby changing a compression ratio of the split-cycle engine. In some embodiments, the third piston includes a diagonal notch on a leading edge of the third piston closest to the compression and expansion chambers; and the fourth piston includes a diagonal notch on a leading edge of the fourth piston closest to the compression and expansion chambers.

In some embodiments, the volume fluidly decouples from the compression chamber when the first piston is at TDC. In some embodiments, the volume fluidly couples to the expansion chamber when the second piston is at TDC.

In some embodiments, the volume is not simultaneously fluidly coupled to the compression chamber and to the expansion chamber during a cycle of the engine. In some embodiments, the volume simultaneously fluidly couples to the compression chamber and to the expansion chamber during a portion of a cycle of the engine. In some embodiments, the portion of the cycle of the engine comprises a time before the first piston reaches TDC and after the second piston reaches TDC.

In some embodiments, the compression chamber includes an intake mechanism configured to receive an air/fuel mixture. In some embodiments, the intake mechanism is any one of an intake valve or an intake port.

In some embodiments, the expansion chamber includes an exhaust mechanism configured to exhaust combustion product. In some embodiments, the exhaust mechanism is any one of an exhaust valve or an exhaust port.

In some embodiments, the engine includes an ignition source. In some embodiments, the ignition source comprises a spark plug positioned in one of the transfer chamber, the expansion chamber, or an inlet port of the expansion chamber.

In some embodiments, the compression chamber and the expansion chamber have different volumes. In some embodiments, the expansion chamber has a larger volume than the compression chamber.

In some embodiments, the compression chamber and the expansion chamber are arranged in parallel; and the transfer chamber is positioned above and perpendicularly to the compression chamber and the expansion chamber.

In some embodiments, a method of operating an engine includes: inducing working fluid in a first chamber; compressing the working fluid in the first chamber; changing a volume of the second chamber; expanding the working fluid in the third chamber; and exhausting the working fluid from the third chamber.

In some embodiments, while the first chamber is fluidly coupled to the second chamber: increasing the volume, then decreasing the volume.

In some embodiments, when the second chamber fluidly decouples from the third chamber, the volume is at a minimum.

In some embodiments, when the first chamber fluidly couples to the second chamber, the volume is at a minimum.

In some embodiments, the second chamber is fluidly decoupled from the third chamber during a third time period; and the second chamber is fluidly coupled to the third chamber during a fourth time period.

In some embodiments, changing a volume of the second chamber includes moving a first moveable boundary of a second chamber and moving a second moveable boundary of the second chamber. In some embodiments, moving the first moveable boundary of the second chamber fluidly couples the first chamber with the second chamber and transfers the working fluid from the first chamber to the second chamber; and moving the second moveable boundary of the second chamber fluidly couples the second chamber with the third chamber and transfers the working fluid from the second chamber to the third chamber. In some embodiments, while moving the first moveable boundary of the second chamber: the first chamber is fluidly decoupled from the second chamber during a first time period; and the first chamber is fluidly coupled to the second chamber during a second time period. In some embodiments, the first moveable boundary and the second moveable boundary are moved concurrently during a portion of an engine cycle.

In some embodiments, fluidly coupling the first chamber with the second chamber comprises exposing an outlet port on the first chamber. In some embodiments, fluidly coupling the second chamber with the third chamber comprises exposing an inlet port on the third chamber.

In some embodiments, the second chamber is not simultaneously fluidly coupled to the first chamber and to the third chamber. In some embodiments, the second chamber is simultaneously fluidly coupled to the first chamber and the third chamber during a portion of an engine cycle.

In some embodiments, the method includes igniting the working fluid with an ignition source.

In some embodiments, the first moveable boundary is a first piston; and the second moveable boundary is a second piston.

In some embodiments, the first chamber and the third chamber have different volumes.

As used herein, the term "fluid" is understood to include both liquid and gaseous states.

Although certain embodiments arm described exclusively with respect to an internal combustion engine or an external combustion engine, it should be appreciated that the systems and methods apply equally to external combustion engines, internal combustion engines, and any other engine. In some embodiment, an ignition source inside the internal combustion engine could initiate expansion (for example, spark ignition; SI). In some embodiments, an ignition source is not used to initiate expansion in the internal expansion chamber and combustion may be initiated by compression (compression ignition; CI).

Description of an internal combustion engine—including phase-lag, combustion timing, opposite phase lag, compression piston leading, combustion at the spool and after coupling to the expansion cylinder, and multi-expansion cylinders to a single compression cylinder—are found in PCT Application No. PCT/US2014/047076, the content of which is incorporated herein by reference in its entirety and for all purposes.

Therefore, according to the above, some examples of the disclosure are directed to a split-cycle engine. In some embodiments, the split-cycle engine comprises a compression chamber, housing a first piston, that induces and compresses working fluid; an expansion chamber, housing a second piston, that expands and exhausts the working fluid; and a transfer chamber, housing a third piston and a fourth piston, wherein the third piston and the fourth piston move relatively to vary a volume within the transfer chamber and to selectively fluidly couple the volume within the transfer chamber to the compression chamber and the expansion chamber.

Additionally or alternatively, in some embodiments, the volume within the transfer chamber is at a minimum when the transfer chamber fluidly decouples from the expansion chamber. Additionally or alternatively, in some embodiments, the volume within the transfer chamber remains substantially constant during a portion of the cycle of the engine after the transfer chamber fluidly decouples from the expansion chamber. Additionally or alternatively, in some embodiments, the volume within the transfer chamber comprises a volume between the third piston and the fourth piston. Additionally or alternatively, in some embodiments, the third piston opposes the fourth piston. Additionally or alternatively, in some embodiments, the transfer chamber fluidly decouples from the compression chamber when the first piston is at top dead center (TDC). Additionally or alternatively, in some embodiments, the transfer chamber fluidly couples to the expansion chamber when the second piston is at top dead center (TDC). Additionally or alternatively, in some embodiments, the volume of the transfer chamber decreases while the transfer chamber is fluidly coupled to the expansion chamber. Additionally or alternatively, in some embodiments, the transfer chamber is not simultaneously fluidly coupled to the compression chamber and to the expansion chamber during a cycle of the engine.

Additionally or alternatively, in some embodiments, the transfer chamber simultaneously fluidly couples to the compression chamber and to the expansion chamber during a portion of a cycle of the engine. Additionally or alternatively, in some embodiments, the portion of the cycle of the engine comprises a time before the first piston reaches TDC and after the second piston reaches TDC. Additionally or alternatively, in some embodiments, the third piston includes a diagonal notch on a leading edge of the third piston closest to the compression and expansion chambers; and the fourth piston includes a diagonal notch on a leading edge of the fourth piston closest to the compression and expansion chambers. Additionally or alternatively, in some embodiments, the compression chamber includes an outlet port; the expansion chamber includes an inlet port; and the relative movement of the third piston and the fourth piston selectively seals and exposes the outlet port of the compression chamber and the inlet port of the expansion chamber. Additionally or alternatively, in some embodiments, the compression chamber includes an intake mechanism configured to receive an air/fuel mixture. Additionally or alternatively, in some embodiments, the intake mechanism is any one of an intake valve or an intake port.

Additionally or alternatively, in some embodiments, the expansion chamber includes an exhaust mechanism configured to exhaust combustion product. Additionally or alternatively, in some embodiments, the exhaust mechanism is any one of an exhaust valve or an exhaust port. Additionally or alternatively, in some embodiments, the engine further comprises an ignition source. Additionally or alternatively, in some embodiments, the ignition source comprises a spark plug positioned in one of the transfer chamber, the expansion chamber, or an inlet port of the expansion chamber. Additionally or alternatively, in some embodiments, the compression chamber and the expansion chamber have different volumes. Additionally or alternatively, in some embodiments, the expansion chamber has a larger volume than the compression chamber. Additionally or alternatively, in some embodiments, the compression chamber and the expansion chamber are arranged in parallel; and the transfer chamber is positioned above and perpendicularly to the compression chamber and the expansion chamber. Additionally or alternatively, in some embodiments, the third and the fourth pistons move perpendicularly to the first and the second piston. Additionally or alternatively, in some embodiments, a phase of the third piston is offset from a phase of the fourth piston. Additionally or alternatively, in some embodiments, the phase of the third piston and the phase of the fourth piston is offset by a first offset during a first time period and offset by a second offset, different from the first offset, during a second time period, thereby changing a compression ratio of the split-cycle engine.

Some examples of the disclosure are directed to a method of operating an engine. In some embodiments, the method comprises: inducing working fluid in a rust chamber; compressing the working fluid in the first chamber; moving a first moveable boundary of a second chamber, moving a second moveable boundary of the second chamber; expanding the working fluid in the third chamber; and exhausting the working fluid from the third chamber.

Additionally or alternatively, in some embodiments, moving the first moveable boundary of the second chamber fluidly couples the first chamber with the second chamber and transfers the working fluid from the first chamber to the second chamber: and moving the second moveable boundary of the second chamber fluidly couples the second chamber with the third chamber and transfers the working fluid from the second chamber to the third chamber. Additionally or alternatively, in some embodiments, while moving the first moveable boundary of the second chamber: the first chamber is fluidly decoupled from the second chamber during a first time period; and the first chamber is fluidly coupled to the second chamber during a second time period. Additionally or alternatively, in some embodiments, while moving the second moveable boundary of the second chamber: the second chamber is fluidly decoupled from the third chamber during a third time period; and the second chamber is fluidly coupled to the third chamber during a fourth time period. Additionally or alternatively, in some embodiments, the first moveable boundary and the second moveable boundary are moved concurrently during a portion of an engine cycle. Additionally or alternatively, in some embodiments, fluidly coupling the first chamber with the second chamber comprises exposing an outlet port on the first chamber.

Additionally or alternatively, in some embodiments, fluidly coupling the second chamber with the third chamber comprises exposing an inlet port on the third chamber. Additionally or alternatively, in some embodiments, the second chamber is not simultaneously fluidly coupled to the first chamber and to the third chamber. Additionally or alternatively, in some embodiments, the second chamber is simultaneously fluidly coupled to the first chamber and the third chamber during a portion of an engine cycle. Additionally or alternatively, in some embodiments, the method further comprises igniting the working fluid with an ignition source. Additionally or alternatively, in some embodiments, the first moveable boundary is a first piston; and the second moveable boundary is a second piston. Additionally or alternatively, in some embodiments, the first chamber and the third chamber have different volumes.

It will be appreciated by those skilled in the art that embodiments herein describe, for exemplary purposes, the compression cylinder and the expansion cylinder arranged in parallel and a transfer cylinder positioned above and perpendicular to the compression cylinder and the expansion cylinder. The description is not limited to this arrangement. In some embodiments, the compression and expansion cylinders are not parallel. In some embodiments, the transfer cylinder is not positioned above and/or does not move parallel to the compression cylinder and expansion cylinder.

In the above description of examples, reference is made to the accompanying drawings which form a part hereof, and in which it is shown by way of illustration specific examples that is practiced. It is understood that similar elements are referenced with similar numerals throughout. It is understood that the figures are not necessarily drawn to scale. Nor do they necessarily show all the details of the various exemplary embodiments illustrated. Rather, they merely show certain features and elements to provide an enabling description of the exemplary embodiments. Any variations in font in the diagrams or figures are not intended to signify a distinction or emphasis, except those explicitly described.

Although the present invention has been fully described in connection with embodiments thereof with reference to the accompanying drawings, it is to be noted that various changes and modifications will become apparent to those skilled in the art. Such changes and modifications are to be understood as being included within the scope of the present invention as defined by the appended claims. The various embodiments of the invention should be understood that they have been presented by way of example only, and not by way of limitation. Likewise, the various diagrams may depict an example architectural or other configuration for the invention, which is done to aid in understanding the features and functionality that is included in the invention. The invention is not restricted to the illustrated example architectures or configurations, but is implemented using a variety of alternative architectures and configurations. Additionally, although the invention is described above in terms of various exemplary embodiments and implementations, it should be understood that the various features and functionality described in one or more of the individual embodiments are not limited in their applicability to the particular embodiment with which they are described. They instead can, be applied, alone or in some combination, to one or more of the other embodiments of the invention, whether or not such embodiments are described, and whether or not such features are presented as being a part of a described embodiment. Thus the breadth and scope of the invention should not be limited by any of the above-described exemplary embodiments.

The particular features presented in the dependent claims is combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional." "traditional," "normal," "standard," "known", and terms of similar meaning, should not be construed as limiting the item described to a given time period, or to an item available as of a given time. But instead these terms should be read to encompass conventional, traditional, normal, or standard technologies that may be available, known now, or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated. The presence of broadening words and phrases such as "one or more," "at least." "but not limited to", or other like phrases in some instances shall not be read to mean that the narrower case is intended or required in instances where such broadening phrases may be absent.

We claim:

1. A split-cycle engine comprising:

a compression chamber, housing a first piston, that induces and compresses working fluid;

an expansion chamber, housing a second piston, that expands and exhausts the working fluid; and a transfer chamber, housing a third piston and a fourth piston, wherein the third piston and the fourth piston move relatively to vary a volume within the transfer chamber and to selectively fluidly couple the volume within the transfer chamber to the compression chamber and the expansion chamber, and wherein the third and the fourth pistons move perpendicularly to the first and the second pistons.

2. The engine of claim 1, wherein:

the volume within the transfer chamber is at a minimum when the transfer chamber fluidly decouples from the expansion chamber.

3. The engine of claim 1, wherein:

the volume within the transfer chamber remains substantially constant during a portion of the cycle of the engine after the transfer chamber fluidly decouples from the expansion chamber.

4. The engine of claim 1, wherein:

the volume within the transfer chamber comprises a volume between the third piston and the fourth piston.

5. The engine of claim 1, wherein:

the third piston opposes the fourth piston.

6. The engine of claim 1, wherein:

the transfer chamber fluidly decouples from the compression chamber when the first piston is at top dead center (TDC).

7. The engine of claim 1, wherein:

the transfer chamber fluidly couples to the expansion chamber when the second piston is at TDC.

8. The engine of claim 1, wherein:

the volume of the transfer chamber decreases while the transfer chamber is fluidly coupled to the expansion chamber.

9. The engine of claim 1, wherein:

the volume of the transfer chamber increases while the transfer chamber is fluidly coupled to the compression chamber, then decreases.

10. The engine of claim 1, wherein:

when the transfer chamber decouples from the expansion chamber, the volume of the transfer chamber is at a minimum.

11. The engine of claim 1, wherein:

when the transfer chamber couples to the compression chamber, the volume of the transfer chamber is at a minimum.

12. The engine of claim 1, wherein:

the transfer chamber is not simultaneously fluidly coupled to the compression chamber and to the expansion chamber during a cycle of the engine.

13. The engine of claim 1, wherein:

the transfer chamber simultaneously fluidly couples to the compression chamber and to the expansion chamber during a portion of a cycle of the engine.

14. The engine of claim 13, wherein:

the portion of the cycle of the engine comprises a time before the first piston reaches TDC and after the second piston reaches TDC.

15. The engine of claim 13, wherein:

the third piston includes a diagonal notch on a leading edge of the third piston closest to the compression and expansion chambers; and the fourth piston includes a diagonal notch on a leading edge of the fourth piston closest to the compression and expansion chambers.

16. The engine of claim 1, wherein:

the compression chamber includes an outlet port;

the expansion chamber includes an inlet port; and the relative movement of the third piston and the fourth piston selectively seals and exposes the outlet port of the compression chamber and the inlet port of the expansion chamber.

17. The engine of claim 1, wherein:

the compression chamber includes an intake mechanism configured to receive an air/fuel mixture.

18. The engine of claim 17, wherein:

the intake mechanism is any one of an intake valve or an intake port.

19. The engine of claim 1, wherein:

the expansion chamber includes an exhaust mechanism configured to exhaust combustion product.

20. The engine of claim 19, wherein:

the exhaust mechanism is any one of an exhaust valve or an exhaust port.

21. The engine of claim 1, further comprising an ignition source, wherein the ignition source comprises a spark plug positioned in one of the transfer chamber, the expansion chamber, or an inlet port of the expansion chamber.

22. The engine of claim 21, wherein the ignition source comprises a spark plug positioned in one of the transfer chamber, the expansion chamber, or an inlet port of the expansion chamber.

23. The engine of claim 1, wherein the compression chamber and the expansion chamber have different volumes.

24. The engine of claim 23, wherein the expansion chamber has a larger volume than the compression chamber.

25. The engine of claim 1, wherein:

the compression chamber and the expansion chamber are arranged in parallel; and the transfer chamber is positioned above and perpendicularly to the compression chamber and the expansion chamber.

26. The engine of claim 1, wherein:

a phase of the third piston is offset from a phase of the fourth piston.

27. The engine of claim 26, wherein:

the phase of the third piston and the phase of the fourth piston is offset by a first offset during a first time period and offset by a second offset, different from the first offset, during a second time period, thereby changing a compression ratio of the split-cycle engine.

* * * * *